US006163663A

United States Patent [19]

Shinohara et al.

[11] Patent Number: 6,163,663

[45] Date of Patent: Dec. 19, 2000

[54] IMAGE FORMING APPARATUS USING A DEVELOPER OF A GIVEN POLARITY AND AN EXTERNALLY ADDED ADDITIVE OF AN OPPOSITE POLARITY

[75] Inventors: Seiichi Shinohara, Abiko; Junichi Kato, Toride; Satoru Inami, Kashiwa; Masahiro Yoshida; Yusuke Nakazono, both of Toride, all of Japan

[73] Assignee: Canon Kabushiki Kaisha, Tokyo, Japan

[21] Appl. No.: 09/167,735

[22] Filed: Oct. 7, 1998

[30] Foreign Application Priority Data

| | | | |
|---|---|---|---|
| Oct. 7, 1997 | [JP] | Japan | 9-290295 |
| Oct. 7, 1997 | [JP] | Japan | 9-290296 |
| Oct. 13, 1997 | [JP] | Japan | 9-294960 |
| May 8, 1998 | [JP] | Japan | 10-140454 |

[51] Int. Cl.[7] ..... G03G 15/06

[52] U.S. Cl. ..... 399/55; 399/270; 399/285

[58] Field of Search ..... 399/55, 270, 285, 399/258

[56] References Cited

U.S. PATENT DOCUMENTS

| | | | |
|---|---|---|---|
| 5,066,979 | 11/1991 | Goto et al. | 355/208 |
| 5,202,731 | 4/1993 | Tanikawa et al. | 399/270 |
| 5,212,524 | 5/1993 | Tanikawa et al. | 399/258 |
| 5,521,683 | 5/1996 | Miyamoto et al. | 399/55 |
| 5,659,840 | 8/1997 | Miyamoto et al. | 399/55 |
| 5,678,130 | 10/1997 | Enomoto et al. | 399/55 |

FOREIGN PATENT DOCUMENTS

| | | |
|---|---|---|
| 0154041 | 9/1985 | European Pat. Off. . |
| 0784237 | 7/1997 | European Pat. Off. . |

OTHER PUBLICATIONS

Patent Abstract of Japan, vol. 011, No. 276 (P–613), Sep. 8, 1987 (JP 62–075570).

Patent Abstract of Japan, vol. 097, No. 003, Mar. 31, 1997 (JP 8–305141).

Patent Abstract of Japan, vol. 011, No. 142 (P–573), Dec. 9, 1986 (JP 61–278861).

Patent Abstract of Japan, vol. 018, No. 457 (P–1792), Aug. 25, 1994 (JP 6–148931).

Patent Abstract of Japan, vol. 097, No. 002, Feb. 28, 1997 (JP 8–262,948).

*Primary Examiner*—Fred L. Braun

*Attorney, Agent, or Firm*—Fitzpatrick, Cella, Harper & Scinto

[57] ABSTRACT

An image forming apparatus includes an image bearing member for bearing an electrostatic image; a developer carrying member for carrying a developer and for forming a developing zone with the image bearing member, wherein the developer is externally added with additive having a charging polarity opposite from that of the developer; a voltage applying device for applying a developing voltage to the developer carrying member; voltage a control device for controlling the developing voltage so as to change force for directing the additive toward a non-image portion of the image bearing member in accordance with a number of image forming operations.

19 Claims, 24 Drawing Sheets

IMAGE FORMING APPARATUS USING A DEVELOPER OF A GIVEN POLARITY AND AN EXTERNALLY ADDED ADDITIVE OF AN OPPOSITE POLARITY

FIELD OF THE INVENTION AND RELATED ART

The present invention relates to an image forming apparatus such as a copying machine or a printer which employs an electrostatic recording system or an electrophotographic recording system.

An electrophotographic image forming apparatus such as a laser beam printer or a copying machine which employs an electrophotographic system uses developer (hereinafter, "toner") in the form of powder.

Toner is held in a developer container, which is a developer holding container. It is conveyed to a developer bearing member (hereinafter, "developing sleeve") by a toner conveying means, and is borne on the development sleeve. It is given a predetermined electrical charge by a toner layer regulating member (hereinafter, "doctor blade"), and is transferred onto an image bearing member (hereinafter, "photosensitive member"), to develop an electrostatic latent image on the photosensitive member into a visual image. Thereafter, the visible image is transferred onto a piece of transfer medium such as a sheet of paper by a transferring means, and then is fixed to the transfer medium, in a fixing apparatus. The toner which remains on the photosensitive member without being transferred onto the transfer medium is stripped off from the photosensitive member by a cleaning member placed in contact with the photosensitive member, and is sent to a cleaning container, ending a single cycle of the image forming process, and a user can receive a copy with a desired image.

As one of various image developing methods, a jumping developing method has been known. According to this method, a latent image on a photosensitive member is developed by positioning the toner bearing member of an image developing apparatus close to the photosensitive member, that is, without allowing contact between the two members. At this time, a conventional image developing apparatus which employs a jumping developing method will be described with reference to a typical conventional image developing apparatus depicted in FIG. 12.

In the developing apparatus 7 in FIG. 12, negatively chargeable toner 32 contained in a developer container 3 is borne on a development sleeve 10. As the development sleeve 10 is rotated in the direction of an arrow mark b, the toner borne on the development sleeve 10 is conveyed toward an image developing station, in which the peripheral surfaces of the development sleeve 10 and the photosensitive member 1 directly face each other. On its way to the development station, the toner is regulated by a doctor blade 9 placed in contact with the development sleeve 10, being coated in a thin layer on the peripheral surface of the development sleeve 10. In the developing station, a gap of 50–500 $\mu$m is maintained between the peripheral surfaces of the development sleeve 10 and the photosensitive member 1, and as development bias composed of a DC current and an AC current is applied to the development sleeve 10 from a bias power source 33, the toner coated in a thin layer on the development sleeve 10 jumps over to the electrostatic latent image on the photosensitive member 1, and adheres to it, developing in reverse the latent image into a toner image, i.e., a visible image.

The aforementioned development bias is applied to the development sleeve 10 not only during the period in which the photosensitive member is being actively used for image formation, but also during other periods in which the photosensitive member 1 is being idly rotated in terms of image formation; for example, the prerotation period in which the photosensitive member 1 is rotated prior to an actual image forming operation, the post-rotation period in which the photosensitive member 1 is rotated after the completion of an image forming operation, the period, or interval, between the proceeding and following image formation cycles, and the like.

In such an image developing apparatus as the one described above, there sometimes occurs the so-called "flowing image effect", i.e., a phenomenon that certain portions of a latent image formed on the photosensitive member 1 drop out due to the ozonic compounds generated on the photosensitive member 1.

In order to prevent the occurrence of the "flowing image effect", it is feasible to externally add abrasive additive to developer so that the ozonic compounds are continuously shaved away from the peripheral surface of the photosensitive member 1 during image formation. Presently, however, the addition of external additive to developer has not produced desirable results.

SUMMARY OF THE INVENTION

The primary object of the present invention is to provide an image forming apparatus capable of preventing the flowing image effect caused by the adhesion of ozonic compounds to the image bearing member.

Another object of the present invention is to provide an image forming apparatus capable of polishing clean the peripheral surface of the image bearing member, with the use of external additive externally added to developer.

Another object of the present invention is to provide an image forming apparatus capable of controlling the ratio to toner at which external additive is supplied to the image bearing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the image forming apparatus in accordance with the present invention will be described in detail with reference to the drawings.

Embodiment 1

Figure 1:
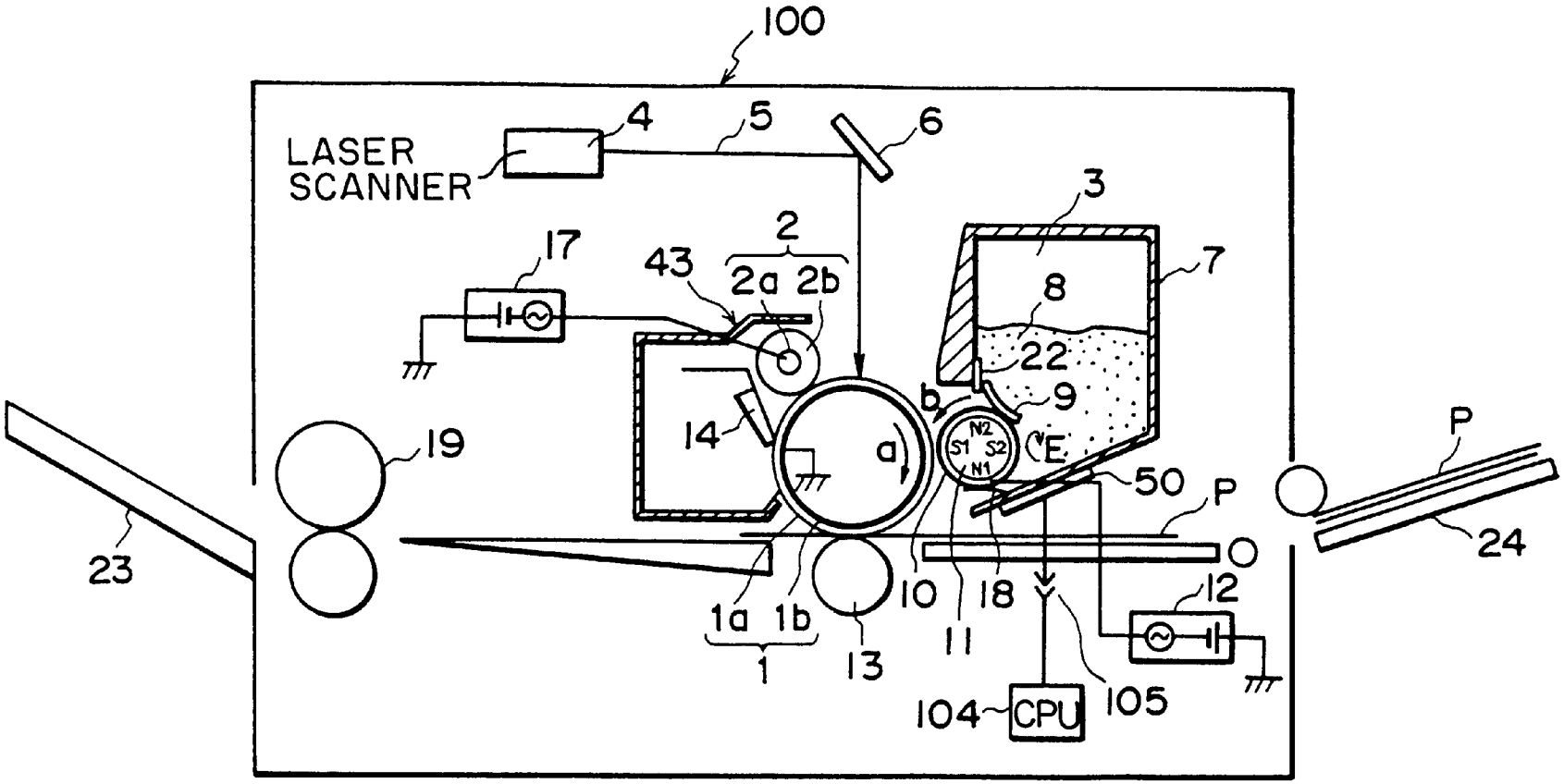
FIG. 1 is a schematic section of the image forming apparatus in the first embodiment of the present invention, and depicts the general structure thereof.

The first embodiment of the present invention will be described with reference to FIGS. 1 through 6. FIG. 1 depicts the image forming apparatus in accordance with the present invention.

An image forming apparatus 100 comprises a process cartridge 43, a transfer roller 13, a fixing apparatus 19, an optical system consisting of a laser scanner 4 and a mirror 6, and the like. The process cartridge integrally comprises several processing apparatuses: a photosensitive member 1, a charge roller 2, a developing apparatus 7, and a cleaning apparatus 14.

The photosensitive member 1 is an image bearing member, and is constituted of an electrically conductive base member 1*b*, which is an aluminum cylinder, and a photoconductor photosensitive layer 1*a*, which is laid on the peripheral surface of the base member 1*b*. It is rotatively driven in the direction indicated by an arrow mark a.

The peripheral surface of the rotating photosensitive member 1 is uniformly charged to the negative polarity by the charge roller 2, and then is exposed to a laser beam 5, which is projected from a laser scanner 4 and deflected by the mirror 6 disposed in the main assembly of the image forming apparatus 100. The laser beam 5 is modulated with sequential digital electric image signals sent from a video-controller (unillustrated), based on the image data. As a result, an electrostatic latent image is formed on the peripheral surface of the photosensitive member 1.

The electrostatic latent image on the photosensitive member 1 is developed in reverse into a toner image, i.e., a visible image, by the toner 8 borne on the development sleeve 10 within the developing apparatus 7.

The toner image is transferred onto a piece of transfer sheet P fed from a sheet feeder tray, by the function of a transfer roller 13. After receiving the toner image, the transfer sheet P is separated from the photosensitive member 1, and is introduced into a fixing apparatus 19, in which the toner image is fixed to the transfer sheet P. Thereafter, the transfer sheet P is discharged from the image forming apparatus main assembly, onto a delivery tray 23.

Meanwhile, the residual toner, that is, the toner which remains on the photosensitive member 1 after the toner image transfer, is removed by a cleaning apparatus 14, and then, the next cycle of image formation begins.

The charge roller 2 is constituted of a metallic core 2*a*, and an elastic rubber layer 2*b* in the form of a roller fitted around the peripheral surface of the metallic core 2*a*. The electrical resistance of the elastic layer is in the medium range. The charge roller 2 is rotatively supported at both longitudinal ends of the metallic core 2*a* by bearings, being kept always in contact with the photosensitive member 1. The charge roller 2 is rotated by the rotation of the photosensitive member 1.

The metallic core 2*a* of the charge roller 2 is electrically connected to a charge bias application power source 17 capable of applying a compound voltage composed of DC voltage and AC voltage. As charge bias is applied to the charge roller 2 through the metallic core 2*a*, the peripheral surface of the photosensitive member 1 is charged to a predetermined potential level.

The developing apparatus 7 employs a noncontact type developing system. It has a development sleeve 10, which bears the toner 8 and conveys it to the photosensitive member 1, and a developer container 3, which stores the toner 8.

The development sleeve 10 is produced by coating carbon dispersed paint on the peripheral surface of a tubular base member, and it is nonmagnetic. The tubular base is formed of aluminum, stainless steel, or the like. The peripheral surface of the development sleeve 10 displays a certain degree of roughness due to the properties of the paint coated thereon, and the roughness contributes to the toner conveyance by the development sleeve 10.

The development sleeve 10 is rotatively supported by unillustrated bearings, and is rotated in the direction indicated by an arrow mark b by the photosensitive member 1 through a gear (unillustrated). The development sleeve 10 is connected to a development bias power source 12 capable of applying compound bias composed of DC bias and AC bias, to the development sleeve 10. As bias is applied to the development sleeve 10 by the development bias power source 12, the latent image on the photosensitive member 1 is visualized as a toner image. Further, the development sleeve 10 is supported so that the peripheral surface of the development sleeve 10 holds a predetermined development gap from the peripheral surface of the photosensitive member 1.

The doctor blade 9 is a toner layer thickness regulating member which regulates the thickness of the layer of the toner 8 on the development sleeve 10. It gives the toner 8 a proper amount of triboelectrical charge, in cooperation with the development sleeve 10; the doctor blade 9 triboelectrically charges the toner 8 to a proper potential level, in cooperation with the development sleeve 10.

As for the material for the doctor blade 9, it is possible to use elastic material such as urethane or silicone rubber, elastic metal such as phosphor bronze or stainless steel, or relatively stiff elastic resin such as polyethylene terephthalate. The doctor blade 9 is welded to a metallic plate 22 fixed to the inside of the developing apparatus 7.

The toner 8 is nonmagnetic, negatively chargeable, single component toner, and is stored in the developer container 3. To the toner 8, external additive (unillustrated) is added to prevent the flowing image effect.

As for the external additive, it is desirable that the external additive is in the form of positively chargeable particles, and is more likely to jump onto the print-less portions of the peripheral surface of the photosensitive member (normal development) than onto the print portions, because the flowing image effect is more likely to occur on the print-less portions. Also, the addition of the external additive to the negatively chargeable toner assures that the toner 8 is triboelectrically charged to a satisfactory potential level from the beginning of the service life of the process cartridge 43, and therefore, desirable images are formed throughout the service life of the process cartridge 43.

As for the positively chargeable particles, strontium titanate particles or Melamine particles, are available. In this embodiment, strontium titanate particles are employed (hereinafter, "positive external additive"). The positive external additive is added to the toner by a ratio of 1.3 percent in weight (hereinafter, "wt. %").

Within the development sleeve 10, a magnetic roller 11 is fixedly disposed. The magnetic toner 11 has four magnetic poles: S1, S2, N1 and N2. The pole S1 is positioned immediately next to the photosensitive member 1, so that the fog causing toner particles remain adhered to the development sleeve 10 while the toner 8 is caused to jump onto the photosensitive member 1 to develop a latent image. The pole S2 is positioned across the magnetic roller 11 from the pole S1, and its function is to attach the toner 8 in the developer container 8 toward the development sleeve 10 so that the toner 8 circulates (in the direction indicated by an arrow mark E in the drawing) adjacent to the development sleeve 10, following the rotation of the development sleeve 10. This circulation of the toner 8 contributes to the triboelectrical charging of the toner 8. The poles N1 and N2 contribute to the conveyance and triboelectrical charging of the toner 8 coated on the development sleeve 10. Although a magnetic roller with four magnetic poles is employed in this embodiment, the number of the magnetic poles does not need to be limited to four; the number does not matter as long as magnetic poles capable of providing the aforementioned functions are present.

Within the developer container 3 located at a position below the development sleeve 10, a toner blowout prevention sheet 18 for preventing the toner 8 from being blown out is disposed to prevent the toner from leaking from the bottom of the development sleeve 10.

The service life of the process cartridge 43 in this embodiment, in terms of the cumulative number of copies, is 5,000 when the average dot ratio per page is 4%.

Below the developing apparatus 7, a data storing means 50, which employs nonvolatile memories, is located. The data storing means 50 is connected to a CPU 104 located in the main assembly of the image forming apparatus 100 through a connecting device 105. In the data storing means 50, the cumulative number of the copies, which is inputted from the CPU 104, is stored, and is increased by one each time a copy is printed. There is no restriction of the data to be stored in the data storing means as long as the cumulative usage of the process cartridge 43 can be detected by the main assembly of the image forming apparatus 100. For example, the cumulative length of time charge bias was applied to the photosensitive member 1 by the charge roller 2, the cumulative length of time the photosensitive member 1 was rotated, and the like, may be stored, which is obvious.

While the process cartridge 43 is in the image forming apparatus 100, the data storing means 50 remains in connection with the CPU 104, and the cumulative number of the printed copies is continuously written into, or read from, the data storing means 50 by the CPU 104.

Next, the development bias applying method in this embodiment will be described.

This embodiment is characterized in that in order to properly adjust the ratio to the toner at which the positive external additive, i.e., the external additive charged to the polarity opposite to that of the developer, jumps onto the photosensitive member 1, throughout the service life of the process cartridge, that is, through the entire length of time the process cartridge 43 remains fit for practical usage, the size of the area of the waveform of the development bias applied to the development sleeve 10, correspondent to the jumping of the positive external additive onto the photosensitive member, on the print-less potions, (hereinafter, simply, "jumping side area size") is varied in response to the cumulative number of the copies printed by the process cartridge 43.

The image forming apparatus 100 in this embodiment was subjected to a durability test, in which 5,000 copies were made, applying a development bias composed of AC and DC components. The AC component had a voltage of 1200 V (Vpp=1200 V) and a frequency of 1800 Hz (Vf=1800 Hz), and the DC component had a voltage of −400 V (Vdc=−400 V). Further, the development bias was given a rectangular waveform with a fixed duty ratio of 1:1. During this test, the ratio to the toner at which the positive external additive jumped onto the photosensitive member 1 was confirmed.

The results of the test show that improvements were made regarding the problem that image density was low at the beginning of the service life, but the effects of this embodiment upon the flowing image effect did not last until the 5000th copy. Further, the results also showed that the streaky images were made at the beginning of the service life, and the images with white spots began to be made past the midpoint of the durability test. Regarding the streaky images, it was discovered that they were made because a portion of the positive external additive escaped through the cleaning point and interfered with the formation of the latent image. As for the direct cause of the images with white spots, it was discovered that they were made because some of the positive additive particles were buried into the peripheral surface of the photosensitive member 1, becoming nuclei to which the toner particles fused (so-called "image with toner fusion spots").

Figure 2:
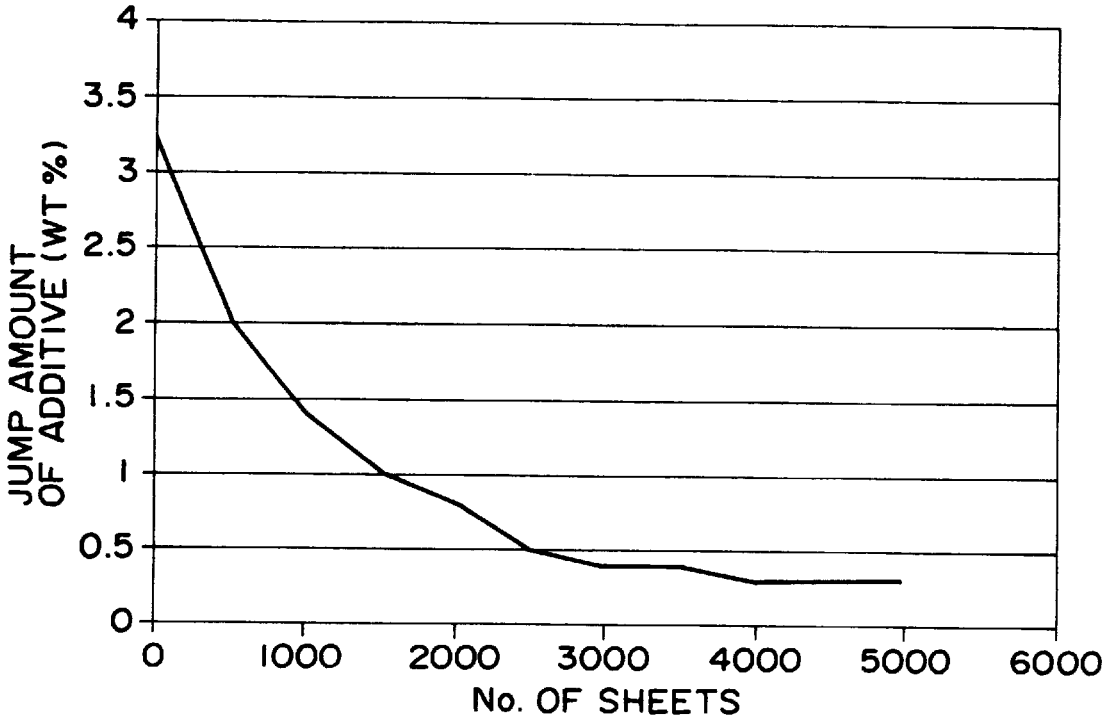
FIG. 2 is a graph which shows the change in the ratio to toner at which positively chargeable external additive jumped onto the photosensitive member when the voltage level of the development bias was kept constant, in the first embodiment.
Figure 3:
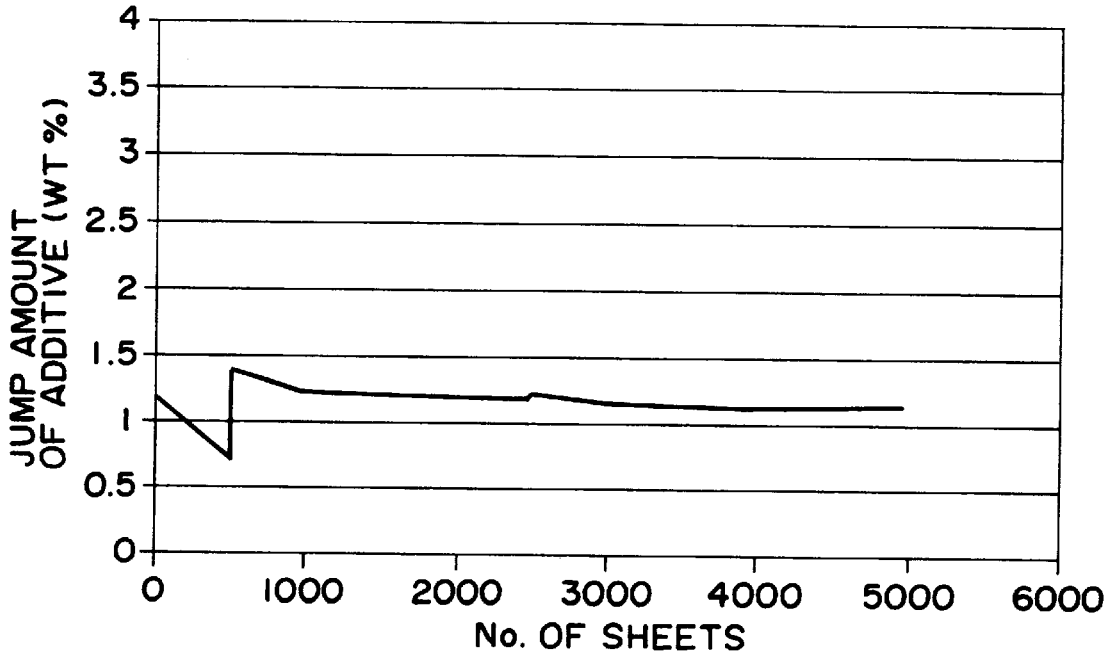
FIG. 3 is a graph which shows the change, in the first embodiment, in the ratio to toner at which the positively chargeable external additive jumped onto the photosensitive member when the size of the area of the development bias waveform, correspondent to the jumping of the positively charged external additive, was controlled.

The change in the ratio at which the positive external additive jumped onto the photosensitive member during the aforementioned durability test is as shown in FIG. 2. As is evident from FIG. 2, the ratio at which the positive external additive jumped onto the photosensitive member was excessive at the beginning of the durability test, but as the test progressed, it gradually decreased, eventually becoming less than the predetermined ratio by which the positive external additive was initially added to the toner. In other words, the excessive jumping of the positive external additive at the beginning caused the failure in cleaning the photosensitive member of the positive external additive, which in turn caused images to be streaky. The excessive jumping of the positive external additive at the beginning also caused the positive external additive to be buried into the peripheral surface of the photosensitive member, which in turn caused the toner to remain adhered to the peripheral surface of photosensitive member (toner fusion). Further, as the test progressed, the ratio at which the positive external additive jumped onto the photosensitive member decreased below the predetermined ratio, becoming no longer effective against the flowing image effect, and as a result, the flowing image effect worsened.

In another durability test, a development bias with a rectangular waveform, the duty ratio of which was variable, was used. In other words, the size of the area of the waveform of the development bias, correspondent to the jumping of the positive external additive, in FIG. 4, was varied, and the ratio at which the positive external additive jumped onto the photosensitive member (hereinafter, "the jumping ratio of the positive external additive") was checked in relation to the size of the aforementioned waveform area.

Next, referring to FIG. 4, the development bias used in this test will be described in detail.

Figure 4:
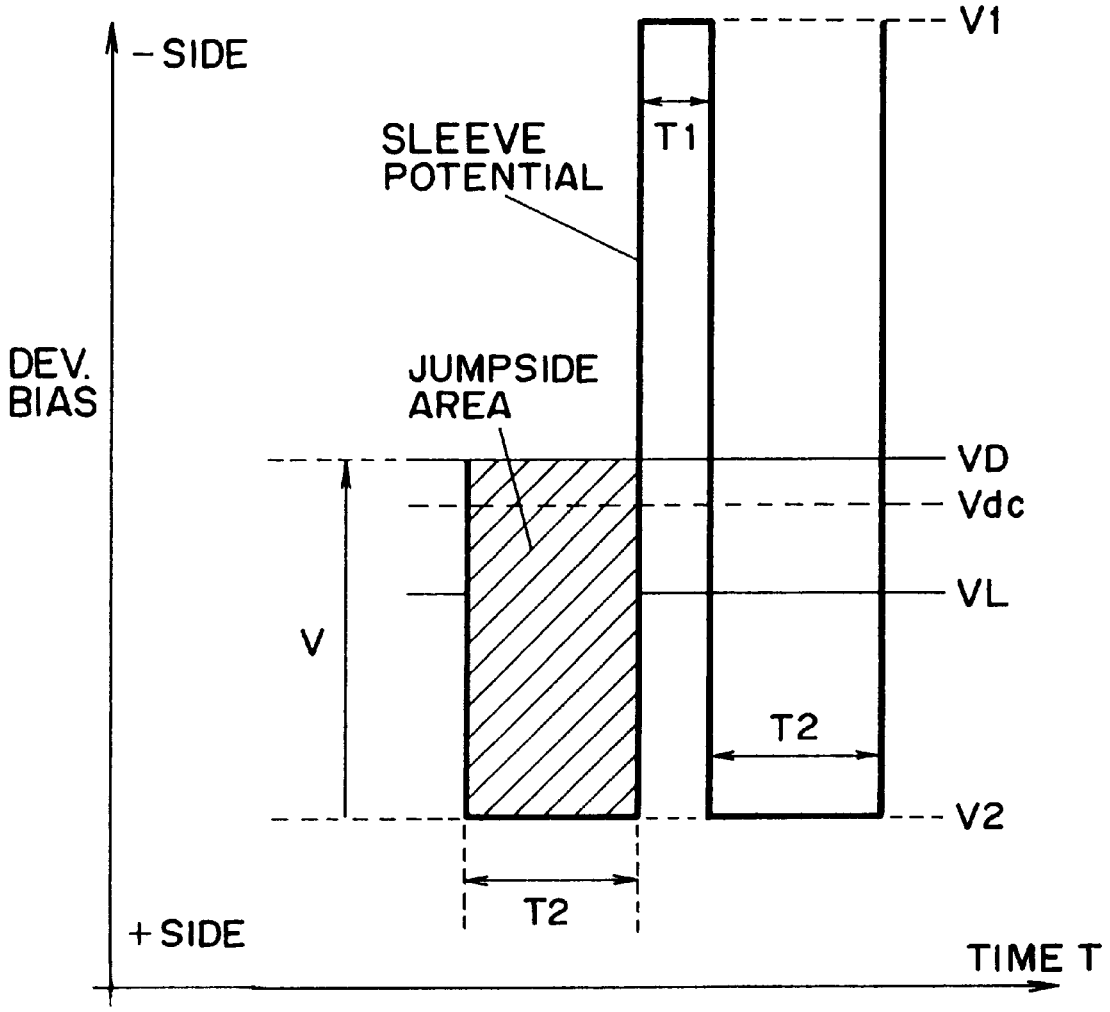
FIG. 4 is an explanatory drawing which graphically depicts the development bias in the first embodiment.

FIG. 4 is an explanatory drawing which depicts a development bias with a frequency of 1800 Hz applied to a development sleeve. A referential code Vdc represents the time-average voltage level of the development bias, that is, an integrated voltage level obtained by integrating the voltage level of the development bias across a single cycle of the development bias (hereinafter, simply, "integrated voltage level"). Referential codes V1 and V2 represent the highest and lowest voltage levels, that is, the peak voltages of the development bias, and referential codes T1 and T2 represent the periods through which the peak voltages V1 and V2 are applied, respectively. It is possible to control image density using this integrated voltage level. A referential code VL represents the surface potential level of the latent image print portions of the photosensitive member, and a referential code VD represents the surface potential level of the latent image print-less portions of the photosensitive member.

The development bias used in this embodiment is such a development bias that has the following specifications: when T1=T2 (duty ratio is 1:1), |V1−V2|=1200 V, and Vdc=−400 V. The potential levels VL and VD are: VL=−150 V, and VD=−650 V. When image density greatly changes due to the controlling of the jumping side area size, the amount of light is adjusted so that the value of |Vdc−VL| remains at 250 V, and also, the development bias is adjusted to shift the entire waveform in the negative or positive side so that the value of |Vdc−VD| remains at 250 V.

On the print portions of the photosensitive member, a latent image with the negative polarity is developed in reverse using the negatively charged toner. More specifically, in the period T1, an electric field works in the direction to induce the toner 8 to move from the development sleeve 10 to the photosensitive member 1 (direction to develop latent image), with a magnitude correspondent to |VL−V1|, and therefore, the toner 8 is affected by a force which works in the same direction with a magnitude proportional to |VL−V1|. On the other hand, in the period T2, an electric field works in the direction to induce the positive external additive to move from the development sleeve 10 to the photosensitive member 1, with a magnitude correspondent to |V2−VL|, and therefore, the positive external additive is affected by a force which works in the same direction with a magnitude proportional to |V2−VL| (in this period T2, force works in the direction to strip the toner away from the photosensitive member and move it to the development sleeve).

On the other hand, on the print-less portions of the photosensitive member, in the period T1, an electrical field works on the toner 8 in the direction to induce the toner 8 to move from the development sleeve 10 toward the photosensitive member 1 (direction to develop latent image on photosensitive member), with a magnitude of |VD−V1|, and therefore, a force with a magnitude proportional to |VD−V1| works on the toner 8 to induce it to move in the same direction, whereas in the period T2, an electric field works on the external additive in the direction to induce the external additive to move from the development sleeve 10 toward the photosensitive member 1 (direction to strip away toner having adhered to photosensitive member), with a magnitude of |V2−VD|, and therefore, a force with a magnitude proportional to |V2−VD| works on the external additive in the same direction.

Referring to FIG. 4, the jumping side area size may be defined as the product of the contrast V between the surface potential level VD of the print-less portions of the photosensitive member and the highest voltage level V2 of the development bias, and the length of the period T2 through which the voltage level of the development bias is highest Table 1 presented below shows the results of a test conducted to confirm the correlation between the jumping side area size and the ratio at which the positive external additive jumped onto the photosensitive member.

TABLE 1

| Jump side area size (V · sec) | Jump amount of additive (% by wt.) |
|---|---|
| ≧0.58 | ≧3.0 |
| 0.50–0.58 | ≧2.0 |
| 0.43–0.50 | ≧1.0 |
| 0.38–0.43 | ≧0.5 |
| <0.38 | <0.5 |

According to Table 1, there is a desirable relationship between the jumping side area size and the ratio at which the positive external additive jumped onto the photosensitive member. As the jumping side area size was reduced, the ratio at which the positive external additive jumped onto the photosensitive member reduced, whereas as the jumping side area size was increased, the ratio at which the positive external additive jumped onto the photosensitive member increased. This implies that the ratio at which the positive external additive jumps can be controlled by controlling the jumping side area size. It was also confirmed that neither of the aforementioned two components of the jumping side area size, i.e., the contrast V and the length of the period T2, displayed a greater correlation with the jumping ratio of the positive external additive, than the other. All that was confirmed was that both the contrast V and the length of the period T2 had some correlation with the jumping ratio the positive external additive. Therefore, the jumping side area size may be controlled by controlling either the magnitude of the contrast V or the length of the period T2, or by controlling both.

Also in the test, the relationship between the ratio at which the positive external additive jumped onto the photosensitive member, and the various image defects (insufficient image density at the beginning of usage, insufficient cleaning of the positive external additive, toner fusion, flowing image effect) was confirmed using the aforementioned development bias, the duty ratio of which is variable.

The results of the test are shown in Table 2 given below. In the table, a reference character o means that no image defect occurred; a referential character Δ means that defects insignificant in terms of practical usage, occurred; and a referential character x means that significant defects occurred.

TABLE 2

| Jump amount of additive | Initial low density | Cleaning defect | Fusion | Flow |
|---|---|---|---|---|
| ≧3.0% by wt. | ○ | x | x | ○ |
| ≧2.0% by wt. | ○ | Δ | Δ | ○ |
| ≧1.0% by wt. | ○ | ○ | ○ | ○ |
| ≧0.5% by wt. | ○ | ○ | ○ | ○ |
| <0.5% by wt. | Δ | ○ | ○ | x |

According to Table 2, there is a clear correlation between the ratio at which the positive external additive jumped and the various image defects. In other words, in order to prevent the occurrence of the insufficient cleaning of the positive external additive and the occurrence of the toner fusion, control should be executed so that the ratio at which the positive external additive jumps onto the photosensitive member is kept below 2.0 wt. %. In order to prevent the image density from becoming too low at the beginning of the service life of the process cartridge 43, or in order to prevent the flowing image effect from occurring, the ratio at which the positive external additive jumps onto the photosensitive member should be kept above 0.5 wt. %. In other words, in order to prevent the occurrence of the above described image defects throughout the service life of the process cartridge 43, i.e., the length of time the process cartridge 43 remains fit, all that is necessary is to keep between 0.5 wt. % to 2.0 wt. %, the ratio at which the positive external additive jumps onto the photosensitive member.

Therefore, it is evident, from the above table which shows the correlation among the jumping ratio of the positive external additive, the jumping side area size, and the various image defects, that in order to maintain desirable image quality, that is, to prevent the occurrence of the aforementioned various image defects, throughout the entire service life of the process cartridge 43, control should be executed so that the jumping side area size remains between 0.38 V.sec and 0.58 V.sec.

In view of the change in the jumping ratio of the positive external additive in the durability test, the results of which are given in FIG. 2, and in which the development bias was fixed, it is evident that the jumping ratio of the positive external additive remained above 2.0 wt. % in the period between the first and 500th copies, and image quality was improved in terms of the insufficient image density at the beginning of the service life of the process cartridge 43, but the insufficient cleaning of the positive external additive occurred.

In the period from the 2500th copy to the 5000th copy, the ratio at which the positive external additive jumped onto the photosensitive member remained below 0.5 wt. %, and the flowing image effect began to occur, progressively worsening. Thus, it may be assumed that the occurrence of the flowing image effect can be prevented throughout the service life of the process cartridge 43 as long as control is executed so that, during the initial period up to the 500th copy, the ratio at which the positive external additive jumps remains above 0.5 wt. % but below 2 wt. % (jumping side area size being between 0.38 V.sec and 0.50 V.sec), preventing the occurrence of the insufficient cleaning and the toner fusion, while improving image quality in terms of the initial insufficient image density, whereas, during the period from the 2500th copy and thereafter, the ratio at which the positive external additive jumps remains above 0.5 wt. % (jumping side area size being above 0.38 V.sec).

Therefore, in this embodiment, in order to output copies with desirable image quality throughout the service life of the process cartridge 43, such an operational sequence is employed that, based on the data stored in the data storing means 50 located in the image forming apparatus 100, the jumping side area size of the development bias is kept at 0.43 V.sec while the cumulative number of printed copies is between 0 and 500; 0.47 V.sec, from 501 to 2500; and 48 V.sec from 2501 to 5000.

Figure 5:
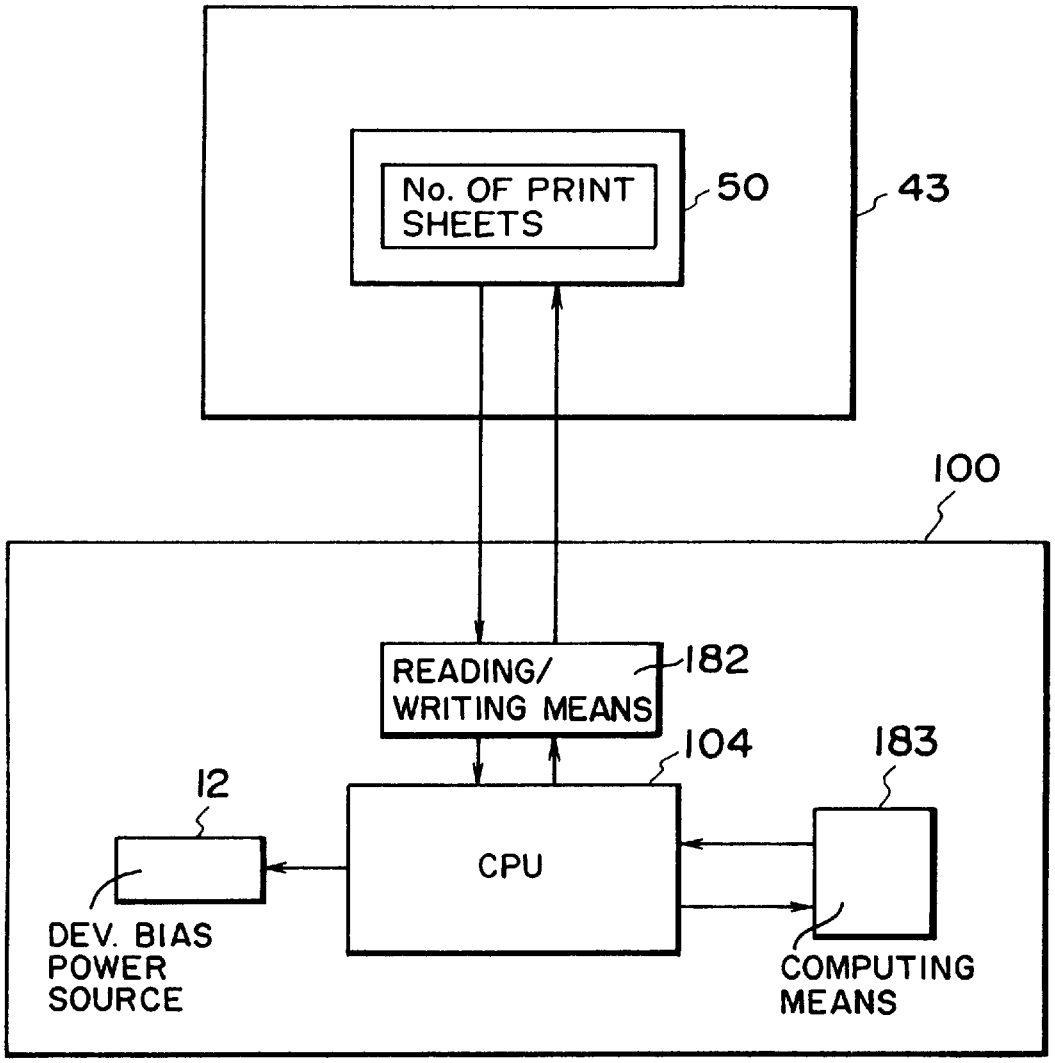
FIG. 5 is a block diagram of the image forming apparatus in the first embodiment.
Figure 6:
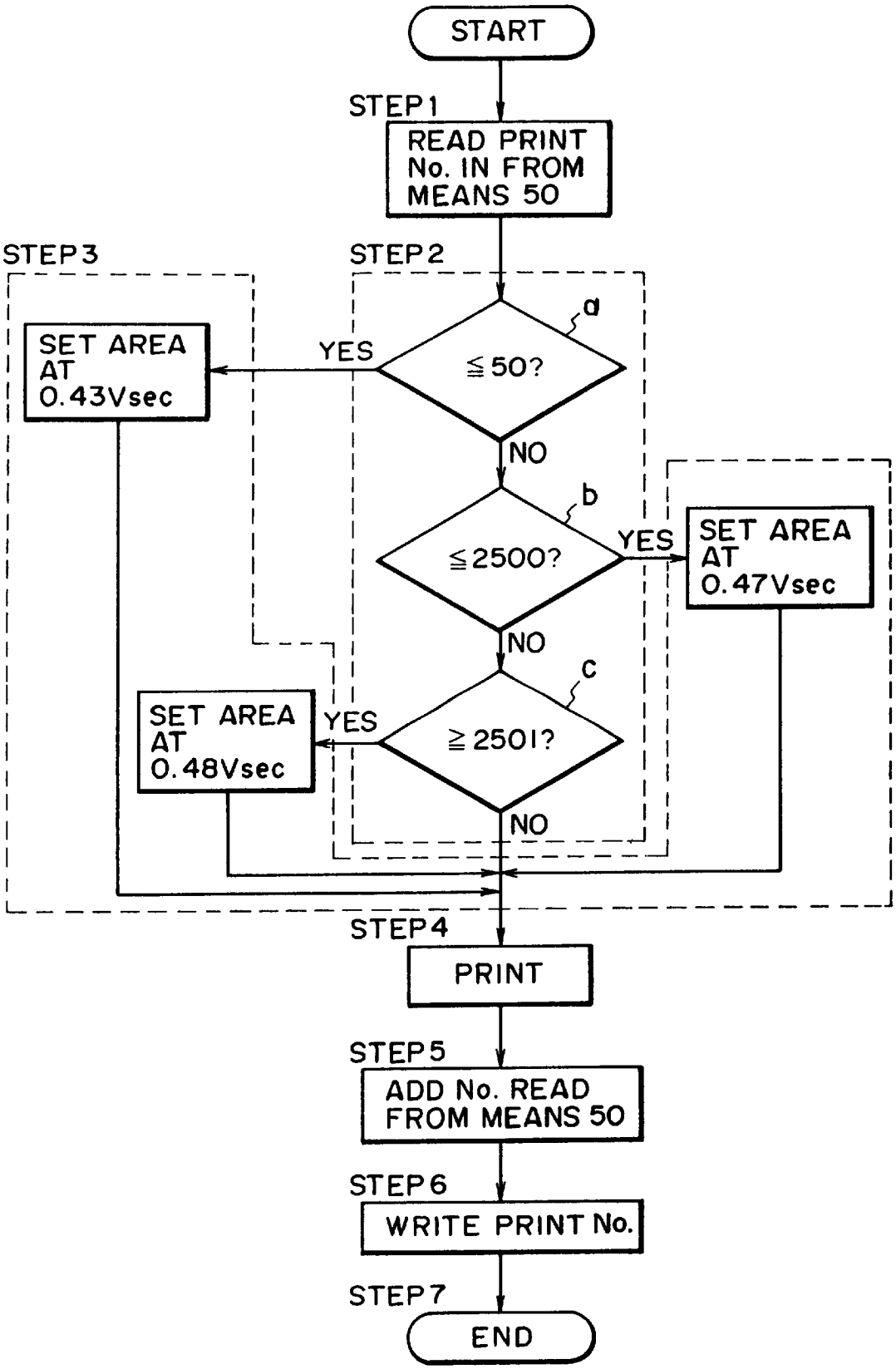
FIG. 6 is a flowchart for controlling the development bias, in terms of the size of the area of the waveform of the development bias, correspondent to the jumping of the positively charged external additive.

Next, referring to FIGS. 5 and 6, the method in this embodiment for controlling the jumping side area size of the development bias in response to the cumulative number of the printed copies will be described in detail. FIG. 5 shows the block diagram for the control sequence in this embodiment.

Referring to FIG. 5, the process cartridge 43 comprises the data storing means 50 which stores the number of the printed copies, and the image forming apparatus 100 comprises a reading/writing means 182, a computing means 183, the development bias power source 12, and the CPU 104. The reading/writing means 182 reads out data from the data storing means 50 or write data into the data storing means 50, and the computing means 183 computes the cumulative usage of the process cartridge 43 based on the data read out of the data storing means 50.

The computing means 183 sends to the CPU 104, a signal that represents the cumulative usage of the process cartridge 43, based on the cumulative number of the printed copies stored in the process cartridge 43.

Receiving the signal from the computing means 183, the CPU 104 controls the jumping side area size of the development bias outputted by the development bias power source 12.

After the printing, the number of the copies just printed is added to the cumulative number of the printed copies read out from the data storing means 50 prior to the current printing operation, and the total is inputted into the data storing means 50 through the reading/writing means 182, and is stored there.

Next, the control, in this embodiment, of the image forming apparatus 100 will be described in detail with reference to FIG. 6.

First, receiving image signal inputted from an image signals inputting means such as a computer, the CPU 104 reads out information regarding the cumulative number of the printed copies from the data storing means 50, through the reading/writing means 182 (Step 1).

Next, the computing means 183 determines in which of the following ranges the cumulative number of the printed copies is: (a) 0–500, (b) 501–2500 or (c) 2501 or more (Step 2).

If it is determined that the cumulative number of the printed copies is in Range (a), the output of the development bias power source 12 is set so that the jumping side area size of the development bias becomes 0.43 V.sec. If it is determined that the cumulative number of the printed copies is in Range (b), the output of the development bias power source 12 is set so that the jumping side area size of the development bias becomes 0.47 V.sec. If the cumulative number of the printed copies is in Range (c), the output of the development bias power source 12 is set so that the jumping side area size of the development bias becomes 0.48 V.sec (Step 3).

Then, a printing operation is carried out using the above settings (Step 4). During the printing operation, the number of the copies printed in the current printing operation is continuously added to the cumulative number of the printed copies read out of the data storing means 50 (Step 5). Next, the cumulative number of the printed copies is written into the data storing means 50 through the reading/writing means 182 (Step 6), and the printing operation is ended (Step 7).

The above-described control method was used to print 5000 copies to test the durability of the process cartridge 43 in terms of image quality. During the test, the ratio at which the positive external additive jumped onto the photosensitive member was also confirmed.

The results of the test showed that the insufficient cleaning of the positive external additive, the toner fusion, and the flowing image effect did not occur, and image quality was stable even in the initial period of the process cartridge usage; desirable copies could be outputted throughout the test. In view of the graph in FIG. 3, which shows the change in the amount of the jumped positive external additive, it is evident that the ratio at which the positive external additive jumped was kept above 0.5 wt. % but below 2.0 wt. % throughout the test.

As described above, in this embodiment, in order to control the ratio at which the positive external additive jumps onto the photosensitive member, development bias, the jumping side area size of which is variable, is used. Therefore, the ratio at which the positive external additive jumps onto the photosensitive member is kept at a proper level throughout the service life of the process cartridge 43, stabilizing image quality during the initial. period of the service life of the process cartridge 43, maintaining the effects of the positive external additive upon the flowing image effect, preventing the production of streaky images, and preventing the toner fusion, so that high quality images can be formed throughout the service life of the process cartridge 43.

Embodiment 2

Figure 7:
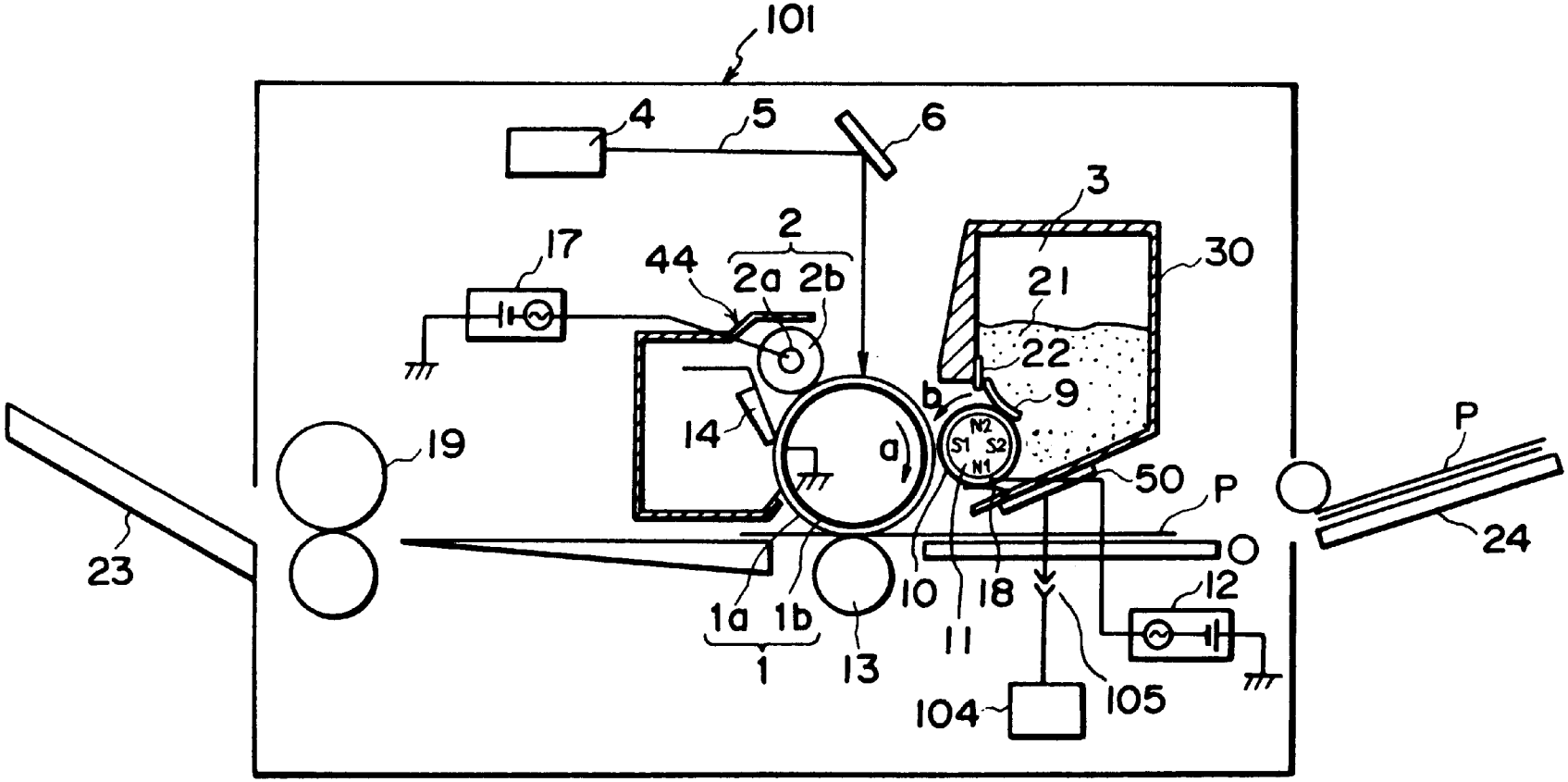
FIG. 7 is a schematic section of the image forming apparatus in the second embodiment of the present invention, and depicts the general structure thereof.

Next, referring to FIGS. 7–11, the second embodiment of the present invention will be described. FIG. 7 depicts the image forming apparatus 101 in this embodiment.

The image forming apparatus 101 comprises a process cartridge 44, a transfer roller 13, a fixing apparatus 19, an optical system consisted of a laser scanner 4, a mirror 6, and the like. The process cartridge 44 integrally comprises processing apparatuses: a photosensitive member 1, a charge roller 2, a developing apparatus 30, and a cleaning apparatus 14. The same components or portions as those in FIG. 1 are given the same reference characters as those in FIG. 1.

In the developer container 3, a toner 21 is held. The positive external additive in the toner 21 is the same as the one in the first embodiment. In this embodiment, the positive external additive is initially added by 0.75 wt. %. The service life of the process cartridge 44 is 4000 copies when the average dot ratio per page is 4%.

Next, the development bias applying method in this embodiment, which is the specific aspect of this embodiment that characterizes it, will be described in detail.

This embodiment is characterized in that in order to prevent the occurrence of the flowing image effect which tends to become worse toward the end of the service life of the process cartridge 44, such development bias is applied that increases, throughout the latter half of the service life of the process cartridge, the ratio to the toner at which the positive external additive jumps onto the photosensitive member during the transfer sheet intervals in a continuous printing operation, and the prerotation period in which the photosensitive member is rotated prior to the formation of a latent image.

The image forming apparatus 101 in this embodiment was subjected to a durability test, in which 4000 copies were made, applying a development bias composed of AC and DC components. The AC component had a voltage of 1600 V (Vpp=1600 V) and a frequency of 2400 Hz (Vf=2400 Hz), and the DC component had a voltage of −400 V (Vdc=−400 V). Further, the development bias was given a rectangular waveform with a fixed duty ratio of 1:1. During this test, the ratio at which the positive external additive jumped onto the photosensitive member was confirmed. The results are as follows: image quality could be improved in terms of the image density start-up at the initial period of the service life of the process cartridge 44, but the effect of the positive external additive in terms of preventing the flowing image effect was satisfactory only up to the 2000th copy, failing to remain satisfactory up to the 4000th copy, or the end of the service life of the process cartridge 44. In addition, images were somewhat streaky during the initial period of the service life, and also, white spots appeared in the images toward the end of the service life, but both defects were at the levels that did not cause any problem in terms of practical usage. It should be noted here that the streakiness and the white spots in this embodiment occurred due to the same causes as those in the first embodiment.

Figure 8:
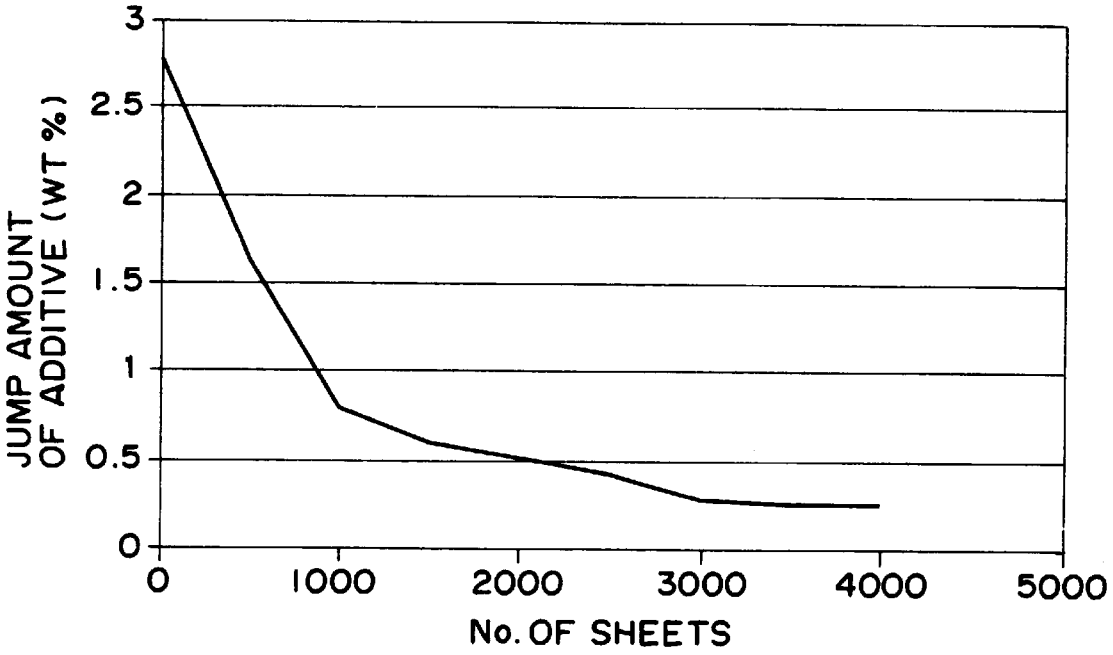
FIG. 8 is a graph which shows the change, in the second embodiment, in the amount of the positively charged additive which jumped onto the photosensitive member when the development bias was kept constant.

The change in the ratio at which the positive external additive jumped onto the photosensitive member in the above endurance test was as shown in FIG. 8. In FIG. 8, the ratio at which the positive external additive jumped onto the photosensitive member was larger during the initial period of the service life of the process cartridge 44, and gradually decreased, eventually decreasing to a level at which the ratio of the positive external additive to the toner on the peripheral surface of the photosensitive member was less than the ratio by which the positive external additive was initially added to the toner. In other words, the higher jumping ratio of the external additive during the initial period of the process cartridge 44 caused the insufficient cleaning of the positive external additive, leading to the creation of the nuclei which was the cause of the toner fusion to the photosensitive member, whereas toward the end of the process cartridge 44, the jumping ratio of the positive external additive became less than the predetermined ratio by which the positive external additive was initially added to the toner, and as a result, the effects of the positive external additive in terms of preventing the flowing image effect gradually diminished, worsening the flowing image effect.

Next, the image forming apparatus 101 in this embodiment was subjected to another durability test which was substantially the same as the first test in this embodiment, except for one aspect of the development bias. More specifically, the development bias applied to the development sleeve 10 had an AC component with a voltage level of 1600 V (Vpp=1600 V) and a frequency of 2400 Hz (Vf=2400 Hz), and a DC component with a voltage of −400 V (Vdc=−400 V), as had the development bias in the preceding test in this embodiment. The waveform was also rectangular. However, in this embodiment, the duty ratio of the development bias was rendered variable. More specifically, during the actual developing period, a development bias with a fixed duty ratio of 1:1 was applied, whereas, during the sheet interval and the prerotation period, a development bias, the duty ratio of which was variable (hereinafter, "sheet interval development bias"), was applied. Then, the ratio at which the positive external additive jumped onto the photosensitive member was measured, while changing the jumping side area size of the waveform of the sheet interval development bias; in the test, the jumping side area size of the sheet interval development bias was varied, and the ratio at which the positive external additive jumped onto the photosensitive member was measured for each of the various jumping side area sizes.

Because this embodiment concerns such flowing image effect that occurs after the printing of the 2000th copy, that is, such flowing image effect that creates a problem in practical usage, this test was carried out after 2000 copies were printed with the use of process cartridge 44. The sheet interval bias in this test was basically the same as that in the first embodiment, except that in this embodiment, |V1−V2|= 1600 V, when T1=T2 in FIG. 4. The frequency of the development bias was 2400 Hz, and Vdc=−400 V. Further, while the sheet interval bias was applied, the surface potential level VD of the photosensitive member was fixed at −650 V. The length of the sheet interval, and the length of the prerotation period, were set to be equivalent to the circumference of the photosensitive member, or a single rotation of the photosensitive member.

Table 3 given below shows the results of this test carried out to confirm the correlation between the jumping side area size and the ratio at which the positive external additive jumped.

TABLE 3

| Jump side area size (V · sec) | Jump amount of additive (% by wt.) |
|---|---|
| ≧0.42 | ≧3.0 |
| 0.37–0.42 | ≧2.0 |
| 0.30–0.37 | ≧1.0 |
| 0.25–0.30 | ≧0.5 |
| <0.25 | <0.5 |

According to Table 3, there was a desirable relationship between the jumping side area size and the ratio at which the positive external additive jumped onto the photosensitive member, which is similar to the relationship in the first embodiment. As the jumping side area size was reduced, the amount of the jumped positive external additive reduced, whereas as the jumping side area size was increased, the amount of the jumped positive external additive increased. The implies that the ratio at which the positive external additive jumps onto the photosensitive member can be controlled by controlling the jumping side area size. It should be noted here that according to Table 3, the ratio of the jumping side area size relative to the amount of the jumped positive external additive in this embodiment is smaller than that in the first embodiment. This is due to the fact that in this embodiment, the ratio of the positive external additive, relative to the toner, which jumped onto the photosensitive member during the actual developing period, was approximately 0.4 wt. %.

It was also confirmed by the test that neither of the aforementioned two components of the jumping side area size, i.e., the contrast V and the length of the period T, displayed a greater correlation with the amount of the jumped positive external additive, than the other. All that was confirmed was that both the contrast V and the length of the period T2 had correlation with the amount of the jumped positive external additive. Therefore, the jumping side area size may be controlled by controlling either the magnitude of the contrast V or the length of the period T2, or by controlling both.

The image forming apparatus 101 was subjected to another test, in which the relationship between the ratio at which the positive external additive jumped onto the photosensitive member, and the various image defects (insufficient image density at the beginning of usage, insufficient cleaning of the positive external additive, toner fusion, and flowing image effect), was confirmed using the aforementioned development bias, the duty ratio of which was variable. This test was carried out also after 2000 copies were printed using the process cartridge 44.

The results of the test are shown in Table 4 given below. In the table, a reference character o means that no image defect occurred; a referential character Δ means that image defects, insignificant in terms of practical usage, occurred; and a referential character x means that significant image defects occurred.

TABLE 4

| Jump amount of additive | Cleaning defect | Fusion | Flow |
|---|---|---|---|
| ≧3.0% by wt. | x | x | ○ |
| ≧2.0% by wt. | Δ | Δ | ○ |
| ≧1.0% by wt. | ○ | ○ | ○ |

TABLE 4-continued

| Jump amount of additive | Cleaning defect | Fusion | Flow |
|---|---|---|---|
| ≧0.5% by wt. | ○ | ○ | ○ |
| <0.5% by wt. | ○ | ○ | x |

According to Table 4, it is clear that there is a definite correlation between the ratio at which the positive external additive jumped onto the photosensitive member and the various image defects. In other words, in order to prevent the occurrence of the insufficient cleaning of the positive external additive and the occurrence of the toner fusion, a control should be executed so that the ratio at which the positive external additive jumps onto the photosensitive member should be kept below 2 wt. % In order to prevent the flowing image effect from occurring, the ratio at which the positive external additive jumps onto the photosensitive member should be kept above 0.5 wt. %. In other words, in order to suppress the flowing image effect, while preventing the occurrence of the insufficient cleaning of the positive external additive and the toner fusion, during the latter half of the service life of the process cartridge 43, all that is necessary is to keep between 0.5 wt. % to 2.0 wt. %, the ratio at which the positive external additive jumps onto the photosensitive member. In other words, it is evident, from the above described correlation among the ratio at which the positive external additive jumped onto the photosensitive member, the jumping side area size, and the various image problems (traceable to insufficient cleaning of positive external additive, toner fusion, and flowing image effect), that in order to prevent the occurrences of the insufficient cleaning of the positive external additive, the toner fusion, and the flowing image effect, the jumping side area size should be kept above 0.25 V.sec but below 0.42 V.sec during the latter half of the service life of the process cartridge 44.

In view of the change in the jumping ratio of the positive external additive in the durability test, the results of which are given in FIG. 8, and in which the development bias was fixed, it is evident that the jumping ratio of the positive external additive remained above 0.5 wt. % but below 3 wt. % in the period between the first and 2000th copy, and image quality was improved in terms of the problems related to the insufficient image density at the beginning of the service life of the process cartridge 43 was improved. Also during this period from the first to the 2000th copy, the insufficient cleaning of the positive external additive occurred, and the toner fusion nuclei were also created, but they were not severe enough to cause problems in practical usage. In the period from the 2000th copy to the 4000th copy, the jumping ratio of the positive external additive remained below 0.5 wt. %, and the flowing image effect began to occur, progressively worsening. This implies that the occurrence of the flowing image effect can be prevented, while improving image quality in terms of the initial insufficiency in image density, throughout the service life of the process cartridge 44, as long as control is executed so that during the period past the 2000th copy, the ratio at which the positive external additive jumps remains above 0.5 wt. % (jumping side area size being above 0.25 V.sec).

Therefore, in this embodiment, in order to output copies with desirable image quality throughout the service life of the process cartridge 44, such an operational sequence is employed that, based on the data stored in the data storing means 50 located in the image forming apparatus 101, the sheet interval development bias is not applied during the period in which the cumulative number of the printed copies is 0–1999, and then, the sheet interval development bias is applied during the period in which the cumulative number of printed copies is 2000–4000, so that the jumping side area size of the development bias is kept at 0.33 V.sec.

Figure 9:
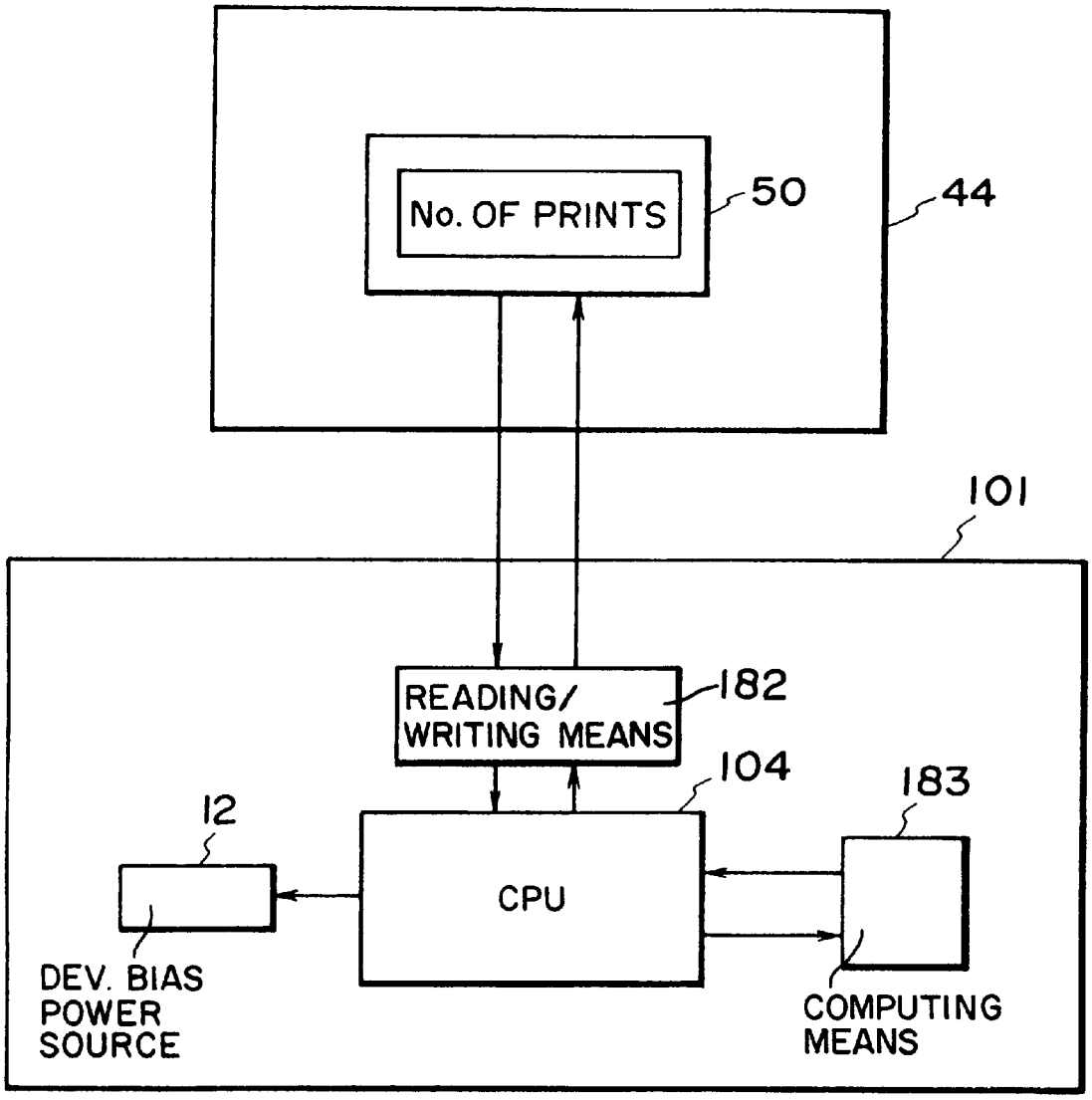
FIG. 9 is a block diagram of the image forming apparatus in the second embodiment of the present invention.
Figure 10:
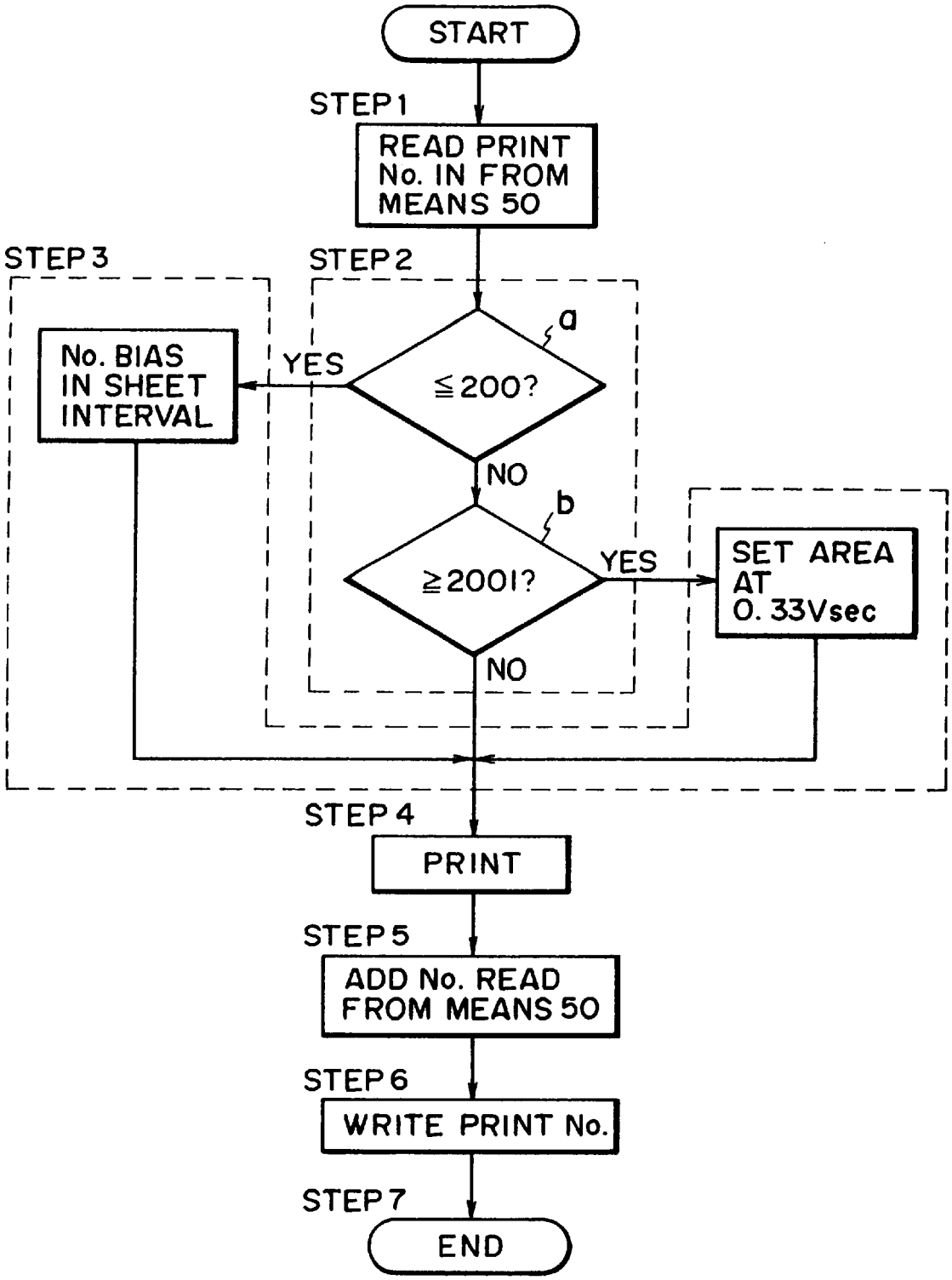
FIG. 10 is a flowchart for controlling the development bias, in terms of the size of the area of the waveform, correspondent to the jumping of the positively charged external additive, in the second embodiment.
Figure 11:
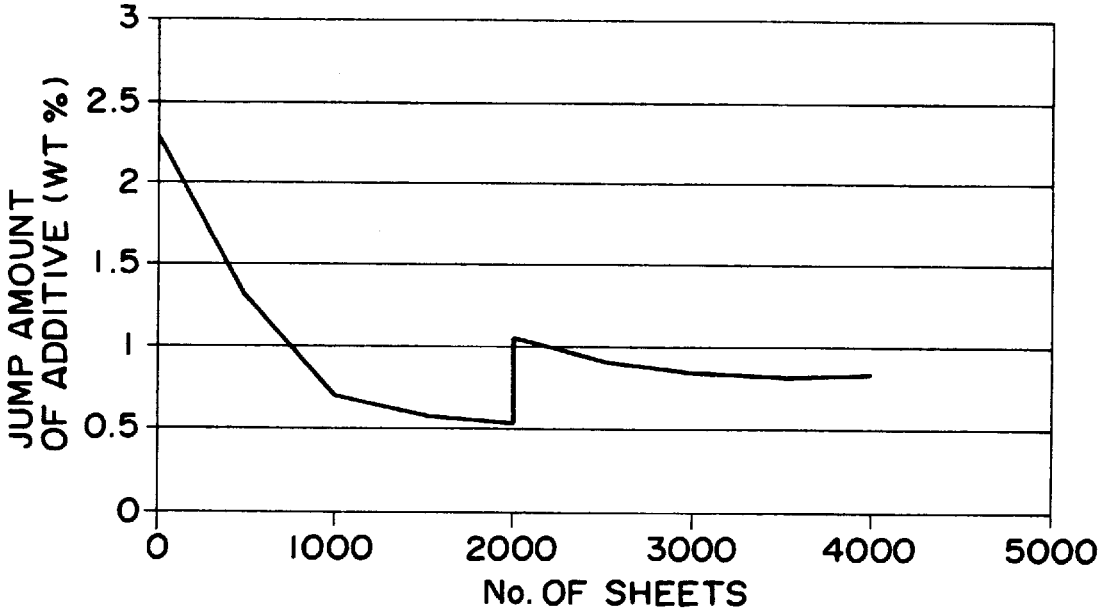
FIG. 11 is a graph which shows the change, in the second embodiment, in the ratio to toner at which the positively charged external additive jumped onto the photosensitive member when the development bias was controlled, in terms of the size of the area of the waveform, correspondent to the jumping of the positively charged external additive.
Figure 12:
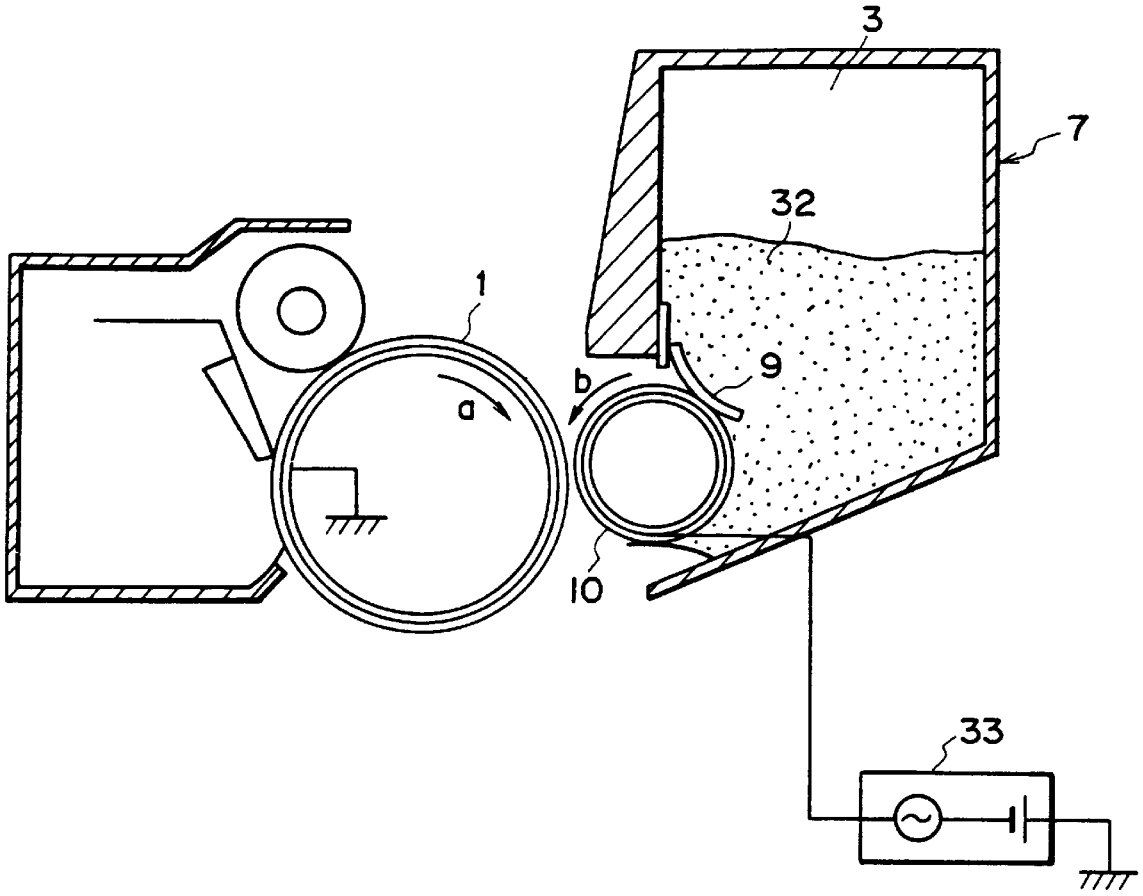
FIG. 12 PRIOR ART
FIG. 12 is a schematic section of a conventional image forming apparatus, and depicts the general structure thereof.

Next, referring to FIGS. 9 and 10, the method in this embodiment for controlling the jumping side area size of the development bias in response to the cumulative number of the printed copies will be described. FIG. 9 shows the block diagram for the control sequence in this embodiment. The same components as those in FIG. 5 are given the same reference characters as those in FIG. 5. The operational structure depicted in FIG. 9 is the same as that in FIG. 5, and therefore, its description will be omitted.

Next, referring to FIG. 10, a flowchart, the control sequence for the image forming apparatus 101 in this embodiment will be described. The first and second embodiments are different only in Steps 2 and 3, and therefore, the descriptions of the steps in this embodiment, other than Steps 2 and 3, which are the same as those in the first embodiment, will be omitted.

In Step 2 in this embodiment, the computing means 183 determines whether the cumulative number of the copies printed by the process cartridge 44 is in a range of (a) 0–2000 or a range of (b) 2001 or more. In Step 3, an arrangement is made so that the sheet interval development bias is not outputted from the development bias power source 12 if it is determined in Step 2 that the cumulative number of the copies printed by the process cartridge 44 is in Range (a), whereas if it is determined that the cumulative number is in Range (b), the sheet interval development bias is outputted from the development bias power source 12, keeping the jumping side area size at 0.33 V.sec.

Using the above-described control method, the image forming apparatus 101 in this embodiment was subjected to a durability test in which 4000 copies were printed. During the test, the ratio at which the positive external additive jumped onto the photosensitive member was also confirmed.

The results of the test showed that the insufficient cleaning of the positive external additive, the toner fusion, and the flowing image effect did not occur; desirable copies could be outputted throughout the durability test. In view of the graph in FIG. 11, which shows the change in the ratio at which the positive external additive jumped, it is evident that the ratio at which the positive external additive jumped was kept above 0.5 wt. % but below 2.0 wt. % during the latter halt of the service life of the process cartridge 44.

As described above, in this embodiment, a sheet interval development bias, the jumping side area size of which can be varied in response to the cumulative number of the copies printed by the process cartridge 44, is used so that the ratio at which the positive external additive jumps onto the photosensitive member can be controlled. Therefore, throughout the service life of the process cartridge 44, the effects of the positive external additive upon the flowing image effect can be maintained, while stabilizing image quality during the initial period of the service life of the process cartridge 44; high quality images can be stably outputted.

Further, in this embodiment, the ratio at which the positive external additive jumps onto the photosensitive member is controlled during the sheet intervals, assuring that the positive external additive jumps onto the photosensitive member at a proper ratio, regardless of the dot ratio during the actual developing period. Also, the jumping side area size is controlled during the period in which image-less portions of the photosensitive member is in the development station, and therefore, it is unnecessary to consider the change in image density caused by the controlling of the jumping side area size. In other words, it is possible to execute drastic control.

Embodiment 3

The structure of the image forming apparatus in this embodiment is the same as that depicted in FIG. 1. In this embodiment, the doctor blade 9, i.e., a toner layer thickness regulating member which regulates the thickness of the layer of the toner 8 on the development sleeve 10, triboelectrically charges the toner 8 to a proper potential level. The toner 8 is magnetic single component toner chargeable to the negative polarity.

As for the means for preventing the flowing image effect, external additive (unillustrated) is added to the toner 8. The flowing image effect is likely to occur corresponding to the print-less portions of the photosensitive member, onto which the toner does not transfer. Therefore, in order to prevent print-less portions of the photosensitive member from causing the flowing image effect, it is desirable to use, as the external additive, the positively chargeable particles, i.e., the particles that normally develops a latent image. As for the positively chargeable particles, strontium titanate particles or Melamine particles, are available. In this embodiment, strontium titanate particles are employed. The strontium titanate particles are initially added to the toner by a ratio of 0.8 wt. %.

The doctor blade 9 is an elastic blade formed of urethane, and is supported by a metallic blade fixed to the internal wall of the developing apparatus 7.

Within the development sleeve 10, a magnetic roller 11 is fixedly disposed. The magnetic roller 11 has four magnetic poles: S1, S2, N1 and N2. The pole S1 is positioned immediately next to the photosensitive member 1, so that the fog causing toner particles are kept adhered to the development sleeve 10 while the toner 8 is caused to jump onto the photosensitive member 1 to develop a latent image.

The pole S2 is positioned across the magnetic roller 11 from the pole S1, and its function is to attract the toner 8 in the developer container 8 toward the development sleeve 10 so that the toner 8 circulates (in the direction indicated by an arrow mark F in the drawing) adjacent to the development sleeve 10, following the rotation of the development sleeve 10. This circulation of the toner 8 contributes to the triboelectrical charging of the toner 8. The poles N1 and N2 contribute to the conveyance and triboelectrical charging of the toner 8 coated on the development sleeve 10. Although a magnetic toner with four magnetic poles is employed in this embodiment, the number of the magnetic poles does not need to be limited to four; the number does not matter as long as magnetic poles capable of providing the aforementioned functions are present Within the developer container 3 located at a position below the development sleeve 10, a toner blowout prevention sheet 18 for preventing the toner 8 from being blown out is disposed to prevent the toner from leaking from the bottom of the development sleeve 10.

The service life of the process cartridge 43 in this embodiment, in terms of the cumulative number of copies, is 3500 copies assuming that the average dot ratio per page is 4%.

At this time, the development bias in this embodiment, which is what characterizes the present invention, will be described in detail.

In this embodiment, a latent image is developed using a single component developer, and in order to prevent the external additive added to the developer from transferring by a large amount onto the print-less portions of the photosensitive member during the image developing period, or to prevent the external additive from transferring to the peripheral surface of the photosensitive member by a large amount during the sheet interval, an oscillating voltage, which will be described below, is used as the development bias to be applied to the development sleeve 10. The usage of this oscillating voltage as the development bias is the main characteristic of this embodiment. Next, this oscillating voltage will be described.

In an oscillating voltage with a duty ratio of 1:1 is used as the development bias to be applied to the development sleeve 10, the external additive, which is positive in polarity, transfers onto the print-less portions of the photosensitive member at a higher ratio to the toner.

Therefore, in this embodiment, a specifically designed oscillating bias is used to effect desirable development performance, that is, to prevent the external additive from unevenly transferring onto the photosensitive drum, so that the flowing image effect, which tends to occur under a high temperature-high humidity condition, is prevented from occurring, to produce highly precise images, through the entire service life of a process cartridge.

One of the characteristics of this embodiment is that the external additive is prevented from transferring onto the photosensitive member by a large amount, by modifying the oscillating bias applied to the development sleeve. More specifically, an arrangement is made so that, during the idle period of the photosensitive drum, that is, the period in which a latent image is not developed, for example, the sheet interval periods, the prerotation period, and the postrotation period, the voltage level of such a portion of the development bias that induces the external additive to move in the direction from the development sleeve toward the print-less portions of the photosensitive member is kept low, while keeping high the voltage level of such a portion of the development bias that induces the toner to move in the direction from the development sleeve toward the photosensitive drum.

Figure 13:
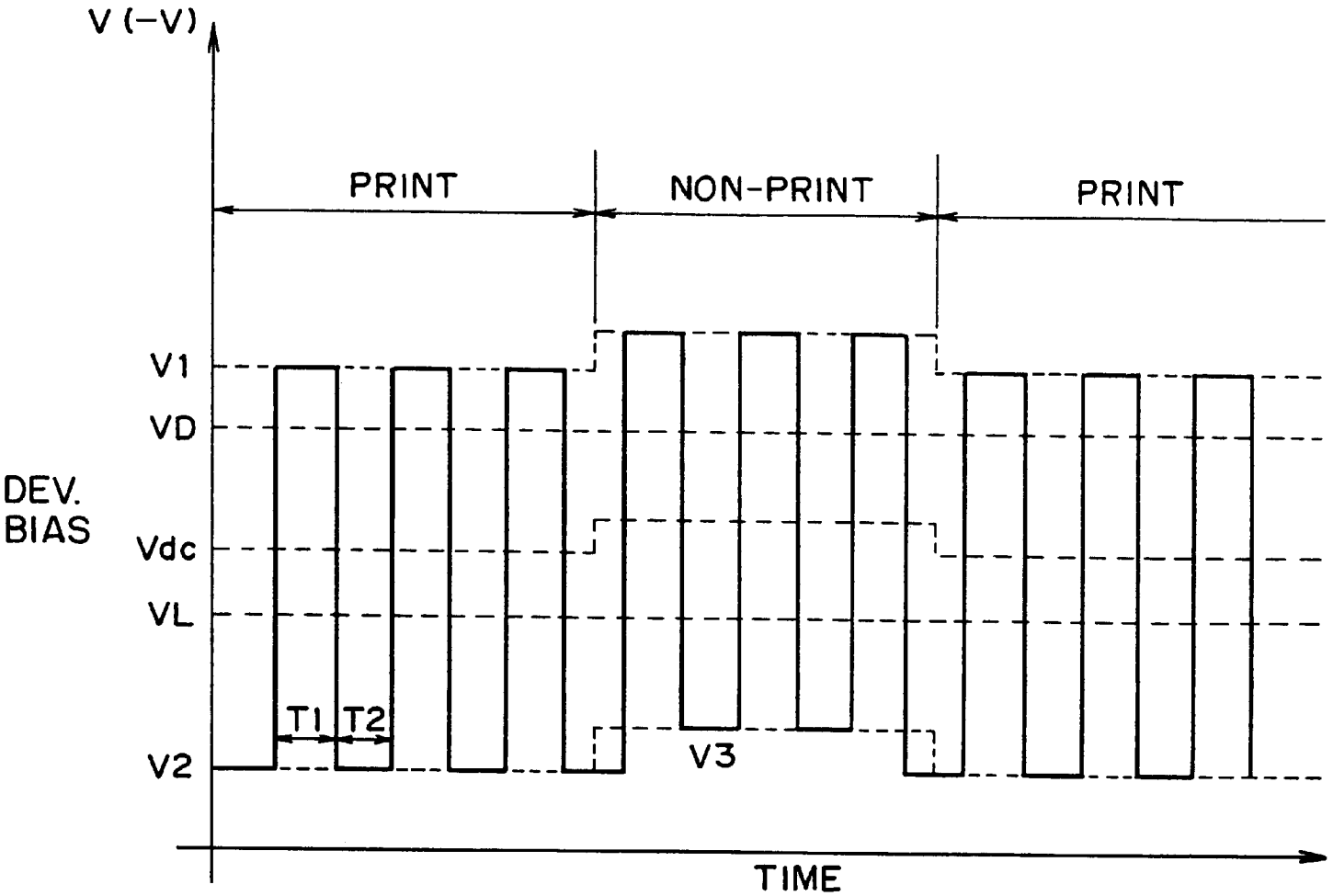
FIG. 13 is a chart which shows the waveform of the development bias in the third embodiment.

More specifically, referring to FIG. 13, reference characters T1 and T2 represent the periods in which the oscillating voltage E is at the lowest and highest levels, respectively; V1 and V2, the lowest and highest voltage levels, respectively, of the oscillating voltage; E, VL, the surface potential level of the latent image, on the image portions; and a reference characters VD represents the surface potential level of the latent image, on the image-less portions. A reference characters Vdc represents the time-average voltage level of the oscillating voltage E, that is, the voltage level of the development bias integrated across a single cycle (T1+T2), which will be simply referred to as "average, or integrated, voltage level of the development bias". The image density of the image portion can be controlled by controlling this integrated voltage level of the development bias.

In the case of an example of development bias depicted by FIG. 13, during the actual developing period, a latent image with the negative polarity is developed in reverse using the negatively charged toner, and therefore, during the period T1, an electric field works on the toner 8 in the direction to induce the toner 8 to move from the development sleeve 10 toward the photosensitive member (direction to develop latent image on photosensitive member), with a magnitude of $|VL-V1|$, and therefore, the toner is induced to move in the same direction, by a force with a magnitude proportional to $|VL-V1|$, whereas during the period T2, the electric field works on the positively charged external additive in the direction to induce the external additive to move from the development sleeve 10 toward the photosensitive member 1 (direction to strip away toner having adhered to photosensitive member), with a magnitude of |V2−VL|, and therefore, a force with a magnitude proportional to |V2−VL| works on the external additive.

During the idling period of the photosensitive member, that is, during the period in which the photosensitive member is rotated, but no latent image is being developed, in the period T1, the electrical field works on the toner 8 in the direction to induce the toner 8 to move from the development sleeve 10 toward the photosensitive member 1 (direction to develop latent image on photosensitive member), with a magnitude of |VD−V1|, and therefore, a force with a magnitude proportional to |VL−V1| works on the toner 8 to induce it to move in the same direction, whereas in the period T2, the electric field works on the external additive in the direction to induce the external additive to move from the development sleeve 10 toward the photosensitive member 1 (direction to strip away toner having adhered to photosensitive member), with a magnitude of |V3−VD|, and therefore, a force with a magnitude proportional to |V3−VD| works on the external additive in the same direction. Reference characters V3 represent the highest voltage level of the development bias during the idle period of the photosensitive drum.

Thus, in order to devise a development bias that can prevent the escaping of the external additive through the cleaning apparatus, or the occurrence of the flowing image effect during the latter half of the service life of the process cartridge, a test was conducted under the following conditions.

First, during the active period of the photosensitive member, that is, the period in which a latent image is being developed, an oscillating bias with the following specifications was applied as the development bias: T1:T2=1:1 (ratio between lengths of periods T1 and T2 of development bias); Vpp=1600 V (V1=−1250 V, V2=+350 V); Vdc=−450 V; frequency=2400 Hz. It converges to −450 V (=Vdc).

Next, during the idle period of the photosensitive member, for example, during the sheet interval period, during the prerotation period, or the postrotation period, various oscillating voltages with the following specifications were applied as the development bias:

(1) T1:T2=1:1 (ratio between lengths of periods T1 and T2 of development bias); Vpp=1600 V (V1=−1250 V, V3=+350 V); Vdc=−450 V; frequency=2400 Hz.

(2) T1:T2=1:1 (ratio between lengths of periods T1 and T2 of development bias); Vpp=1400 V (V1=−1150 V, V3=+250 V); Vdc=−450 V; frequency=2400 Hz.

(3) T1:T2=1:1 (ratio between lengths of periods T1 and T2 of development bias); Vpp=1400 V (V1=−1250 V, V2=+150 V); Vdc=−550 V; frequency=2400 Hz.

(4) T1:T2=1:1 (ratio between lengths of periods T1 and T2 of development bias); Vpp=1200 V (V1=−1050 V, V3=+150 V); Vdc=−450 V; frequency=2400 Hz.

(5) T1:T2=1:1 (ratio between lengths of periods T1 and T2 of development bias); Vpp=1200 V (V1=−1150 V, V2=+50 V); Vdc=−550 V; frequency=2400 Hz.

The above listed five different development biases were tested. Bias (1) is the same as that applied during the active period, and Biases (2)–(5) are the development biases, whose voltage level V3 correspondent to the force that induces the external additive to move from the development sleeve toward the photosensitive member is kept low.

The waveforms of these development biases are as shown in FIG. 13.

Figure 14:
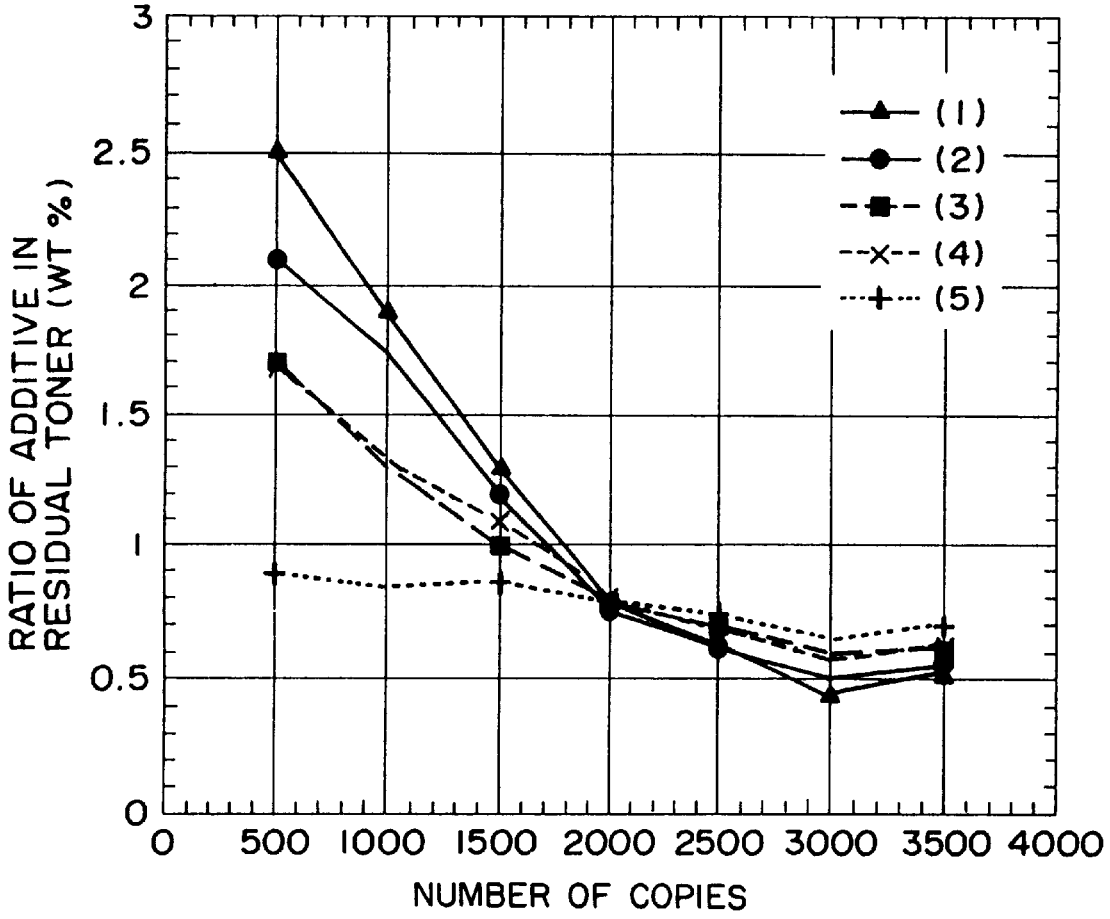
FIG. 14 is a graph which presents the results of the tests in the third embodiment.

First, using the above-described development biases, a durability test was conducted, in which temperature was 23° C. and humidity was 60%. In the test, the weight ratio of the external additive contained in the waste toner accumulated in the waste toner container of the cleaning apparatus was measured at every 500th copy. The results are shown in FIG. 14, from which the following is evident.

When Bias (1), which is the same as the development bias applied during the active period, was applied during the sheet interval period, the prerotation period, and the postrotation period, the external additive was transferred at an extremely high ratio to the toner from the beginning of the durability test until approximately the 2000th copy.

When Bias (2), the V3 of which is lower by 100 V in comparison to Bias (1) was applied, the ratio to the toner at which the external additive transferred onto the photosensitive member was smaller from the beginning of the durability test until approximately the 2000th copy, than when Bias (1) was applied.

When Bias (3), the V3 of which is lower by 100 V in comparison to Bias (2), was applied, the ratio to the toner at which the external additive transferred onto the photosensitive member was smaller from the beginning of the durability test until approximately the 2000th copy, than when Bias (2) was applied.

When Bias (4), the V3 of which is the same as that of Bias 3, was applied, the ratio to the toner at which the external additive transferred onto the photosensitive member was the same as when Bias (3) was applied.

When Bias (5), the V3 of which is lower by 100 V in comparison to Bias (4), was applied, the ratio to the toner at which the external additive transferred onto the photosensitive member was smaller from the beginning of the durability test until approximately the 2000th copy, than when Bias (4) was applied.

From the above observation, it is possible to assume that the ratio at which the external additive transfers onto the photosensitive member at the beginning of the service life of a process cartridge can be controlled by reducing the level of V3.

Thus, the inventors of the present invention discovered that the ratio at which the external additive transfers onto the photosensitive member can be controlled by varying the level of the V3 of the development bias, and through an additional durability test, they were convinced that the transferring of the external additive onto the photosensitive member can be controlled.

Next, the durability test, in terms of image quality, in which the above described development bias was used, will be described.

In the durability test conducted to study the development bias controlling method conceived by the inventors of the present invention, 3500 A4 size copies, which were covered with an image of a grid pattern with an average dot ratio of 4%, were printed. During the test, a solid black copy and a solid white copy were printed at every 500th copy.

Table 5 shows the combined results of two durability tests. In one of the two tests, temperature and humidity were 23° C. and 60%, respectively, and the escaping of the external additive through the cleaning apparatus, and the fog in the solid white image, were checked. In the other test, temperature and humidity were 32.5° C. and 80%, respectively, and the flowing image effect and the toner fusion to the peripheral surface of the photosensitive member, were checked.

TABLE 5

| | Initial density rise | Escape | Fusion | Flow |
|---|---|---|---|---|
| (1) | ○ | xx (initial) | x (750) | x (1328) |
| (2) | ○ | x (initial) | Δ (2033) | Δ (2516) |
| (3) | ○ | Δ (initial) | Δ (3315) | Δ (3415) |
| (4) | ○ | Δ (initial) | Δ (3297) | (3408) |
| (5) | ○ | ○ | ○ | ○ |

Figures in parentheses are numbers of occurrences.

All the results shown in Table 5 are based on the first to 3500th copy.

Bias (1): There was no problem in terms of the startup of image density at the beginning of the service life of the process cartridge; image density reliably started up. However, no improvement could be seen in terms of the escaping of the external additive, the toner fusion, and the flowing image effect.

Bias (2): There was no problem in terms of the startup of image density at the beginning of the service life of the process cartridge; image density reliably started up. However, some improvement could be seen in terms of the toner fusion and the flowing image effect compared to Bias (1), even though no improvement could be seen in terms of the escaping of the external additive.

Bias (3): There was no problem in terms of the startup of image density at the beginning of the service life of the process cartridge; image density reliably started up. The external additive escaped through the cleaning apparatus at the beginning of the service life, but the amount of the external additive which escaped through the cleaning apparatus was insignificant in terms of practical usage. The toner fusion and the flowing image effect also occurred, but only toward the end of the service life, and their severity was insignificant in terms of practical usage. In other words, linage quality was improved.

Bias (4): There was no problem in terms of the startup of image density at the beginning of the service life of the process cartridge; image density reliably started up. Also, some improvement could be seen in terms of the toner fusion and the flowing image effect compared to Bias (1), even though no improvement could be seen in terms of the escaping of the external additive. The escaping of the external additive through the cleaning apparatus occurred at the beginning, its severity was insignificant in terms of practical usage. The toner fusion and the flowing image effect were at the same level as Bias (3).

Bias (5): There was no problem in terms of the startup of image density at the beginning of the service life of the process cartridge; image density reliably started up. The escaping of the external additive through the cleaning apparatus, the toner fusion, and the flowing image effect were also were at an acceptable level.

According to the results of the test given in Table 5, the startup of image density was improved no matter in which fashion, from the above list of various development biases, the development bias applied during the sheet interval period, the prerotation period, and the postrotation period, was varied. This is because the external additive, the polarity of which was opposite to that of the toner, was added to the toner. More specifically, the external additive and the toner were caused to rub against each other in the developer container and on the development sleeve, and therefore, the toner received a greater amount of triboelectrical charge than when no external additive was added to the toner, because the polarity of the external additive was opposite to that of the toner. As a result, development efficiency was improved.

In terms of the defects traceable to the escaping of the external additive, image quality was improved in the order of Bias (1)→Bias (5), in which the level of the peak voltage V3 of the development bias applied during the sheet interval period, the pre-rotation period, and the postrotation period, was reduced. This is because the amount of the jumped external additive, which was greater at the beginning of the service life, decreased in the order of Bias (1)→Bias (5). In other words, as the level of the peak voltage V3 was reduced, the force which induced the external additive to move to the photosensitive member because smaller. In the case of Bias (5), the ratio to the toner at which the external additive jumped onto the photosensitive member remained substantially stable throughout the durability test, which implies that if the ratio at which the external additive jumps onto the photosensitive member is kept at the level of Bias (5), the escaping of the external additive does not occur. Biases (3) and (4) also do not create significant problems in terms of practical usage, as far as the escaping of the external additive is concerned.

Like the escaping of the external additive, the toner fusion was also reduced in the order of Bias (1)→Bias (5) in which the level of the peak voltage V3 of the development bias applied during the sheet interval period, the prerotation period, and the post-rotation period, was reduced. This is because the amount of the jumped external additive, which was greater at the beginning of the service life, decreased in the order of Bias (1)→Bias (5), and as a result, the extent to which the photosensitive member was shaved by the external additive reduced. If the ratio at which the external additive jumps onto the photosensitive member is reduced to the level of Bias (5), and kept there throughout the duration of the test, the toner fusion does not occur. In the case of Biases (3) and (4), the escaping of the external additive occurred, but only on a scale insignificant in terms of practical usage.

The occurrence of the flowing image effect was also reduced in the order of Bias (1)→Bias (5) in which the level of the peak voltage V3 of the development bias applied during the sheet interval period, the prerotation period, and the postrotation period, was reduced. This is because too much external additive jumped onto the photosensitive member at the beginning of the service life of the process cartridge, and as a result, the external additive ran short during the latter half of the service life, failing to prevent the flowing image effect. In the case of Bias (5), the ratio at which the external additive jumped onto the photosensitive member remained steady throughout the service life, and therefore, the external additive did not run short, successfully preventing the flowing image effect, during the latter half of the service life. In the case of Bias (3) and Bias (4), the flowing image effect occurred, but only on a scale insignificant in terms of practical usage.

The ratio at which the external additive jumps onto the photosensitive member at the beginning of the service life of a process cartridge can be reduced by reducing the level of the peak voltage V3 of the development bias applied during the sheet interval period, the prerotation period, and the post-rotation period, because the force which induces the external additive to move from the development sleeve to the photosensitive member is proportional to $|V3-VD|$ which is affected by the level of the peak voltage V3. In other words, the ratio at which the external additive jumps onto the photosensitive member at the beginning of the service life can be controlled by adjusting the level of the peak voltage V3 of the development bias applied during the sheet interval period, the prerotation period, and the postrotation period.

This controlling of the level of the peak voltage V3 is executed during the sheet interval period, the prerotation period, and the postrotation period, and therefore, it is unnecessary to consider image density. Thus, all that is necessary is to assure that the integrated level of Vdc does not exceed the level of VD. In other words, because the level of the VD is fixed, the ratio at which the external additive jumps onto the photosensitive member can be controlled by controlling only the level of V3 with no consideration to the duty ratio or the like. Obviously, the development bias may be selected in consideration of the duty ratio instead of V3.

Based on the studies discussed above, the insufficient image density at the beginning of the service life, the escaping of the external additive through the cleaning apparatus, the flowing image effect which occurs under the high-temperature, high-humidity condition, and the toner fusion, could be completely suppressed, and therefore, images with desirable quality could be produced.

In this embodiment, control is executed only during the sheet interval period, the prerotation period, and the postrotation period. However, when the print-less portions of an image are being formed, image density does not need to be considered. Thus, control similar to the control in this embodiment may be executed while the print-less portions of an image are formed.

Further, in this embodiment, strontium titanate is used as the external additive. However, the choice does not need to be limited to strontium titanate as long as the same effects can be realized.

Further, the development bias in this embodiment is designed as described above. However, the design of the development bias does not need to be limited to the one in this embodiment as long as the same effects can be realized.

Embodiment 4

Next, the fourth embodiment of the present invention will be described with reference to FIGS. 15 and 16.

The fourth embodiment is characterized in that the waveform of the development bias is improved by modifying the waveform in the third embodiment. Thus, the drawing of the image forming apparatus in this embodiment, and its description, will be omitted.

Figure 15:
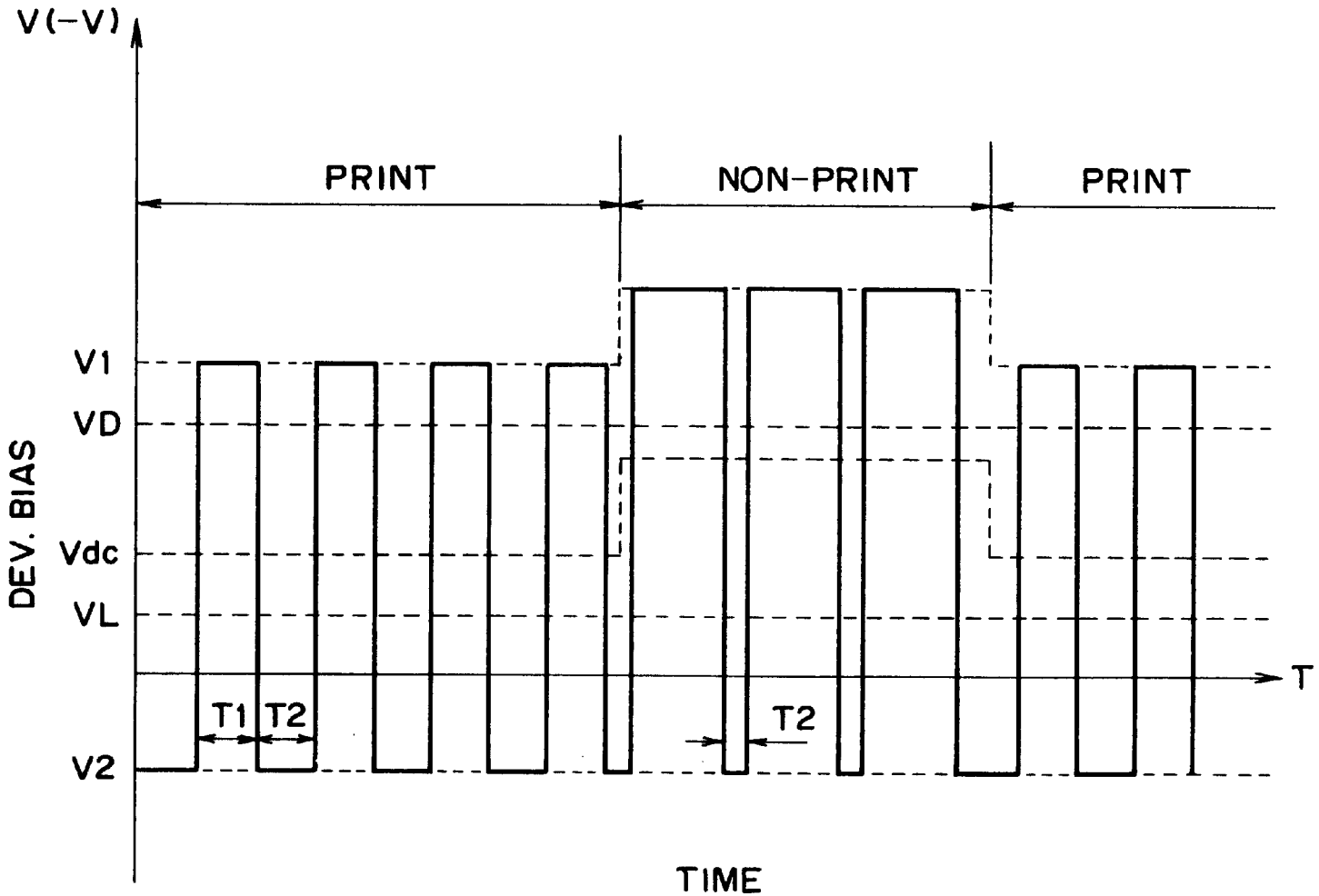
FIG. 15 is a chart which shows the waveform of the development bias in the fourth embodiment.

Referring to FIG. 15, in this embodiment, the period T1 through which the voltage level of the development bias is at the first peak level, and the development bias generates such force that induces the external additive to move from the development sleeve to the photosensitive member, and the period T2 through which the voltage level of the development bias is at the second peak, and the development bias generates such force that induces the external additive to move from the photosensitive member to the development sleeve, alternate. The length of time the development bias is applied is n(T1+T2), (n represents an integer), and the length of the period T2 is varied.

A test was conducted, as it was in the third embodiment, to find out what and how much effect there would be upon the following problems, if the length of the period T2 through which the voltage level of the development bias is at the second peak level V2 was varied: the image density at the beginning of the service life of a process cartridge; the escaping of the external additive through the cleaning apparatus; the flowing image effect which occurs under the high-temperature, high humidity condition; and the toner fusion to the photosensitive member. The test conditions were as follows.

The test was conducted without changing either the peak voltage level or the frequency the development bias.

During the active period, an oscillating voltage with the following specifications was applied as the development bias; T1:T2=1:1 (ratio between the lengths of T1 and T2); Vpp=1600 V (V1=1250 V, V2=+350 V); Vdc=−450 V; frequency=2400 Hz. It converges to −450 V (=Vdc).

During the idle period, for example, during the sheet interval period, the pre-rotation period, and the postrotation period, five different biases were tested; Bias (1), and Biases (6)–(9).

Bias (6): T1:T2=51:49 (ratio between the lengths of T1 and T2); Vpp=1616 V (V1=1266 V, V3=+350 V); Vdc=−466 V; frequency=2400 Hz.

Bias (7): T1:T2=53:47 (ratio between the lengths of T1 and T2); Vpp=1651 V (V1=1301 V, V3=+350 V); Vdc=−501 V; frequency=2400 Hz.

Bias (8): T1:T2=55:45 (ratio between the lengths of T1 and T2); Vpp=1688 V (V1=1338 V, V3=+350 V); Vdc=−538 V; frequency=2400 Hz.

Bias (9): T1:T2=57:43 (ratio between the lengths of T1 and T2); Vpp=1730 V (V1=1380 V, V3=+350 V); Vdc=−580 V; frequency=2400 Hz.

Bias (1) is the same as Bias (1) applied during the active period. Biases (6)–(9) are biases which are different from Bias (1) in that the lengths of the periods T2, through which the peak voltage V3 which induces the external additive to move from the development sleeve to the photosensitive member is applied, are rendered shorter in various degrees than Bias (1).

The waveforms of Biases (1) and (6)–(9) are shown in FIG. 15.

The conditions under which this durability test was conducted, using the above described development biases, were 23° C. in temperature, and 60% in humidity. In the test, the weight ratio of the external additive contained in the waste toner accumulated in the waste toner container of the cleaning apparatus was measured at every 500th copy. The results are shown in FIG. 16, from which the following is evident.

When Bias (1), which is the same as the development bias applied during the active period, was applied during the sheet interval period, the prerotation period, and the postrotation period, the external additive was transferred at an extremely high ratio to the toner from the beginning of the durability test until approximately the 2000th copy.

In the case of Bias (6), the length of the period T2 through which the peak voltage V2 was applied was rendered shorter than that of Bias (1), and the ratio at which the external additive transferred onto the photosensitive member from the beginning up to approximately the 2000th copy, was smaller compared to the case of Bias (1).

In the case of Bias (7), the length of the period T2 through which the peak voltage V2 was applied was rendered shorter than that of Bias (6), and the ratio at which the external additive transferred onto the photosensitive member from the beginning up to approximately the 2000th copy, was smaller compared to the case of Bias (6).

In the case of Bias (8), the length of the period T2 through which the peak voltage V2 was applied was rendered shorter than that of Bias (7), and the ratio at which the external additive transferred onto the photosensitive member from the beginning up to approximately the 2000th copy, was smaller compared to the case of Bias (7).

In the case of Bias (9), the length of the period T2 through which the peak voltage V2 was applied was rendered shorter than that of Bias (8), and the ratio at which the external additive transferred onto the photosensitive member from the beginning up to approximately the 2000th copy, was smaller compared to the case of Bias (8).

In other words, the ratio at which the external additive transfers onto the photosensitive member at the early period of the service life of a process cartridge can be reduced by reducing the length of the period T2 through which the peak voltage V2 is applied.

Based on further studies of the test conducted this time, the inventors of the present invention were convinced that the ratio at which the external additive is transferred onto the photosensitive member can be controlled by varying the length of the period T2 through which the peak voltage V2 of the development bias is applied, and further, they conducted a durability test, confirming that the ratio at which the external additive is transferred onto the photosensitive member could be controlled.

The following is the description of the durability test conducted using the various development biases listed above.

As for the method for testing the effects of the controlling of the development bias, a grid pattern with an average dot ratio of 4% per page was printed on 3500 A4 sheets, and during the test, a solid black image and a solid white image were printed at every 500th copy.

Table 6 given below shows the results of the test. The table sums up the evaluations of the tested development biases in terms of the aforementioned image defects: the startup of image density when the ambient temperature and humidity were 23° C. and 60%, respectively; the escaping of the external additive through the cleaning apparatus when the ambient temperature and humidity were 15° C. and 10%, respectively; and the flowing image effects and the toner fusion to the photosensitive member when the ambient temperature and humidity were 32.5° C. and 80%, respectively.

TABLE 6

| | Initial density rise | Escape | Fusion | Flow |
|---|---|---|---|---|
| (1) | ○ | xx (initial) | x (750) | x (1328) |
| (6) | ○ | x (initial) | x (1132) | x (1417) |
| (7) | ○ | Δ (initial) | Δ (3215) | Δ (3309) |
| (8) | ○ | Δ (initial) | Δ (3318) | Δ (3421) |
| (9) | ○ | ○ | ○ | ○ |

Figures in parentheses are numbers of occurrences.

The results shown in Table 6 are the results obtained when the printing was continued until 3500 copies were finished.

In the case of Bias (1), there was no problem in terms of the image density startup at the beginning of the test. However, no improvement was made in terms of the escaping of the external additive, the toner fusion, and the flowing image effect.

In the case of Bias (6), there was no problem in terms of the image density startup at the beginning of the service life; image density started up in a satisfactory manner. However, no improvement was made in terms of the escaping of the external additive, the toner fusion, and the flowing image effect, but the ordinal number at which the toner fusion and the flowing image effect began to occur was greater compared to Bias (1).

In the case of Bias (7), there was no problem in terms of the image density startup at the beginning of the service life; image density started up in a satisfactory manner. The escaping of the external additive occurred at a level insignificant in practical usage, only at the beginning of the service life. The toner fusion and the flowing image effect occurred slightly, that is, at a level insignificant in practical usage, only during the latter half of the service life.

In the case of Bias (8). there was no problem in terms of the image density startup at the beginning of the service life; image density started up in a satisfactory manner. The escaping of the external additive occurred at a level insignificant in practical usage, only at the beginning of the service life. The toner fusion and the flowing image effect occurred slightly, that is, at a level insignificant in practical usage, only during the latter half of the service life.

In the case of Bias (9), there was no problem in terms of the image density startup at the beginning of the service life: image density started up in a satisfactory manner. Also, the escaping of the external additive, the toner fusion, and the flowing image effect, were all at satisfactory levels.

The results of the test given in Table 6 confirm that the image density startup was improved by modifying the development bias applied during the sheet interval period, the prerotation period, and the post-rotation period, as described above. This is because the external additive, the polarity of which was opposite to that of the toner, was added to the toner. More specifically, the external additive and the toner were caused to rub against each other in the developer container and on the development sleeve, and therefore, the toner received a greater amount of triboelectrical charge than when no external additive was added to the toner, because the polarity of the external additive was opposite to that of the toner. As a result, development efficiency was improved.

In terms of the defects traceable to the escaping of the external additive, image quality was improved in the order of Bias (1)→Bias (9), in which the length of the period T2 through which the peak voltage V2 of the development bias applied during the sheet interval period, the prerotation period, and the postrotation period, was shortened. This is because the ratio at which the external additive jumped onto the photosensitive member, which was greater at the beginning of the service life, decreased in the order of Bias (1)→Bias (9). In other words, as the length of the period T2, through which the peak voltage V2 was applied, was reduced, the force which induced the external additive to move to the photosensitive member became smaller.

In the case of Bias (9), the ratio at which the external additive jumped onto the photosensitive member remained substantially stable throughout the durability test, which implies that if the ratio at which the external additive jumps onto the photosensitive member is kept at the level of Bias (9), the escaping of the external additive does not occur.

Like the escaping of the external additive, the toner fusion was also reduced in the order of Bias (1)→Bias (9) in which the length of the period T2 through which the peak voltage V2 of the development bias applied during the sheet interval period, the prerotation period, and the postrotation period, was shortened. This is because the ratio at which the external additive jumped onto the photosensitive member, which was greater at the beginning of the service life, decreased in the order of Bias (1)→Bias (9), and as a result, the amount of shaving done on the photosensitive member by the external additive reduced. If the ratio at which the external additive jumps onto the photosensitive member remains at the level of Bias (9) which kept steady the ratio at which the external additive jumped onto the photosensitive member, throughout the duration of the test, the toner fusion does not occur.

The occurrence of the flowing image effect was also reduced in the order of Bias (1)→Bias (9) in which the length of the period T2 through which the peak voltage V2 of the development bias applied during the sheet interval period, the prerotation period, and the postrotation period, was shortened. This is because the external additive jumped onto the photosensitive member at a too high ratio to the toner at the beginning of the service life of the process cartridge, and as a result, the external additive ran short during the latter half of the service life, failing to prevent the flowing image effect. If the ratio at which the external additive jumps onto the photosensitive member remains at the level of Bias (9) which kept steady the ratio at which the external additive jumped onto the photosensitive member, throughout the service life of the process cartridge, the external additive does not run short during the latter half the service life, and therefore, the flowing image effect does not occur.

Figure 16:
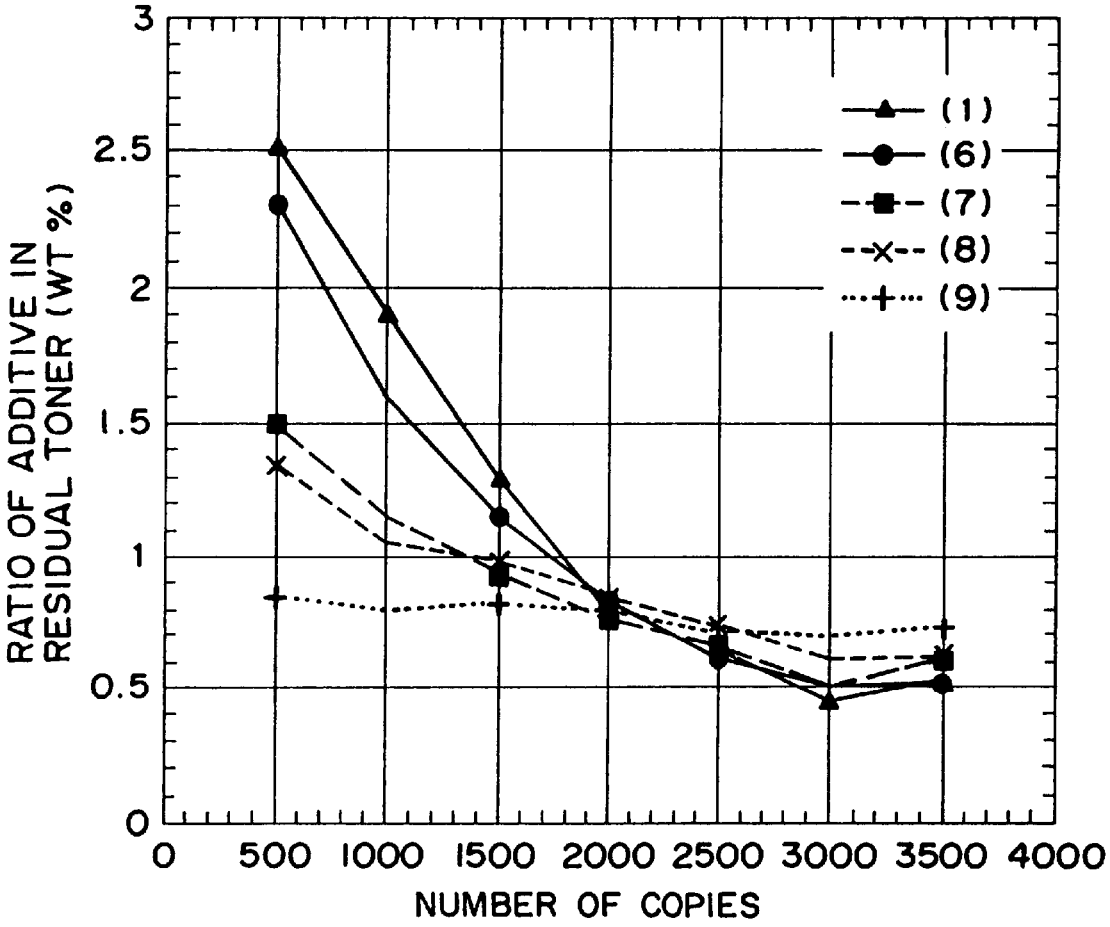
FIG. 16 is a graph which presents the test results in the fourth embodiment.

From FIG. 16 and the results of the test presented in Table 6, it is evident that the image density startup at the beginning of the service life is improved by the presence of the external additive in the toner.

Further, the ratio at which the external additive transfers onto the photosensitive member at the beginning of the service life of a process cartridge can be reduced by shortening the length of the period T2 through which the voltage V2 which induces the external additive to move from the development sleeve toward the photosensitive member during the sheet interval period, the prerotation period, and the postrotation period, with a force proportional to |V2−VD| is applied. In other words, the ratio at which the external additive transfers onto the photosensitive member at the beginning of the service life of a process cartridge can be controlled by varying the length of the period T2 through which the voltage V2 which induces the external additive to move from the development sleeve toward the photosensitive member during the sheet interval period, the prerotation period, and the postrotation period, with a force proportional to |V2−VD| is applied.

This controlling of the length of the period T2 is executed during the idle period. Thus, all that is necessary is to assure that the integrated level of Vdc does not exceed the level of VD. In other words, the ratio at which the external additive jumps onto the photosensitive member can be controlled by controlling the length of the period T2 only, with no consideration to the duty ratio or the like.

Based on the studies discussed above, the startup of the initial image density, the escaping of the external additive through the cleaning apparatus, the flowing image effect which occurs under the high-temperature, high-humidity condition, and the toner fusion, could be completely suppressed. Further, during the idle period, duty ratio or the like does not need to be taken into consideration, in other words, it becomes possible to vary the frequency of the development bias, which in turn makes it possible to control the fog effect closely related to the frequency of the development bias. Obviously, it is also possible to control the fog effect using the development bias designed in consideration of duty ratio, instead of controlling the frequency of the development bias, during the idle period. With the use of the above described controls, images with desirable quality could be produced.

In this embodiment, control was executed only during the sheet interval period, the prerotation period, and the postrotation period. However, a control similar to the control executed in this embodiment can be executed during the formation of the print-less portions of an image, because image density does not need to be considered while the print-less portions are formed.

Embodiment 5

Figure 17:
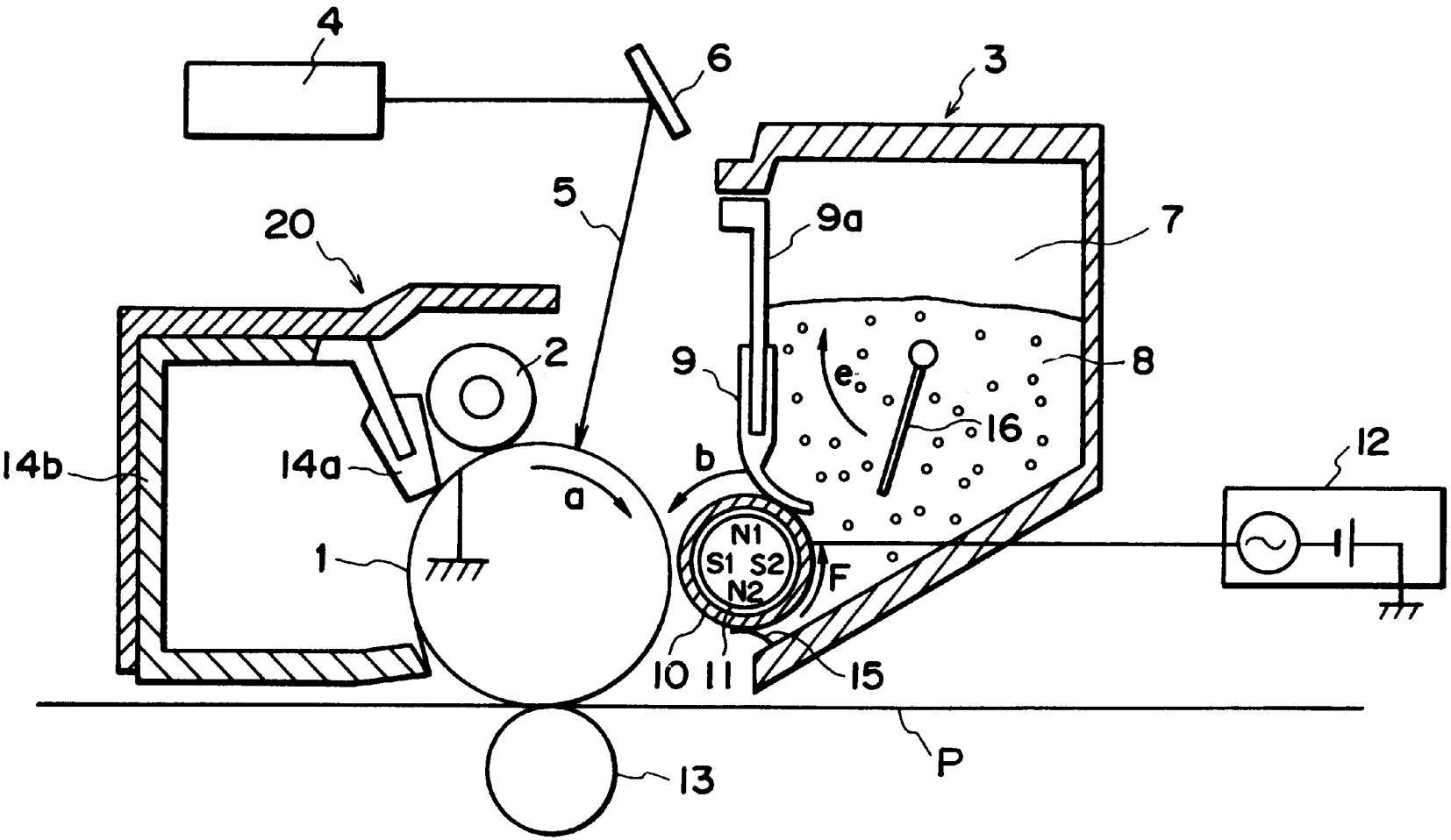
FIG. 17 is a schematic section of the image forming apparatus in the fifth embodiment of the present invention, which employs a developing apparatus in accordance with the present invention.

FIG. 17 is a schematic section of an image forming apparatus, in which a developing apparatus in accordance with the present invention is disposed, and depicts the general structure thereof.

This image forming apparatus comprises a process cartridge 20, and an optical system constituted of a laser scanner 4 and a mirror 6, a transfer roller 13, and the like. The process cartridge integrally comprises processing apparatuses: a photosensitive member 1, a charger roller 2, a developing apparatus 7, and a cleaning apparatus 14. The process cartridge 20 has a service life of 3500 A4 size copies, assuming that average image ratio per page is 4%.

The photosensitive member as an image bearing member is constituted of an electrically conductive aluminum base member, and a photoconductive photosensitive layer laid on the peripheral surface of the base member 1*b*. It is rotatively driven in the direction indicated by an arrow mark a. The rotating photosensitive member 1 is uniformly charged to the negative polarity by the charge roller 2.

The charge roller 2 is constituted of a metallic core, and an elastic rubber layer in the form of a roller fitted around the peripheral surface of the metallic core. The electrical resistance of the elastic layer is in the medium range. The charge roller 2 is rotatively supported at both longitudinal ends of the metallic core 2*a* by bearings, being kept always in contact with the photosensitive member 1. The charge roller 2 is rotated by the rotation of the photosensitive member 1. The metallic core of the charge roller 2 is electrically connected to an unillustrated charge bias power source. As charge bias composed of DC voltage and AC voltage is applied to the charge roller 2 through the metallic core, the peripheral surface of the photosensitive member 1 is negatively charged to a predetermined potential level.

Next, the uniformly charged photosensitive member 1 is exposed to a laser beam 5, which is projected from a laser scanner 4 and deflected by the mirror 6. As a result, an electrostatic latent image which reflects the image data is formed on the peripheral surface of the photosensitive member 1. The laser scanner outputs the laser beam 5 in response to the sequential digital electric image signals sent from a video-controller (unillustrated), based on the image data.

The electrostatic latent image formed on the photosensitive member 1 is developed in reverse into a toner image, i.e., a visible image, by the toner 8 within the developing apparatus 3. Then, the toner image is transferred onto a piece of transfer sheet P delivered to the photosensitive member 1, by the function of a transfer roller 13. After receiving the toner image, the transfer sheet P is separated from the photosensitive member 1, and is introduced into a fixing apparatus (unillustrated), in which the toner image is fixed to the transfer sheet P. Thereafter, the transfer sheet P is discharged from the image forming apparatus main assembly.

After the toner image transfer, the residual toner, or the toner which remains on the photosensitive member 1, is removed by a cleaning blade 14*a*, preparing the photosensitive member 1 for the next cycle of image formation to begin. The removed toner is collected in the waste toner container 14*b*.

The developing apparatus 3 is equipped with a developer container 7 which holds the toner 8. At the opening of the developer container 7, which faces the photosensitive member 1, a development sleeve 10 is positioned. In the development sleeve 10, a magnetic roller 11 is nonrotatively positioned. At the top portion of the development sleeve 10, a doctor blade 9 (toner regulating member) is disposed in contact with the development sleeve 10.

In this embodiment, the toner 8 is magnetic toner chargeable to the negative polarity. In order to improve the toner 8 in terms of fixation, the viscosity of the toner 8 is improved by controlling the viscoelasticity, at the melting point, of the toner 8. The toner 8 is in the form of very fine particles. Further, as a measure for preventing the occurrence of the flowing image effect, the external additive is added to the toner 8. The flowing image effect is a phenomenon that a latent image is partially lost, creating an impression of flowing water, as the electrical resistance of the photosensitive member 1 is reduced by the ozonic compounds formed on the peripheral surface of the photosensitive member 1, and therefore, current is allowed to flow from the photosensitive member surface areas correspondent to the image-less portions of a latent image to the photosensitive member surface areas correspondent to the actual image portion of the latent image. On the image portion of the photosensitive member, the ozonic compounds formed on the photosensitive member are constantly shaved away by the toner, but on the image-less portions of the photosensitive member, they are not. Therefore, in order to shave away the ozonic compounds from the image-less portions of the photosensitive member to prevent the flowing image effect, external additive is added to the toner 8. The external additive to be added to the toner 8 is desired to be composed of positively chargeable particles which easily transfer from the development sleeve to the photosensitive member 1 charged to the negative polarity.

As for the positively chargeable particles, strontium titanate particles or Melamine particles, are available. In this embodiment, strontium titanate particles are employed (hereafter, "positive external additive") as external additive. The ratio by which positive external additive is initially added to the toner 8 is 1.3 wt. %.

The development sleeve 10 is produced by coating carbon dispersed paint on the peripheral surface of a tubular nonmagnetic base member formed of aluminum, stainless steel, or the like. The peripheral surface of the development sleeve 10 displays a certain degree of roughness due to the properties of the paint coated thereon, and the roughness contributes to the toner conveyance by the development sleeve 10. The development sleeve 10 is rotatively supported by bearings, maintaining a predetermined gap (development gap) from the photosensitive member 1, and is rotated in the direction indicated by an arrow mark b by receiving the driving force transmitted from the photosensitive member 1 through an unillustrated gear.

The development sleeve 10 is connected to a development bias power source 12 capable of applying compound bias composed of DC bias and AC bias between the development sleeve 10 and the photosensitive member 1. The development bias in this embodiment will be described later.

A doctor blade 9 is a toner regulating member. In this embodiment, it is formed of silicone rubber with a hardness of 40 deg. so that the toner 8, which is given a high degree of fixability, and is in the form of extremely small particles, is uniformly charged, and also so that the toner 8 is prevented from becoming fused on the development sleeve 10. The doctor blade 9 is supported by a metallic plate 9*a*, being indirectly attached to the internal wall of the developer container 7.

The doctor blade 9 is manufactured through a single piece molding, in the following manner. First, the mold for the blade is preheated. Then, the metallic plate 9*a* coated with primer for silicone is partially inserted in the preheated mold. Then, LTR silicone rubber (LSR SE6744 by Toray-Dow Corning Co., Ltd.) is injected into the mold with the use of an LIM injection molding device. The injected rubber is left in the mold for five minutes, at 150° C., forming a doctor blade constituted of a metallic plate and a silicone rubber blade attached to the metallic plate. Next, the rubber product is removed from the mold, and thermally cured for four hours at 200° C. to harden the rubber. Thus, a single piece doctor blade constituted of a metallic plate and a silicone rubber blade integrated with the metallic plate is obtained.

The magnetic roller 11 nonrotatively positioned in the development sleeve 10 has four magnetic poles. The magnetic pole S1 (development pole), i.e., the one positioned immediately next to the photosensitive member 1 functions to retain the fog causing toner particles on the development sleeve 10 while the toner 8 jumps onto the photosensitive member 1 and develops a latent image. The magnetic pole S2 (pickup pole) positioned across the magnetic roller 11 from the development pole has a function to attract the toner 8 in the developer container 8 toward the development sleeve 10 so that the toner 8 circulates in the direction indicated by an arrow mark F in the drawing, adjacent to the development sleeve 10, following the rotation of the development sleeve 10. This circulation of the toner 8 contributes to the triboelectrical charging of the toner. Both the magnetic poles N1 and N2 contribute to the conveyance and triboelectrical charging of the toner 8 borne on the development sleeve 10.

Although a magnetic roller with four magnetic poles is employed in this embodiment, the number of the magnetic poles does not need to be limited to four; the number does not matter as long as magnetic poles capable of providing the aforementioned functions are present.

Within the developer container 7 located at a position below the development sleeve 10, a toner blowout prevention sheet 15 for preventing the toner 8 within the developer container 7 from being blown out from the portion below the bottom portion of the development sleeve 10 is disposed. Further, within the developer container 7, a toner conveying member 16 is disposed, which is rotated in the direction indicated by an arrow mark e to supply the development sleeve 10 with the toner, while stirring the toner.

The development sleeve 10 bears the toner 8 conveyed to the development sleeve 10 by the conveying member 16, and conveys the toner 8 toward the development station, in which the development sleeve 10 directly faces the photosensitive member 1. On the way to the development station, being borne on the development sleeve 10, the toner 8 is regulated by the doctor blade 9, being coated in a thin layer with a predetermined thickness, on the peripheral surface of the development sleeve 10, while being given a predetermined amount of triboelectrical charge. After being conveyed into the development station, the toner 8 is caused to jump from the development sleeve 10 to the electrostatic latent image on peripheral surface of the photosensitive member 1 by the development bias which is composed of DC voltage and is applied between the development sleeve 10 and the photosensitive member 1; the electrostatic latent image is developed.

Next, the development bias used in this embodiment will be described.

In order to develop an electrostatic latent image with the use of the toner 8, which is a single component magnetic toner, development bias is applied to the development sleeve 10. However, if an oscillating voltage with a duty ratio of 1:1 is applied, the positively chargeable external additive added to the toner 8 transfers onto the image-less portion of the photosensitive member 1 by a large amount.

Figure 18:
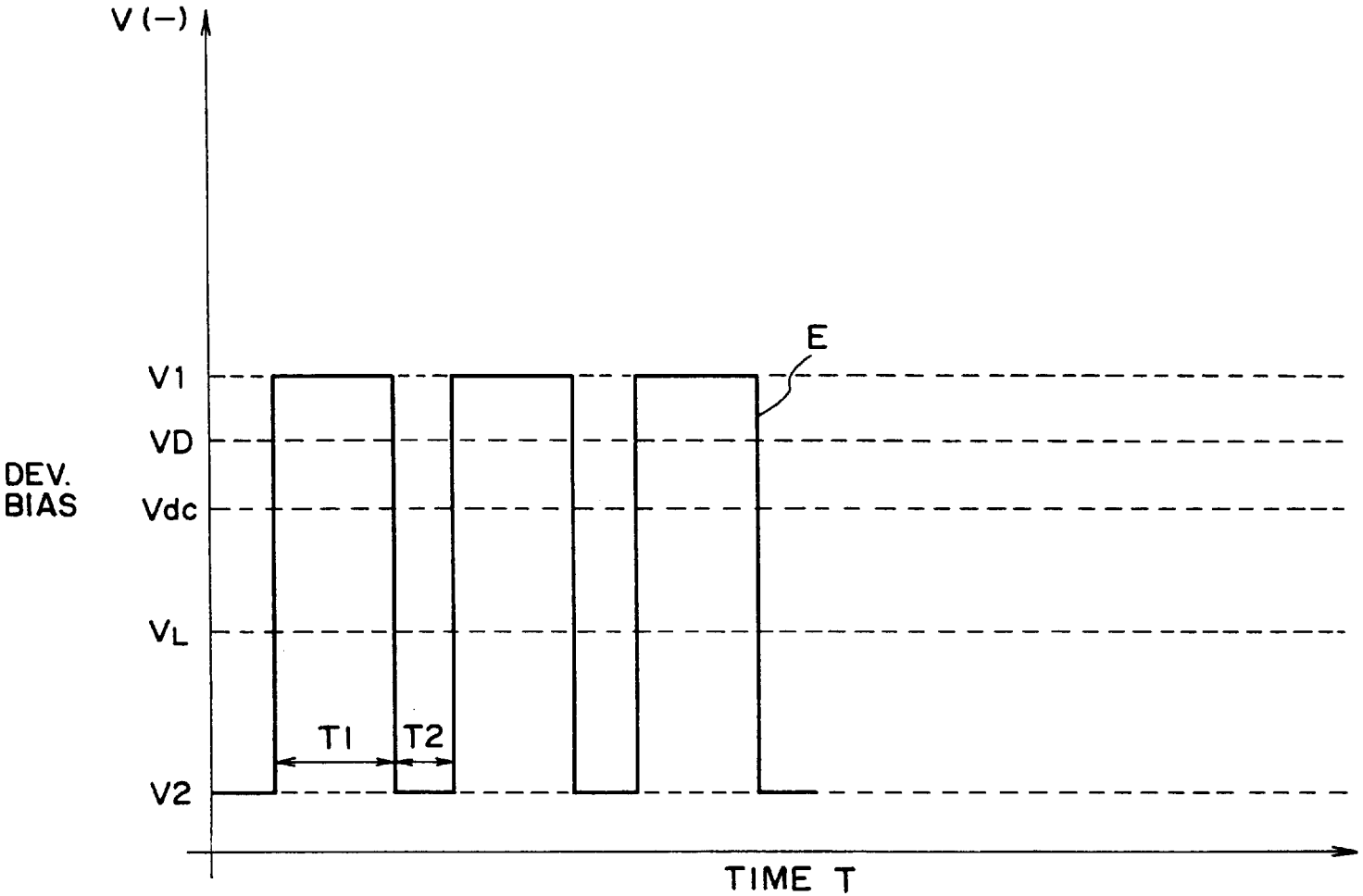
FIG. 18 is a chart which graphically shows the waveform of the development bias used by the developing apparatus illustrated in FIG. 17.

Thus, in this embodiment, in order to prevent the external additive from transferring onto the image-less portion of the photosensitive member 1 by a large amount, an oscillating voltage depicted by FIG. 18 is applied as the development bias to the development sleeve 10. This oscillating voltage is characterized in that the duty ratio of this oscillating voltage is different from the duty ratio for the conventional development bias; in other words, during the oscillation phase in which such force that induces the toner to move from the development sleeve 10 toward the photosensitive member 1 is generated, the potential level of the development bias is left high, whereas during the oscillation phase in which such force that induces the external additive to move in the same direction as the toner, the potential level of the development bias is reduced.

With the above-described modification to the development bias in terms of duty ratio, the external additive is prevented from transferring onto the image-less portions of the photosensitive member 1 by an undesirably large amount, and also from transferring onto the photosensitive member 1, by different amounts between the image-less portions and the image portions. Therefore, the image defects such as white lines which are caused to appear in a copy with a high image ratio, by toner agglutination, or the flowing image effect which occurs under the high-temperature, high-humidity condition, can be prevented. As a result, a very precise image is produced.

More specifically, referring to FIG. 18, the oscillating bias voltage E has a frequency of 2400 Hz. Referential codes V1 and V2 represent the lowest and highest levels, respectively, of the oscillating bias voltage E; T1 and T2, the periods through which V1 and V2 are applied, respectively; Vdc, the time-average level of the oscillating bias voltage E, that is, the level time-integrated across a single cycle (=T1+T2); VL, the peripheral surface voltage of the image portions of the photosensitive member 1; and a reference characters VD represent the peripheral surface voltage of the image-less portions of the photosensitive member 1.

In this embodiment, a latent image with the negative polarity is developed in reverse with the use of negatively charged toner, and a development bias, the waveform and the voltage level of which are shown in FIG. 18. On the image portions of the photosensitive member, in the period T1, an electric field works on the toner 8 in the direction to induce the toner 8 to move from the development sleeve 10 to the photosensitive member 1 (direction to develop the image portions of photosensitive member), with a magnitude correspondent to |VL−V1|, and therefore, the toner 8 is affected by a force with a magnitude proportional to |VL−V1|. On the other hand, in the period T2, an electric field works on the external additive in the direction to induce the positively charged external additive to move from the development sleeve 10 to the photosensitive member 1, with a magnitude correspondent to |V2−VL|, and therefore, the external additive is affected by a force with a magnitude proportional to |V2−VL| (also, the direction to strip the toner away from the photosensitive member and move it to the development sleeve), being induced to move in the same direction as the toner.

On the image-less portions of the photosensitive member, in the period T1, an electrical field works on the toner 8 in the direction to induce the toner 8 to move from the development sleeve 10 toward the photosensitive member 1 (direction to develop the image-less portions of the photosensitive member), with a magnitude of |VD−V1|, and therefore, a force with a magnitude proportional to |VD−V1| works on the toner 8 to induce it to move in the same direction, whereas in the period T2, an electric field works on the external additive in the direction to induce the external additive to move from the development sleeve 10 toward the photosensitive member 1 (direction to strip away toner having adhered to photosensitive member), with a magnitude of |V2−VD|, and therefore, a force with a magnitude proportional to |V2−VD| works on the external additive in the same direction.

Therefore, a test was conducted to determine the level at which the duty ratio of the development bias should be set in order to prevent the white steaks and/or the flowing image effect from appearing in an image.

The development bias used in this test was an oscillating voltage which had the following specifications: when T1=T2 (duty ratio is 1:1), Vpp=1600 V, and Vdc=−450 V, and the frequency f was 2400 Hz. It was designed so that it converted to −450 V (=Vdc) regardless of the change in the length of the periods T1 and T2, and also so that the duty ratio was variable: T1:T2=1:2–20:1. Latent images were developed using this development bias. For comparison, another test was conducted, in which all conditions were the same as in the first test, except that a conventional doctor blade, which was formed of urethane and had a hardness of 65 deg. in JISA scale, was used.

The image printed in this embodiment was a double dot grid pattern with an average dot ratio (average image ratio) of 4%. The transfer medium was an A4 size sheet of paper. A total of 3500 copies were printed, and at every 250th sheet, a solid black image was printed. The tests were conducted under two conditions: a normal-temperature, normal-humidity condition in which temperature and humidity were 23° C. and 60%, respectively, and a high-temperature, high-humidity condition in which temperature and humidity were 32.5° C. and 80%, respectively The aforementioned white streaky lines in the actual image portion of a normal image are different in cause from the agglutination lines in the solid black image. As described previously, the cause of the agglutination lines is that as the cumulative usage of a process cartridge increases, toner particles accumulate and agglutinate in the nip between the doctor blade 9 and the development sleeve 10. On the other hand, the cause of the white streaky lines in the actual image portion of a normal image is as follows. The external additive accumulates on the development sleeve 10, on the areas correspondent to the actual image portions of an image, and the doctor blade 9 is shaved by the accumulated external additive. Then, the toner particles attracted to the development sleeve, on the areas correspondent to the shaved portions of the doctor blade 9, are insufficiently charged, and therefore, fail to satisfactorily develop a latent image on the photosensitive member.

TABLE 7

| | Comp. Ex. Blade: urethane rubber Additive: No | | | Embodiment Blade: silicone rubber Additive: strontium titanate | | |
|---|---|---|---|---|---|---|
| Duty ratio T1:T2 | Occurrence of white lines in solid | Occurrence of white lines | Flow | Occurrence of white lines in solid | Occurrence of white lines | Flow |
| 1:2 | 250th | none | 111th | none | 500th | 1825th |
| | xx | ○ | x | ○ | x | Δ |
| 1:1 | 250th | none | 224th | none | 2500th | none |
| | xx | ○ | x | ○ | Δ | ○ |
| 1.5:1 | 500th | none | 126th | none | none | none |
| | xx | ○ | x | ○ | ○ | ○ |
| 2:1 | 250th | none | 89th | none | none | none |
| | xx | ○ | x | ○ | ○ | ○ |
| 5:1 | 500th | none | 232th | none | none | none |
| | xx | ○ | x | ○ | ○ | ○ |
| 10:1 | 250th | none | 114th | none | none | none |
| | xx | ○ | x | ○ | ○ | ○ |
| 15:1 | 250th | none | 256tb | none | none | 2301th |
| | xx | ○ | ○ | ○ | ○ | Δ |
| 20:1 | 500th | none | 184th | none | none | 883th |
| | xx | ○ | x | ○ | ○ | x |

The checked items were as follows. In the test conducted to test the effectiveness of the development bias in accordance with this embodiment, two types of white streaky lines, that is, the white streaky lines (1) effected in the solid black image by the toner agglutination (hereinafter, "agglutination line") when the image was printed under the normal condition (23° C. in temperature and 60% in humidity), and the white streaky lines (2) effected across the actual image portions of a normal image when the image was printed under the normal condition (23° C. in temperature and 60% in humidity), and the state of the flowing image effect caused in the dot grid pattern image when the image was printed under the high-temperature, high-humidity condition (32.5° C. in temperature and 80% in humidity), were checked. In the comparison test, the states of the agglutination white streaks in the solid black image printed under the normal condition (23° C. in temperature and 60% in humidity), and the flowing image effect in the dot grid pattern printed under the high-temperature, high-humidity condition (32.5° C. in temperature and 80% in humidity), were checked. The results are presented in Table 7.

As is evident from Table 7, in the case of this embodiment, the agglutination lines which tend to appear in a solid black image were completely suppressed. This is due to the fact that the doctor blade 9 in this embodiment, which was formed of silicone rubber, was soft enough to allow the toner 8 to pass the contact nip between the development sleeve 10 and the doctor blade 9 without causing the toner 8 to accumulate and agglutinate on the doctor blade 9, on the portion in the contact nip.

The white streaky lines which tend to appear across the actual image portion of a normal copy could be reduced by setting the duty ratio above 1.5:1. This was due to the following reason. When the duty ratio was set above 1.5:1, the ratio at which the external toner additive on the development sleeve transferred onto the photosensitive member in the development station, that is, the station where the development sleeve and photosensitive member met, became approximately uniform across the development station, whether the portion of the photosensitive member in the development station corresponded to the actual image portion of a copy, or the image-less portion of the copy, or the mixture of both. Therefore, the external toner additive did not locally accumulate on the surface of the development sleeve, and consequently, the doctor blade was prevented from locally shaved.

However, when the duty ratio was set at 1:1 or 1:2, the ratio at which the external toner additive on the development sleeve transferred onto the photosensitive member was very high, on the areas correspondent to the image-less portion of the copy, and was almost zero on the areas correspondent to the actual image portion of the copy. Therefore, as described before, the external additive accumulated on the peripheral surface of the development sleeve, on the areas correspondent to the actual image portion of the copy, shaving the doctor blade. As a result, the toner was insufficiently charged across the portions of the development sleeves correspondent to the shaved portions of the doctor blade, insufficiently developing the latent image an the photosensitive member.

The flowing image effect could be reduced or eliminated by using strontium titanate as the external toner additive. This is due to the following reason. Since strontium titanate was externally added to the toner, strontium titanate transferred onto the photosensitive member, and shaved away the ozonic compound formed on the photosensitive member.

However, when the duty ratio was set at 1:2, 15:1 or 20:1, images were not improved much in terms of the flowing image effect. This is due to the following reason. When the duty ratio was 1:2, the ratio at which the external additive (strontium titanate) transfers to the photosensitive member is greater, and therefore, the amount of the external additive added to the toner was consumed faster at the early stage of the process cartridge life, causing the ratio, at which the external additive transferred onto the photosensitive member, to reduce progressively as the cumulative usage increased. As a result, after passing a certain point of the service life, the ratio at which the external additive transferred onto the photosensitive member became too small to satisfactorily remove the ozonic compounds on the photosensitive member. Further, when the duty ratio was 15:1 or 20:1, the ratio at which the external additive transferred onto the photosensitive member was too small to completely remove the ozonic compounds on the photosensitive member, from the beginning of the service life.

As described above, the duty ratios at which image quality becomes satisfactory in terms of all three aspect of image quality, that is, the toner agglutination line in a solid black image, the white line across the actual image portion of an ordinary copy, and the flowing image effect, are 1.5:1, 2:1, 5:1 and 10:1. Therefore, in this embodiment of the present invention, the duty ratio (T1:T2) of the oscillating bias is kept within a range of 1.5:1–10:1 (T1:T2=1.5:1–10:1). With this arrangement, the agglutination line in a solid black image, the white streaky liens across the actual image portion of an ordinary copy, and the flowing image effect under the high-temperature, high-humidity condition, can be prevented, and therefore, high quality images can be obtained.

In this embodiment, strontium titanate is used as the external additive for the toner. However, the choice does not need to be limited to the choice in this embodiment; any external additive may be used as long as it functions in the same manner as the external additive in this embodiment. Also, a doctor blade is used as a regulating member in this embodiment. However, the choice does not need to be limited to a doctor blade; any regulating member may be used as long as it functions in the same manner as the one in this embodiment.

Embodiment 6

Figure 19:
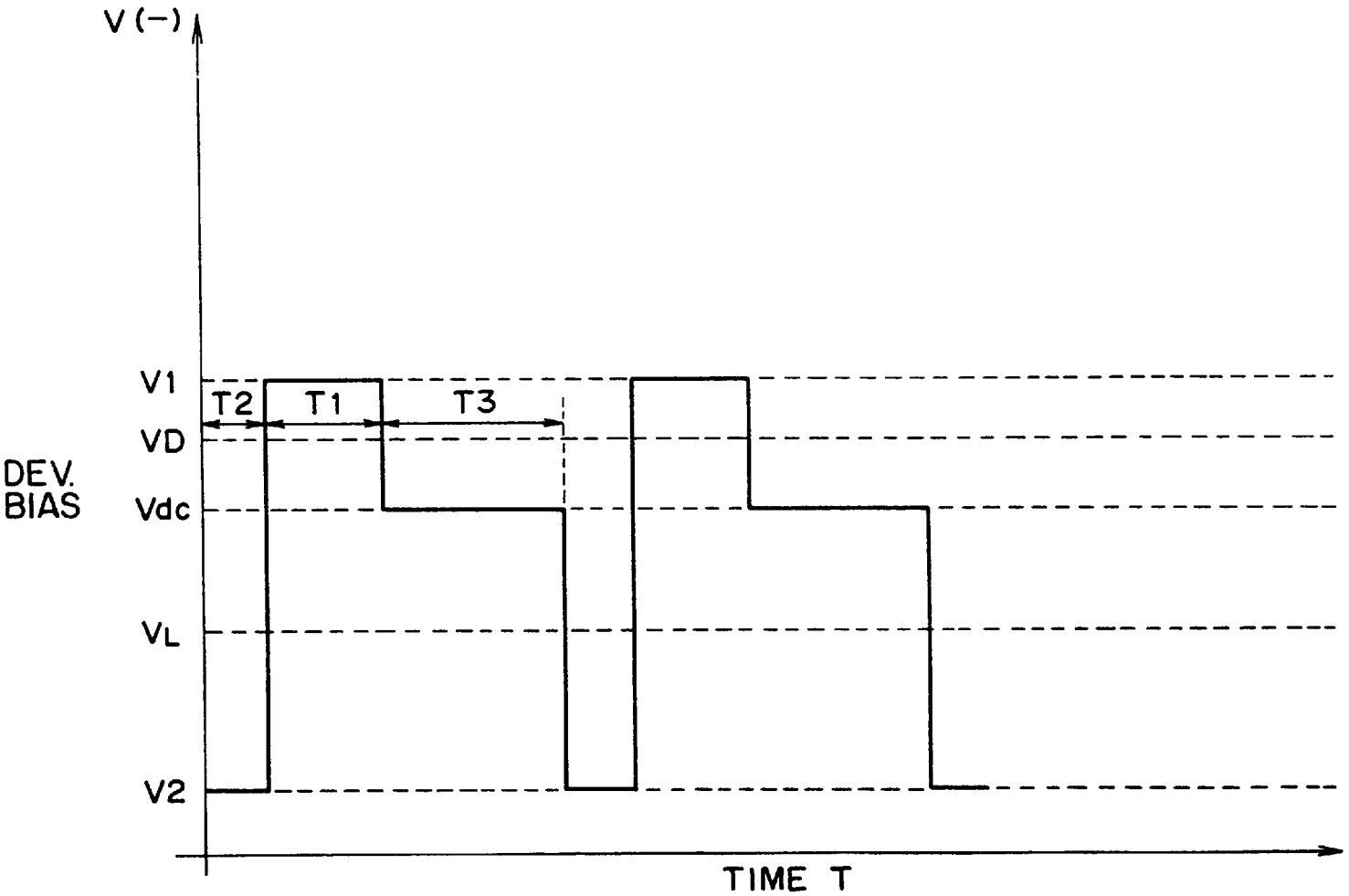
FIG. 19 is a chart which graphically shows the waveform of the development bias used in the sixth embodiment of the present invention.

FIG. 19 depicts the waveform of the development bias in the sixth embodiment of the present invention. This embodiment is characterized in that the development bias used in this embodiment has the waveform depicted in FIG. 19. The structures of the developing apparatus and the adjacencies thereof are substantially the same as those of the development apparatus and the adjacencies thereof in the fifth embodiment depicted in FIG. 17.

The development bias in this embodiment is an oscillating bias (black pulse) composed of oscillatory portions and unoscillatory, or flat, portions (black portion) which alternate. The oscillatory portion comprises two subportions: a first subportion which generates such an electric field that induces the toner to move from the development sleeve 10 toward the photosensitive member 1, and a second subportion which generates such as electric field that induces the toner to move from the photosensitive member 1 toward the development sleeve. The first subportion has a voltage level (first peak voltage) of V1 and is applied through a period T1. The second subportion has a voltage level (second peak voltage) of V2, and is applied through a period T2. The total length of time the oscillatory portion of the development bias in this embodiment is applied is: nT1+mT2 (n and m are integers; $1 \leqq n$, $1 \leqq m$). The time-average voltage level Vdc of the oscillatory portion of the oscillating voltage is on the first peak voltage side.

The oscillatory portion of the development bias starts up from the second peak, moves to the first peak, oscillates back to the second peak, and then, oscillates back to the first peak, ending a single cycle. The flat portion of the development bias, that is, the black portion, has no voltage relative to the time-average voltage level Vdc of the development bias, in other words, the voltage level of the flat portion is the same as the Vdc. It corresponds to the period T2 in FIG. 19. The black pulse starts up from the oscillatory portion and ends in black portion.

In this embodiment, the following image formation tests were conducted to investigate whether the black pulse depicted in FIG. 19 was effective to prevent the agglutination line in a solid black image, the white streaky line in the actual image portion of a copy, and the flowing image effect under the high temperature-high humidity condition.

The development bias in this embodiment had a frequency of 1200 Hz, and a single cycle of the development bias comprised an oscillatory portion, duration of which corresponds periods (T1+T2), and a blank portion, which follows the oscillatory portion, and the duration of which corresponds to the period T3 (=T1+T2). When the duty ratio was 1:1 (T1:T2=1:1), Vpp=1600 V, and Vdc=−450 V. as it was in the first embodiment. The tests were conducted varying the duty ratio within a range of 1:2–20:1 (T1:T2=1:2–20:1) so that the development bias converged to Vdc (=−450 V) regardless of the changes made to the length of the periods T1 and T2.

The above described blank pulse was used in the developing process. For comparison, another image formation test was conducted, in which the conditions were the same as the main test, except that a conventional doctor blade, which was formed of urethane and had a hardness of 65 deg. in JISA scale, was used as it was in the first embodiment. The image printed was a double dot grid pattern with an average dot ratio (average image ratio) of 4% per sheet. The transfer medium was an A4 size sheet of paper, and 3500 copies were made. During the printing test, a solid black image was produced at every 250th copy.

The test was conducted under two conditions: a normal-temperature (23° C.), normal-humidity (60%) condition, and a high-temperature (32.5° C.), high-humidity (80%) condition. The checked items were the states of the toner agglutination lines in the solid black image printed under normal condition (23° C., 60%), the white streaky lines in the actual image portion of an image printed under the normal condition (23° C., 60%), and the flowing image effect in the dot grid pattern printed under the high-temperature, high-humidity condition (32.5° C., 80%). In the comparison test, the states of the agglutination white streaks in the solid black image printed under the normal condition (23° C. in temperature and 60% in humidity), and the flowing image effect in the dot grid pattern printed under the high-temperature, high-humidity condition (32.5° C. in temperature and 80% in humidity), were checked. The results are presented in Table 8.

Therefore, the external additive was collected on the development sleeve, eliminating the difference between the portions of the development sleeve correspondent to the actual image portion of a latent image on the photosensitive member, and the portions of the development sleeve correspondent to the image portion (print portion) of the photosensitive member, in the amount of the external additive on them. In other words, the external additive was substantially evenly distributed across the development sleeve, and therefore, the local shaving of the doctor blade, which tended to occur to a doctor blade across the portions correspondent to the actual image portion of an image, did not occur. Thus, the white streaky lines traceable to the accumulation of the external additive on the development sleeve, across the areas correspondent to the actual image portion of an image, did not occur.

Further, this embodiment was different from the fifth embodiment in that the level of the flowing image effect was substantially low even when the duty ratio was 1:2. This was due to the following reason That is, when a single cycle of the blank pulse ends on the first peak voltage V1 side as described above, the external additive collects on the development sleeve side, and as a result, the flowing image effect was kept at a low level even through the latter half of the test in which a large number of copies were printed.

TABLE 8

| | Comp. Ex. Blade: urethane rubber Additive: No | | | Embodiment Blade: silicone rubber Additive: strontium titanate | | |
|---|---|---|---|---|---|---|
| Duty ratio T1:T2 | Occurrence of white lines in solid | Occurrence of white lines | Flow | Occurrence of white lines in solid | Occurrence of white lines | Flow |
| 1:2 | 250th | none | 213th | none | 2238th | 2786th |
| | xx | ○ | x | ○ | Δ | Δ |
| 1:1 | 500th | none | 210th | none | none | none |
| | xx | ○ | x | ○ | ○ | ○ |
| 1.5:1 | 250th | none | 148th | none | none | none |
| | xx | ○ | x | ○ | ○ | ○ |
| 2:1 | 500th | none | 315th | none | ncxne | none |
| | xx | ○ | x | ○ | ○ | ○ |
| 5:1 | 250th | none | 118th | none | none | none |
| | xx | ○ | x | ○ | ○ | ○ |
| 10:1 | 250th | none | 221th | none | none | none |
| | xx | ○ | x | ○ | ○ | ○ |
| 15:1 | 250th | none | 134th | none | none | 2197th |
| | xx | ○ | x | ○ | ○ | Δ |
| 20:1 | 250th | none | 254th | none | none | 798th |
| | xx | ○ | x | ○ | ○ | x |

As is evident from Table 8, in the case of this embodiment, the agglutination lines which tend to appear in a solid black image were completely suppressed, as they were in the case of the first embodiment.

Further, this embodiment was different from the first embodiment in that the white streaky lines which tend to appear across the actual image portion of an image were completely suppressed by the standard bias with a duty ratio 1:1, and also they were remarkably suppressed, although not completely, when the duty ratio was 1:2. This was due to the following reason. In this test, each cycle of the black pulse, i.e., each cycle of the development bias in this embodiment, was caused to end on the first peak side, where the voltage level was V1, due to the presence of the blank portion.

As is evident from the tests described above, according to this embodiment, a blank pulse is used as the development bias applied to the development sleeve, and further, the blank bias is designed so that the blank portion of the blank bias ends on the first peak voltage V1 side. Therefore, even when the duty ratio is set at 1:1, i.e., the standard ratio, the amount by which the white streaky lines appear across the actual image portion of a copy can be reduced. In other words, high quality images can be obtained while affording more latitude in terms of the duty ratio. Further, even if the duty ratio is set so that the length of the period through which the second peak voltage V2 is applied becomes longer, high quality images which do not suffer from the flowing image effect can be obtained even throughout the latter half of the service life of a process cartridge in which a large number of copies are made.

The single cycle of the blank pulse used as the development bias in this embodiment has a single blank portion after the oscillatory portion. However, the design of the blank pulse does not need to be limited to the one used in this embodiment; it does not matter as long as the same function as the one provided by this embodiment can be provided. In other words, the present invention is not restricted by this embodiment, in terms of the design of the blank pulse.

Embodiment 7

In this embodiment, the image forming apparatus depicted in FIG. 1 or FIG. 17 is employed. The developer is mixture of negatively chargeable magnetic resin toner, and positively chargeable external additive, for example, strontium titanate particles of Melamine particles. The developing apparatus employs a known reversal development process, and develops in reverse an electrostatic latent image borne on a latent image bearing member 1, into a visible image.

Next, the tests conducted by the inventors of the present invention to determine the proper range for the ratio by which the external additive should be initially added to the resin toner will be described with reference to the results of the measurement in the tests.

Figure 20:
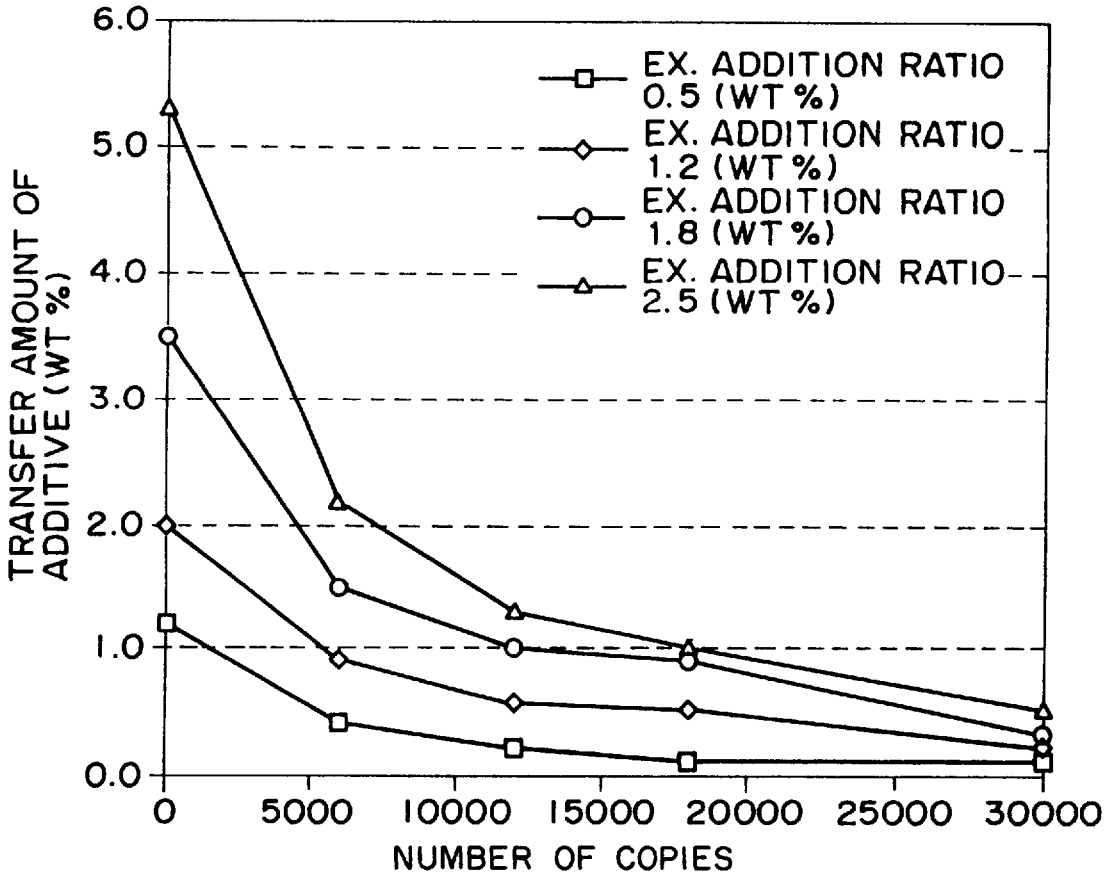
FIG. 20 is a graph which shows the change in the voltage level of the development bias, and the change in the ratio at which the external additive transferred onto the photosensitive member, in the seventh embodiment of the present invention.

FIG. 20 is a graph which shows the relationship between the weight ratio at which the external additive was transferred onto the photosensitive member, and the number of copies printed during the tests. The development bias applied from a bias power source 12 to a development sleeve 10 was a compound bias composed of an AC voltage with a peak-to-peak voltage Vpp of 1800 V (Vpp=1800 V) and a frequency of 2000 Hz, and a DC voltage with a voltage level of −450 V (Vdc=−450). The development bias, or the development voltage, was given a rectangular waveform with a duty ratio of 1:1. In the tests, four developers different in terms of the weight ratio by which the external additive was initially added to the resin toner were used (0.5 wt. %, 1.2 wt. %, 1.8 wt. % and 2.5 wt. %), and an image was printed on 5000 sheets of recording medium, using each developer, to examine the relationship between the weight ratio by which the external additive was initially added to the resin toner, and the durability of the latent image bearing member 1.

As is evident from FIG. 20, the higher the ratio of the external additive to the resin toner, the longer the durability of the latent image bearing member 1. However, none of the above listed weight ratios of the external additive to the resin toner was satisfactory to maintain the performance of the latent image bearing member 1 at the desirable level until the end of the printing session in which an image was printed on 5000 sheets of recording medium.

As is evident from FIG. 20, in all cases of the above listed weight ratios of the external additive to the resin toner, the ratio at which the external additive transferred onto the latent image-less portions of the photosensitive member was greater at the beginning of the printing session in which the durability of the latent image bearing member was measured, but gradually decreased as the session progressed. Past the midpoint of the durability measurement session for the latent image bearing member, the ratio between the rate at which the resin toner was transferred onto the latent image portions of the latent image bearing member, and the rate at which the external additive was transferred onto the latent image-less portions of the latent image bearing member 1, became lower than the ratio by which the external additive was initially added to the resin toner prior to the starting of the durability measurement test for the latent image bearing member 1.

This is due to the following reason. That is, at the beginning of the latent image bearing member durability measurement test, the external additive transferred onto the latent image-less portions of the latent image bearing member 1, at a high ratio to the resin toner, reducing the ratio of the external additive in the developer. As a result, the performance of the latent image bearing member 1 did not remain at the desirable level through the end of the printing session in which an image was printed on 5000 sheets of recording medium.

Further, in order to investigate the relationship among the duty ratio of the compound voltage (development bias), the ratio between the resin toner and the external additive added to the resin toner, and the durability of the latent image bearing member 1, three compound voltages different in duty ratio were used and the results of their usage were measured.

At this time, the compound voltage power source 12 used in the above described the latent image durability measurement sessions will be described with reference to FIG. 21.

Figure 21:
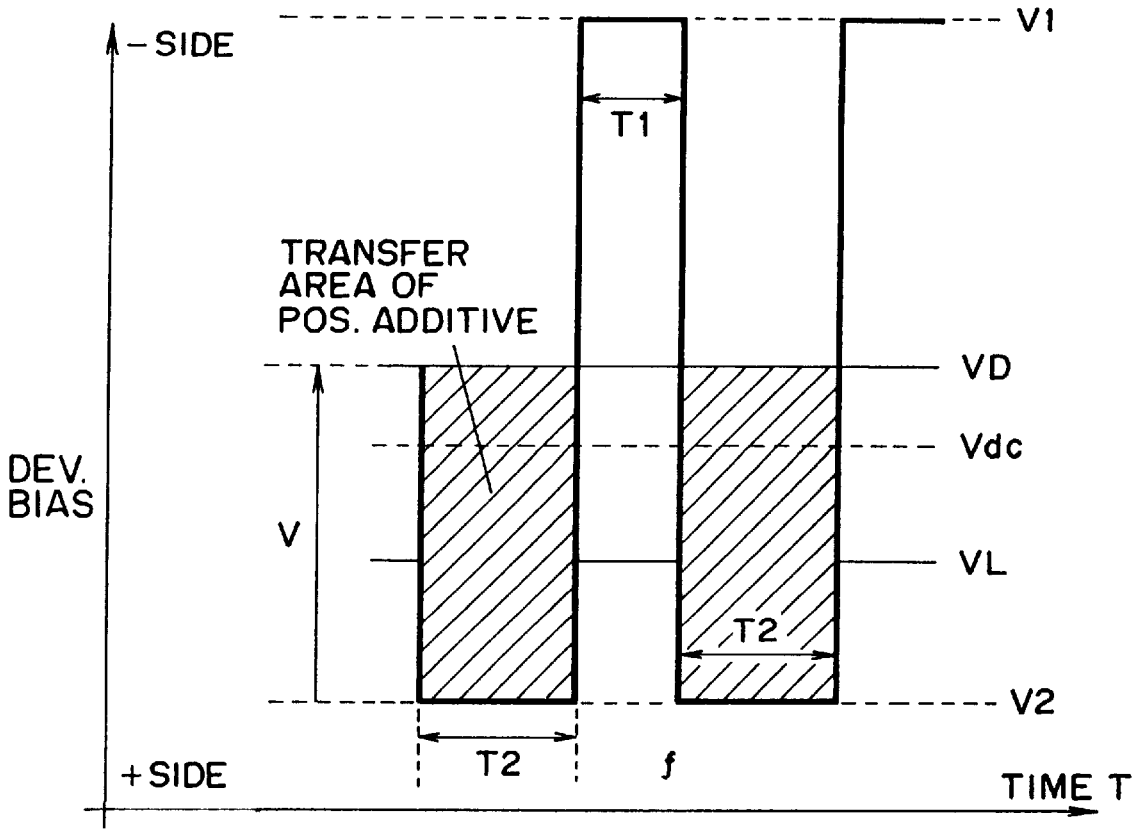
FIG. 21 is a chart which shows the waveform of the development bias in the seventh embodiment of the present invention.

FIG. 21 is an explanatory drawing which depicts the waveform of the development bias applied from the bias power source 12 to the development sleeve 10.

In FIG. 21, a referential code Vdc represents the time-average voltage level of the development bias applied from the bias power source 12 to the development sleeve 10, that is, the integral average across a single cycle (T1+T2). Reference characters T1 and T2 represent periods through which the voltage level of the development bias remains at peak levels V1 and V2, respectively.

In other words, this embodiment is characterized in that image density can be controlled through the adjustment of the time-average voltage level of the development bias.

Also in FIG. 21, a referential code VL represents the potential level of the latent image portion of the latent image bearing member 1, and a reference characters VD represent the potential level of the latent image-less portion of the latent image bearing member 1.

Further, the development bias in this embodiment was given the following properties when the T1=T2 (duty ratio is 1:1), |V1−V2|=1400 V; Vdc=−400 V.

Referring to FIG. 21, the potential levels of the latent image bearing member 1, on the portions correspondent to the actual image portions, and the image-less portions, of a latent image, were set at −150 V and −65 V (VL=−150 V, VD=−65 V), respectively. In order to change image density, |Vdc−VL| was adjusted to 300 V (|Vdc−VL|=300 V), adjusting the amount of light projected during the exposing process, and also, |Vdc−VD| was adjusted to 200 V by shifting the waveform of the development bias in entirety (|Vdc−VD|=200 V).

With this arrangement, on the latent image portions of the latent image bearing member 1, the actual image portions of the latent image, which are negative in polarity, are developed in reverse by the developer triboelectrically charged to negative polarity. Therefore, such an electric field that induces the developer to move from the portions of the latent image bearing member 1, correspondent to the actual image portion of the latent image, toward the peripheral surface of the development sleeve 10, works on the developer, with a magnitude correspondent to |VL−V|, throughout the period T1.

Thus, a force with a magnitude proportional to |VL−V1| works on the developer in the direction to induce the developer to move from the peripheral surface of the development sleeve 10 toward the latent image portions of the latent image bearing member 1, throughout the period T1, because the developer is mainly composed of negatively chargeable resin.

However, throughout the period T2, such an electric field that induces the developer to move from the peripheral surface of the development sleeve 10 toward the latent image portions of the latent image bearing member 1, works on the developer, with a magnitude correspondent to |V2−VL|. Thus, a force with a magnitude proportional to |V2−VL| works on the developer in the direction to induce the developer to move from the latent image portions of the latent image bearing member 1, toward the peripheral surface of the development sleeve 10.

On the other hand, on the latent image-less portions of the latent image bearing member 1, such an electric field that induces the developer to move from the latent image-less portion of the latent image bearing member 1, toward the peripheral surface of the development sleeve 10, works on the developer, with a magnitude correspondent to |VD−V1|, throughout the period T1. Thus, a force with a magnitude proportional to |VD−V1| works on the external additive in the direction to induce the external additive to move from the latent image-less portions of the latent image bearing member 1, toward the peripheral surface of the development sleeve 10, throughout the period T1.

However, throughout the period T2, such an electric field that induces the developer to move from the peripheral surface of the development sleeve 10 toward the latent image portions of the latent image bearing member 1, works on the developer, with a magnitude correspondent to |V2−VL|. Thus, a force with a magnitude proportional to |V2−VL| works on the external additive in the direction to induce the external additive to move from the peripheral surface of the development sleeve 10 toward the latent image-less portions of the latent image bearing member 1.

Referring to FIG. 21, in this embodiment, the size of an area S which can serve as an index for showing the rate per unit of time at which the external additive is transferred onto the latent image-less portion of the latent image bearing member 1, from the peripheral surface of the development sleeve 10 is defined as the product of the contrast E between the potential level VD of the latent image-less portion of the latent image bearing member 1, and the highest voltage level V2 of the development bias, the length of the period T2 through which the voltage level of the development bias applied from the bias power source 12 to the development sleeve 10 remains at the highest voltage level V2, and the frequency f of the development bias; in other words, S=E·T2·f.

Figure 22:
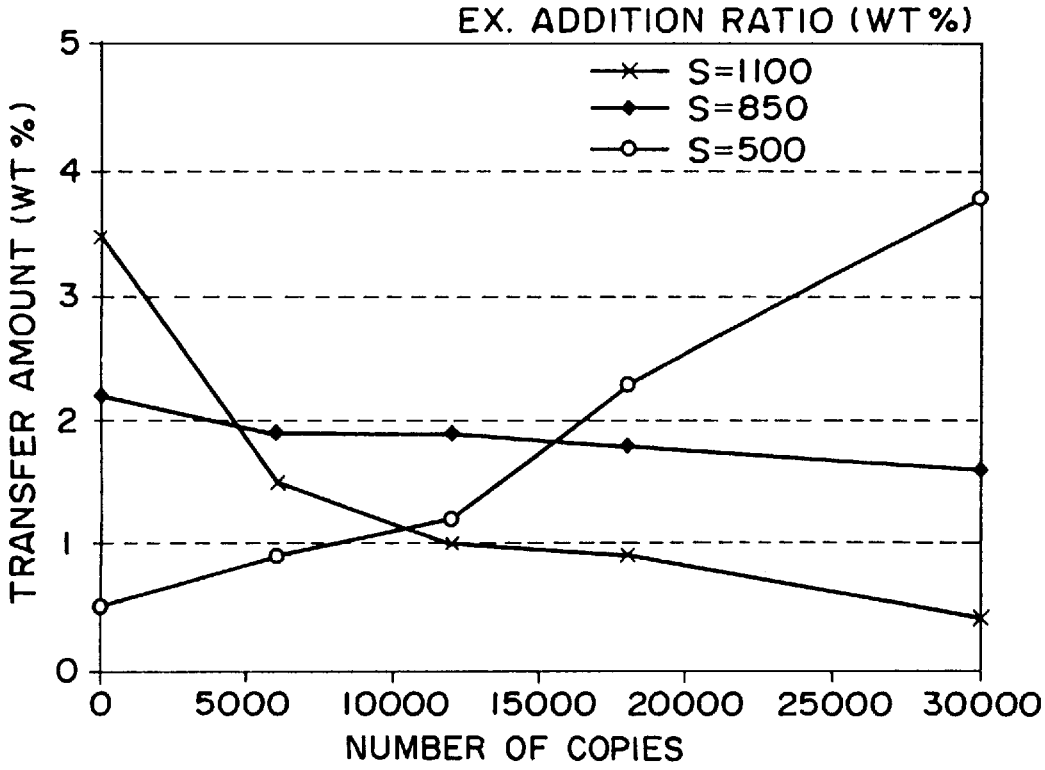
FIG. 22 is a graph which shows the ratio to toner at which the external additive transferred onto the photosensitive member, with reference to various sizes of the area of the development bias waveform, correspondent to the transferring of the external additive, in the seventh embodiment.

FIG. 22 shows the ratio at which the external additive transferred, with reference to the number of copies printed, and three different sizes of the area S (1100 V.sec.Hz. 850 V.sec.Hz, and 500 V.sec.Hz), which are shown in Table 9. The initial ratio between the external additive and the toner in the developer was 1.8 wt. %.

TABLE 9

| | | | |
|---|---|---|---|
| Additive transfer area S | 550 | 423 | 248 |
| Contrast V | 1100 | 900 | 750 |
| Application time T2 (10R (−3)) | 0.25 | 0.235 | 0.165 |
| Freq. | 2000 | 2000 | 2000 |

As is evident from FIG. 22, at the beginning of the service life of a process cartridge, the smaller the external additive side area size, the smaller the ratio at which the external additive transferred, whereas toward the end of the service life, the smaller the external additive side area size, the greater the ratio at which the external additive transferred.

In other words, this table implied that the ratio at which the external additive transfers could be kept steady at a desirable level throughout the service life of a process cartridge by adjusting the eternal additive side area size.

Thus, the ratio at which the external additive transferred onto the latent image bearing member 1 (hereinafter, "initial ratio") was measured for each ratio by which the external additive was initially added to the toner, that is, the initial ratio between the external additive and the toner in a process cartridge, (hereinafter "initial ratio"). The results of the measurement are given in FIG. 23 in a graphical form, showing the transfer ratio of the external additive, with reference to the initial ratio of the external additive, and the external additive side area size. A graph (1) represents a case in which the transfer ratio of the external additive was greater than the initial ratio of the external additive, at the beginning of the service life of the service life of the process cartridge, but became less than the initial ratio, in the latter half; (2), a case in which the transfer ratio was kept close to the initial ratio throughout the service life; and a graph (3) represents a case in which the transfer ratio was less than the initial ratio, in the beginning of the service life, but became greater than the initial ratio, in the latter half of the service life.

Figure 23:
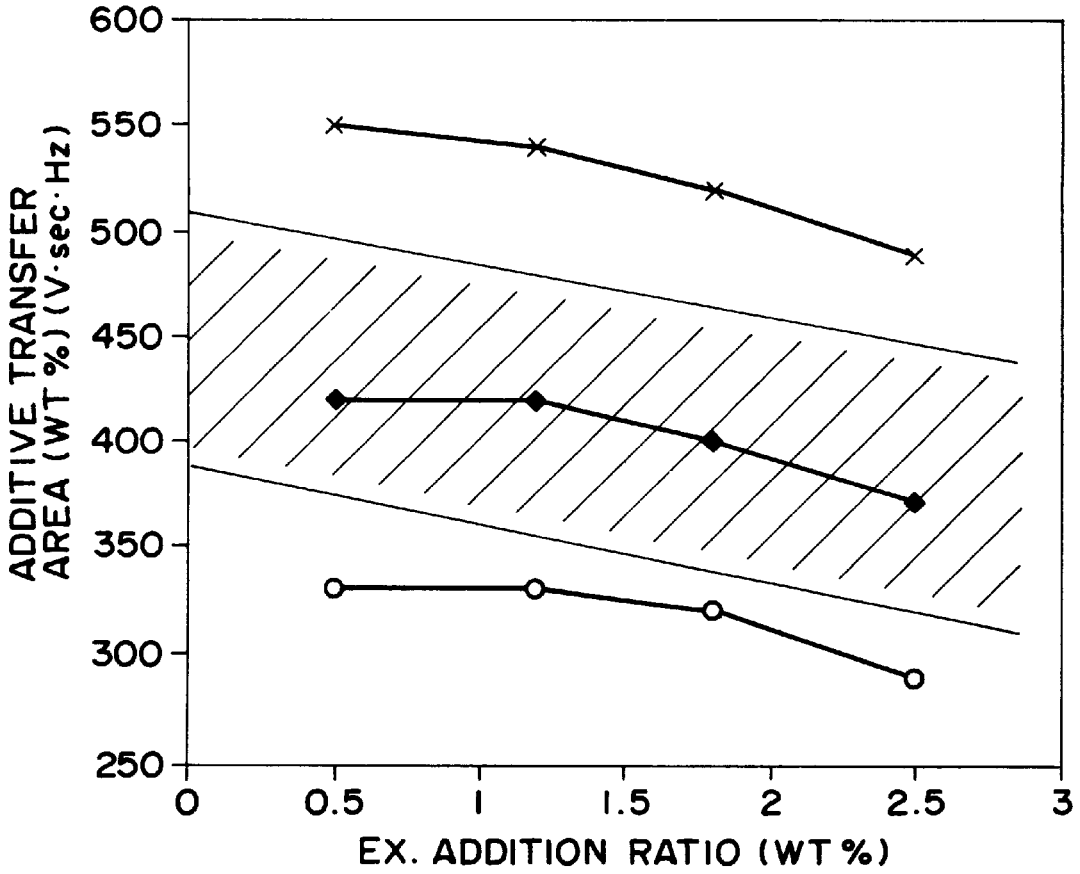
FIG. 23 is a graph which shows the relationship between the ratio to toner at which the external additive transferred onto the photosensitive member, and the various sizes of the development bias waveform area correspondent to the transferring of the external additive, in the seventh embodiment.

As is evident from FIG. 23, the change in the transfer ratio of the external additive, which occurs throughout the service life of a process cartridge, can be controlled by adjusting the size of the external additive side area S. Further, it is implied that there is a clear correlation between the size of the external additive side area S and the initial ratio W (weight ratio) of the external additive. Therefore, it may be assumed that the ratio at which the external additive transfers onto the latent image bearing member 1 can be controlled by adjusting the size of the external additive side area S.

The results of the measurement of the transfer ratio of the external additive, which are given in FIG. 23, do not indicate that the transfer ratio of the external additive had closer relation to one of the aforementioned two components of the external additive side area S, that is, the contrast and the length of the period T2, than the other. All that could be confirmed was that there was a correlation between the transfer ratio of the external additive and the size of the external additive side area.

Thus, in order to adjust the size of the external additive side area, either the contrast V or the length of the period T2, or both may be adjusted.

In another test conducted based on the classification of the transfer ratio of the external additive, image quality was measured in various terms while changing the size of the external additive transfer side area. The results are given in FIG. 24.

Figure 24:
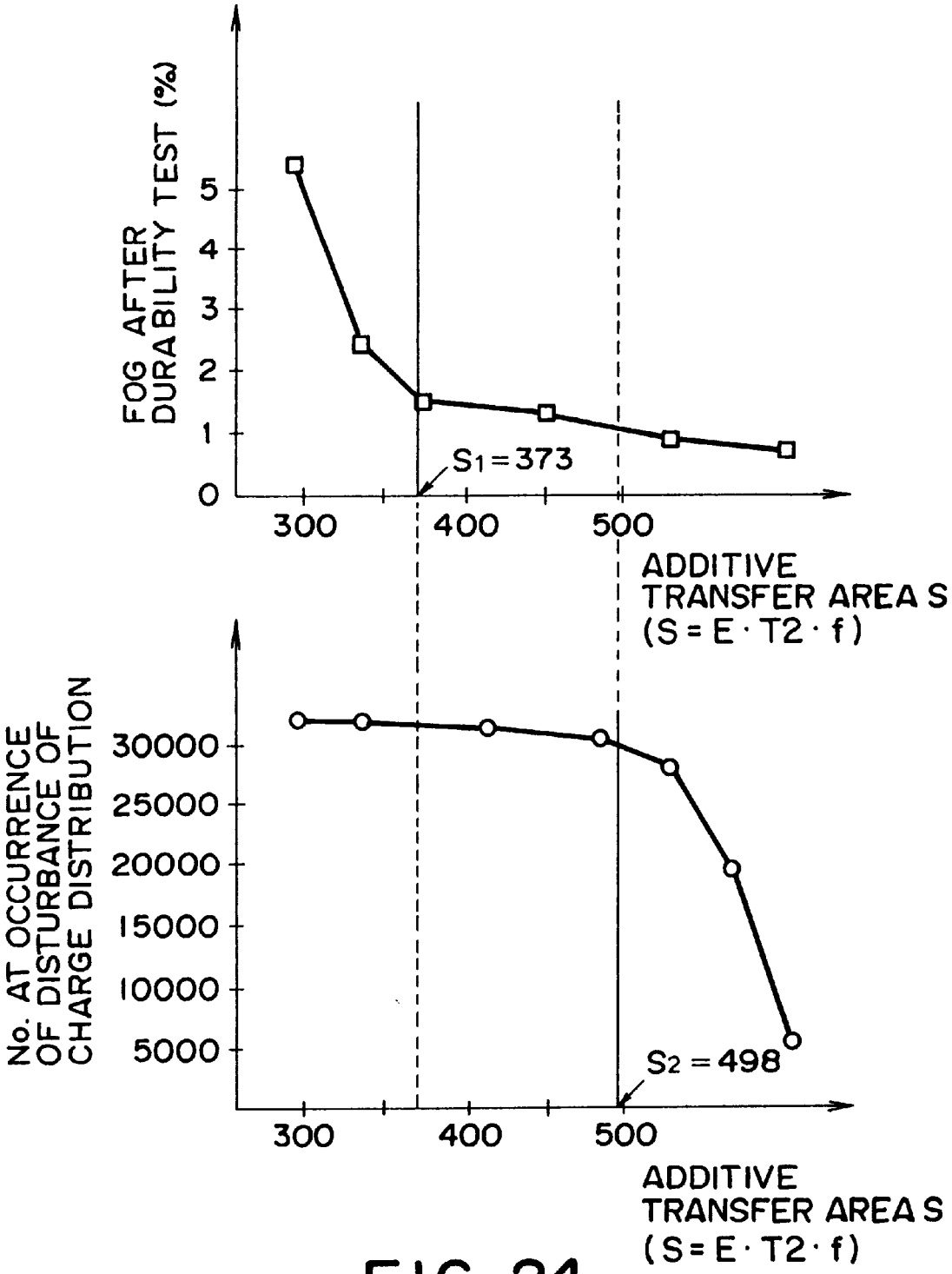
FIG. 24 is a graph which shows the relationship between the size of the development bias waveform area correspondent to the transferring of the external additive, and image quality, when the ratio to toner by which the external additive was initially added to the toner was 0.5 percent in weight, in the seventh embodiment.

FIG. 24 is a graph which shows the relationship between the size of the external additive side area S and image quality, which was observed when the initial ratio W (weight ratio) was kept at 0.5.

As is evident from FIG. 24, the greater the size of the external additive side area S, the smaller the amount of the fog at the end of the durability test, in which 3000 copies were printed, but the earlier did the charge begin to become nonuniform.

In FIG. 24, the amount of the fog is represented by the difference in the reflection density of a sheet of recording medium between prior and after the printing of a solid image on the sheet. The reflection density of the recording medium was measured by Densitometer TC-6DS (Tokyo Denshoku Co., Ltd.).

It seems that the aforementioned tendency of the fog resulted from the following cause. That is, when the size of the external additive side area S is relatively small, the transfer ratio of the external additive was smaller at the beginning of the service life, but became greater than the initial ratio of the external additive, in the latter half of the service life. In other words, the external additive was consumed by an insufficient amount, remaining in the main assembly of the developing apparatus, and therefore, progressively increasing the ratio of the external additive in the developer as the printing operation continued. As a result, the amount of the electrical charge which the developer particles received became nonuniform. Consequently, it became easier for the fog to occur.

On the other hand, when the size of the external additive side area S was relatively large, the transfer ratio of the external additive was greater at the beginning of the service life, but it became less than the initial ratio of the external additive, in the latter half of the service life. In other words, at the beginning of the service life, the phenomenon that the latent image bearing portion of the latent image bearing member 1 is nonuniformly charged (hereinafter, "charge uniformity disruption") was effectively prevented, but toward the end of the service life, the charge uniformity disruption could not be effectively prevented.

Thus, in order to solve the above described various problems, the size of the external additive side area S should be in a range of 373–498 ($373 \leqq S \leqq 498$), provided that the initial ratio W (wt. %) of the external additive is set at 0.8 wt. %, as shown in FIG. 24.

In other words, when the size of the external additive side area S is in the range of 373–498 ($373 \leqq S \leqq 498$), the transfer ratio of the external additive is kept at a desirably level throughout the service life of a process cartridge, and therefore, not only can the fog be prevented, but also the charge uniformity disruption can be prevented until the end of the service life, in which 3000 copies is printed.

Figure 25:
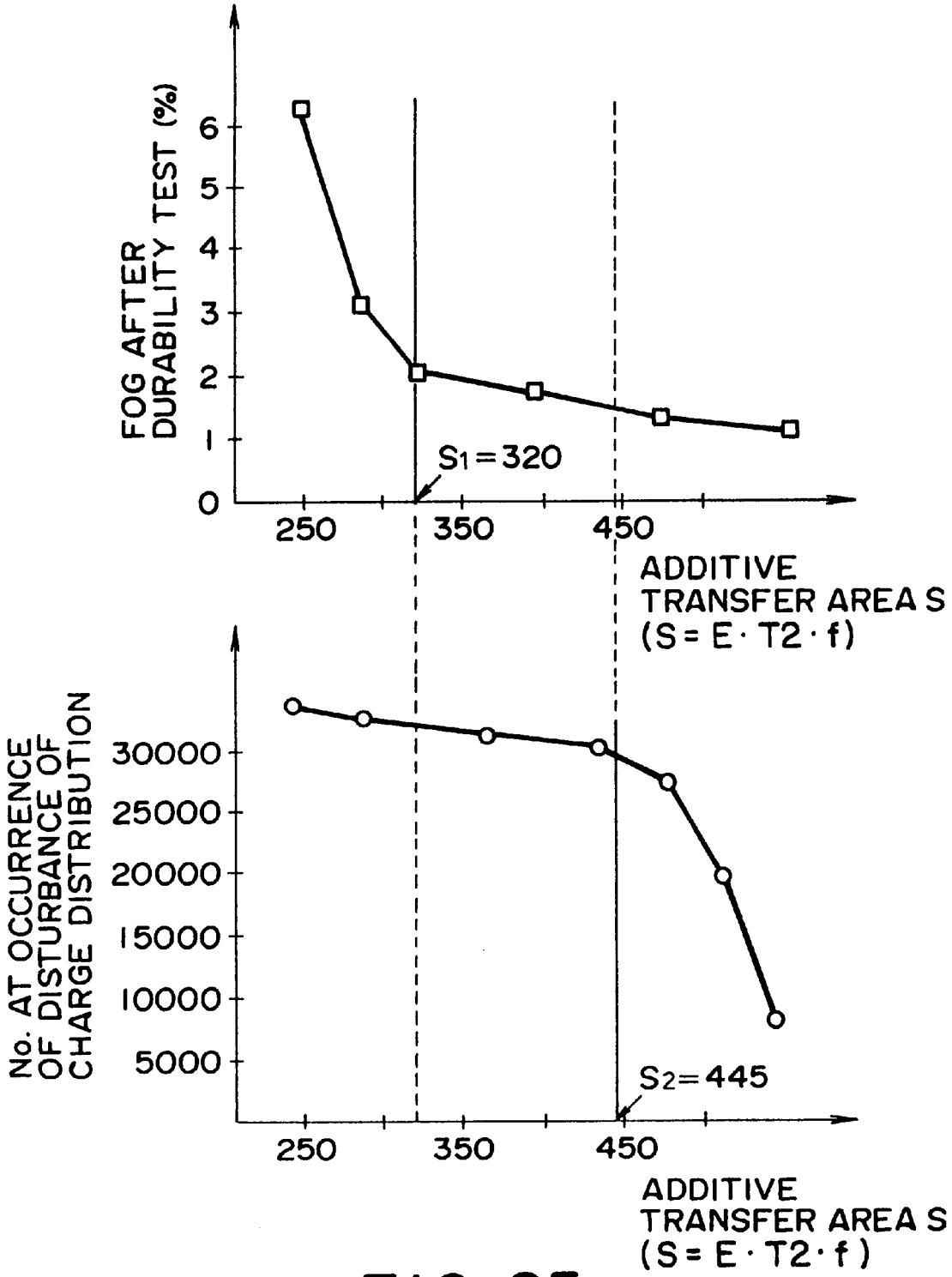
FIG. 25 is a graph which shows the relationship between the size of the development bias waveform area correspondent to the transferring of the external additive, and image quality, when the ratio to toner by which the external additive was initially added to the toner was 2.5 percent in weight, in the seventh embodiment.

FIG. 25 is a graph which shows the relationship between the size of the external additive side area S and image quality when the initial ratio W (wt. %) of the external additive was set at 2.5 wt. %.

As is evident from FIG. 25, also in this case, the greater the size of the external additive side area S, the smaller the amount of the fog at the end of the durability measurement session, in which 3000 copies were printed. However, in this case, the time at which the charge uniformity disruption occur became earlier.

Thus, in order to prevent the aforementioned various problems, the size of the external additive side area S should be within a range of 320–445 ($320 \leqq S \leqq 445$) if the initial ratio W (wt. %) of the external additive is set at 2.5 wt. % (W=2.5).

As described above, the optimum range for the size of the external additive side area S remained approximately the same even when the initial ratio W (wt. %) was changed, and further studies upon this observation confirmed that there are the following primary correlation between the lowest and highest values S1 and S2, respectively, of the optimum range for the size of the external additive side area S, and the initial ratio W of the external additive:

$$S1=-26.5W+386$$

$$S2=-26.5W+511.$$

Thus, in consideration of the facts that if the initial ratio of the external additive is too small, the effectiveness of the external additive in terms of the prevention of the charge uniformity disruption diminishes, and that if the initial ratio of the external additive is too large, the problems such as the fog occur, the initial ratio W of the external additive and the size of the external additive side area S should be determined to satisfy the following formula:

$$-26.5W+386 \leqq S \leqq -26.5W+511.$$

With such an arrangement, it becomes possible to maintain desirable image quality from the beginning to the end of the service life of the process cartridge 43.

For the purpose of confirming the effectiveness of this embodiment, the inventors of the present invention tested the process cartridge 43 and the printer 100, in terms of the fog and the charge uniformity disruption, with the initial ratio of the external additive relative to the resin toner and the size of the external additive side area S being set at 2.0 wt. % and 350, respectively. The results of the test showed that both the fog and the charge uniformity disruption were prevented throughout the service life of the process cartridge 43.

This embodiment may be summed up as follows. According to this embodiment, the external additive added to the resin toner by an optimum ratio to the resin toner is caused to transfer from the peripheral surface of the development sleeve 10 to the latent image-less portion of the latent image bearing member 1 by the oscillatory electric field generated between the latent image bearing member 1 and the development sleeve 10, and reduces the amount of frictional wear which occurs to the latent image-less portion of the photosensitive member, and recording medium. Therefore, the phenomenon that talc contained in recording medium is caused to leak by the friction between the recording medium and the latent image-less portion of the latent image bearing member 1 can be prevented. Further, the fog is prevented, and also, the time it takes for the amount of the ozonic compounds grows to the level at which the charge uniformity of the latent image-less portion of the latent image bearing member 1 can be prolonged.

Further, in this embodiment, the latent image bearing member 1, the developing apparatus 3, and the like, are contained in the process cartridge which is removably installable in the main assembly of the printer. Therefore, maintenance such as repair of the latent image bearing member 1 or replacement of the developing apparatus 3 can be done by exchanging the old process cartridge with a new one, simplifying the maintenance, which is quite advantageous.

Further, in this embodiment, the developer composed of negatively chargeable resin toner, i.e., the main component, and positively chargeable external additive, is used. Obviously, however, the same effects and advantages as those of this embodiment can be realized by using developer composed of positively chargeable resin toner, i.e., the main component, and negatively chargeable external additive.

Further, in this embodiment, a laser beam printer is employed as an example of an image forming apparatus compatible with the present invention. However, obviously, the same effects and advantages will be realized when this embodiment is applied to an image forming apparatus other than a laser beam printer, for example, a copying machine, a facsimile machine, a microfilm reader/printer, an image displaying/recording apparatus, or the like.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing an electrostatic image;

a developer carrying member for carrying a developer and for forming a developing zone with said image bearing member, wherein an additive having a charging polarity opposite to a polarity of the developer is externally added to the developer;

voltage applying means for applying a developing voltage to said developer carrying member;

voltage control means for controlling the developing voltage so as to change force for directing the additive toward a non-image portion of said image bearing member in accordance with a number of image forming operations.

2. An apparatus according to claim 1, wherein the developing voltage is in the form of a rectangular wave, and said control means controls a duty ratio of the developing voltage.

3. An apparatus according to claim 1, wherein said control means increases a size of a jump side area of the additive in a waveform of the developing voltage with the increase of the number of the image forming operations.

4. An apparatus according to claim 1, wherein said developer carrying member is contained in a developing cartridge detachably mountable to a main assembly of said image forming apparatus.

5. An apparatus according to claim 4, wherein said developer carrying member is contained in a unit which contains said image bearing member and said developer carrying member integrally.

6. An apparatus according to claim 5, wherein said unit includes storing means for storing the number of image forming operations, wherein said control means controls the developing voltage in accordance with information stored in the storing means.

7. An image forming apparatus comprising:

an image bearing member for bearing an electrostatic image;

a developer carrying member for carrying a developer and for forming a developing zone with said image bearing member, wherein an additive having a charging polarity opposite a polarity of the developer is externally added to the developer;

voltage applying means for applying a developing voltage to said developer carrying member;

voltage control means for controlling the developing voltage such that force for directing the additive toward said image bearing member is smaller during non-developing duration than during developing operation duration.

8. An apparatus according to claim 7, wherein said voltage applying means applies an oscillating voltage which oscillates across a charge potential of said image bearing member.

9. An apparatus according to claim 8, wherein said control means reduces a peak value of the voltage for applying the force for directing the additive toward said image bearing member.

10. An apparatus according to claim 8, wherein said control means shorten a time duration of the voltage for applying the force for directing the additive toward said image bearing member.

11. An apparatus according to claim 7, wherein said developer carrying member is contained in a developing cartridge detachably mountable to a main assembly of said image forming apparatus.

12. An apparatus according to claim 11, wherein said developer carrying member is contained in a unit which contains said image bearing member and said developer carrying member integrally.

13. An apparatus according to claim 7, wherein said non-development duration occurs in an interval of image forming operations, before image forming operation or after image forming operation.

14. An image forming apparatus comprising:

an image bearing member for bearing an electrostatic image;

a developer carrying member for carrying a developer and for forming a developing zone with said image bearing member, wherein an additive having a charging polarity opposite to a polarity of the developer is externally added to the developer;

voltage applying means for applying a developing voltage to said developer carrying member, said developing voltage is in the form of a rectangular wave which oscillates across a charged potential of said image bearing member;

wherein a ratio of a time duration T1 of continuing applied voltage for applying force to the developer toward said image bearing member and a time duration T2 of continuing applied voltage for applying force to the developer toward said developer carrying member, in the developing voltage, is 3:2 to 10:1.

15. An image forming apparatus comprising:

an image bearing member for bearing an electrostatic image;

a developer carrying member for carrying a developer and for forming a developing zone with said image bearing member, wherein an additive having a charging polarity opposite to a polarity of the developer is externally added to the developer;

voltage applying means for applying a developing voltage to said developer carrying member, said developing voltage includes a rectangular wave portion which oscillates across a charged potential of said image bearing member and a rest portion close to the charged potential;

wherein said voltage applying means stops application of the voltage at a point of time in which the additive receives the force toward said developer carrying member.

16. An apparatus according to claim 15, further comprising an elastic blade, elastically urged to said developer carrying member, for regulating an amount of the developer applied on said developer carrying member and for triboelectrically charging the developer.

17. An apparatus according to claim 16, wherein said blade has a JIS-A hardness of 10–55 degrees.

18. An image forming apparatus comprising:

an image bearing member for bearing an electrostatic image;

a developer carrying member for carrying a developer and for forming a developing zone with said image bearing member, wherein an additive having a charging polarity opposite to a polarity of the developer is externally added to the developer;

voltage applying means for applying a developing voltage to said developer carrying member, said developing voltage oscillates across a charged potential of said image bearing member; and wherein a size of area S (V×sec) of a region in a waveform of the developing voltage in which the additive receives force toward said image bearing member and an amount of additive W (% by wt.) in the developer satisfy the following relationship:

$$-26.5W+386 \leq S \leq -26.5W+511.$$

19. An apparatus according to claim 18, wherein the developing voltage is rectangular, and the area size S is a level of the voltage for applying force to the additive toward said image bearing member multiplied by a difference of the voltage from the charged voltage of said image bearing member and a time duration of the level of the voltage.

* * * * *

UNITED STATES PATENT AND TRADEMARK OFFICE

CERTIFICATE OF CORRECTION

PATENT NO. : 6,163,663
DATED : December 19, 2000
INVENTOR(S) : Seiichi Shinohara, et al.

It is certified that error appears in the above-identified patent and that said Letters Patent is hereby corrected as shown below:

Title page,
Item [56], "(JP 8-262,948)." should read -- (JP 8-262948) --.
Item [57], Abstract line 8, "voltage a" should read -- a voltage --.

Column 6,
Line 62, "potions, should read -- portions, --.

Column 7,
Line 63, "referential codes" should read -- reference characters --.

Column 8,
Lines 1, 3 and 9, "referential codes" should read -- reference characters --; and
Line 62, "highest" should read -- highest. --.

Column 9,
Line 16, "reduced," should read -- was reduced, --;
Line 19, "increased." should read -- was increased. --;
Line 27, "ratio" should read -- ratio of --; and
Lines 42 and 44, "referential" should read -- reference --.

Column 14,
Line 17, "reduced," should read -- was reduced, --;
Line 19, "increased." should read -- was increased. --;
Line 20, "The" should read -- This --; and
Lines 55 and 57, "referential" should read -- reference --.

Column 15,
Line 44, "was improved" should be deleted.

Column 16,
Line 46, "halt" should read -- half --; and
Line 67, "is" should read -- are --.

Column 17,
Line 1, "station" should read -- stage --; and
Line 22, "develops" should read -- develop --.

UNITED STATES PATENT AND TRADEMARK OFFICE

CERTIFICATE OF CORRECTION

PATENT NO. : 6,163,663
DATED : December 19, 2000
INVENTOR(S) : Seiichi Shinohara, et al.

It is certified that error appears in the above-identified patent and that said Letters Patent is hereby corrected as shown below:

Column 18,
Line 11, "is" should be deleted;
Line 46, "characters" should read -- character --;
Line 48, "acters" should read -- acter --.

Column 21,
Line 39, "linage" should read -- image --.

Column 22,
Line 9, "pre-rotation" should read -- prerotation --;
Line 15, "because" should read -- became --; and
Lines 29 and 63, "post-rotation" should read -- postrotation --.

Column 24,
Line 3, "frequency" should read -- frequency of --; and
Line 10, "pre-rotation" should read -- prerotation --.

Column 26,
Line 30, "post-rotation" should read -- postrotation --.

Column 27,
Line 7, "reduced." should read -- was reduced. --; and
Line 29, "half" should read -- half of --.

Column 31,
Line 54, "that" should be deleted.

Column 32,
Line 13, "and a" should read -- and --; and
Line 59, "steaks" should read -- streaks --.

Column 35,
Line 3, "from" should read -- from being --;
Line 47, "aspect" should read -- aspects --; and
Line 56, "liens" should read -- lines --.

Column 36,
Line 21, "as" should read -- an --;
Line 54, "duration" should read -- the duration --; and
Line 55, "periods" should read -- to periods --.

UNITED STATES PATENT AND TRADEMARK OFFICE

CERTIFICATE OF CORRECTION

PATENT NO. : 6,163,663
DATED : December 19, 2000
INVENTOR(S) : Seiichi Shinohara, et al.

It is certified that error appears in the above-identified patent and that said Letters Patent is hereby corrected as shown below:

Column 38,
Line 21, "reason" should read -- reason. --.

Column 39,
Line 14, "mixture" should read -- a mixture --; and
Line 16, "of" should read -- or --.

Column 40,
Line 28, "the" (second occurrrence) should be deleted; and
Line 47, "and a" should read -- and --.

Column 42,
Line 3, "V.sec.Hz," should read -- V·sec·Hz --;
Line 4, "V.sec.Hz," should read -- V·sec·Hz -- and V.sec. Hz)," should read -- V·sec·Hz), --; and
Line 40, "of the service life" (second occurrence) should be deleted.

Column 43,
Line 62, "desirably" should read -- desirable --; and
Line 66, "is" should read -- are --.

Column 44,
Line 10, "occur" should read -- occurs --; and
Line 20, "are" should read -- is --.

Column 45,
Line 7, grows" should read -- to grow --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,163,663
DATED : December 19, 2000
INVENTOR(S) : Seiichi Shinohara et al.

It is certified that error appears in the above-identified patent and that said Letters Patent is hereby corrected as shown below:

Title page,
Item [56], "(JP 8-262,948)." should read -- (JP 8-262948). --
Item [57], ABSTRACT, line 8, "voltage a" should read -- a voltage --.

Column 6,
Line 62, "potions," should read -- portions, --.

Column 7,
Line 63, "referential codes" should read -- reference characters --.

Column 8,
Lines 1, 3, and 9, "referential codes" should read -- reference characters --; and
Line 62, "highest" should read -- highest. --.

Column 9,
Line 16, "reduced," should read -- was reduced, --;
Line 19, "increased." should read -- was increased. --;
Line 27, "ratio" should read -- ratio of --;
Lines 42, and 44, "referential" should read -- reference --.

Column 14,
Line 17, "reduced," should read -- was reduced, --;
Line 19, "increased." should read -- was increased. --;
Line 20, "The" should read -- This --;
Lines 55, and 57, "referential" should read -- reference --.

Column 15,
Line 44, "was improved" should be deleted.

Column 16,
Line 46, "halt" should read -- half --; and
Line 67, "is" should read -- are --.

UNITED STATES PATENT AND TRADEMARK OFFICE

CERTIFICATE OF CORRECTION

PATENT NO. : 6,163,663
DATED : December 19, 2000
INVENTOR(S) : Seiichi Shinohara et al.

It is certified that error appears in the above-identified patent and that said Letters Patent is hereby corrected as shown below:

Column 17,
Line 1, "station" should read -- stage --; and
Line 22, "develops" should read -- develop --.

Column 18,
Line 11, "is" should be deleted;
Line 46, "characters" should read -- character --;
Line 48, "acters" should read -- acter --.

Column 21,
Line 39, "linage" should read -- image --.

Column 22,
Line 9, "pre-rotation" should read -- prerotation --;
Line 15, "because" should read -- became --; and
Lines 29, and 63, "post-rotation" should read -- postrotation --.

Column 24,
Line 3, "frequency" should read -- frequency of --; and
Line 10, "pre-rotation" should read -- prerotation --.

Column 26,
Line 30, "post-rotation" should read -- postrotation --.

Column 27,
Line 7, "reduced." should read -- was reduced. --; and
Line 29, "half" should read -- half of --.

Column 31,
Line 54, "that" should be deleted.

UNITED STATES PATENT AND TRADEMARK OFFICE

CERTIFICATE OF CORRECTION

PATENT NO. : 6,163,663
DATED : December 19, 2000
INVENTOR(S) : Seiichi Shinohara et al.

It is certified that error appears in the above-identified patent and that said Letters Patent is hereby corrected as shown below:

Column 32,
Line 13, "and a" should read -- and; and
Line 59, "steaks" should read -- streaks --.

Column 35,
Line 3, "from" should read -- from being --;
Line 47, "aspect" should read -- aspects --; and
Line 56, "leins" should read -- lines --.

Column 36,
Line 21, "as" should read -- an --;
Line 54, "duration" should read -- the duration --; and
Line 55, "periods" should read -- to periods --.

Column 38,
Line 21, "reason" should read -- reason. --.

Column 39,
Line 14, "mixture" should read -- a mixture --; and
Line 16, "of" should read -- or --.

Column 40,
Line 28, "the" (second occurrence) should be deleted; and
Line 47, "and a" should read -- and --.

Column 42,
Line 3, "V .sec.Hz," should read -- V·sec·Hz --;
Line 4, "V.sec.Hz," should read -- V·sec·Hz -- and V.sec.Hz),"
should read -- V·sec·Hz), --; and
Line 40, "of the service life" (second occurrence) should be deleted.

UNITED STATES PATENT AND TRADEMARK OFFICE

CERTIFICATE OF CORRECTION

PATENT NO. : 6,163,663
DATED : December 19, 2000
INVENTOR(S) : Seiichi Shinohara et al.

It is certified that error appears in the above-identified patent and that said Letters Patent is hereby corrected as shown below:

Column 43,
Line 62, "desirably" should read -- desirable --; and
Line 66, "is" should read -- are --.

Column 44,
Line 10, "occur" should read -- occurs --; and
Line 20, "are" should read -- is --.

Column 45,
Line 7, "grows" should read -- to grow --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*